US009494348B2

(12) United States Patent
Ishimura et al.

(10) Patent No.: US 9,494,348 B2
(45) Date of Patent: Nov. 15, 2016

(54) AIR-CONDITIONING APPARATUS

(75) Inventors: Katsuhiro Ishimura, Tokyo (JP); Koji Yamashita, Tokyo (JP); Hiroyuki Morimoto, Tokyo (JP); Shinichi Wakamoto, Tokyo (JP); Naofumi Takenaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 521 days.

(21) Appl. No.: 14/110,773

(22) PCT Filed: May 23, 2011

(86) PCT No.: PCT/JP2011/002857

§ 371 (c)(1),
(2), (4) Date: Oct. 9, 2013

(87) PCT Pub. No.: WO2012/160597

PCT Pub. Date: Nov. 29, 2012

(65) Prior Publication Data

US 2014/0026605 A1 Jan. 30, 2014

(51) Int. Cl.

| | |
|---|---|
| ***F25B 29/00*** | (2006.01) |
| ***F25B 1/00*** | (2006.01) |
| ***F25B 41/04*** | (2006.01) |
| ***F25B 13/00*** | (2006.01) |

(52) U.S. Cl.

CPC ..... *F25B 29/003* (2013.01); *F25B 1/00* (2013.01); *F25B 13/00* (2013.01); *F25B 29/00* (2013.01); *F25B 41/043* (2013.01); *F25B 2313/0272* (2013.01); *F25B 2400/13* (2013.01); *F25B 2600/2513* (2013.01)

(58) Field of Classification Search

CPC ..... F25B 1/00; F25B 13/00; F25B 29/00; F25B 29/003; F25B 41/043; F25B 2313/0272; F25B 2400/13; F25B 2600/2513

See application file for complete search history.

(56) References Cited

U.S. PATENT DOCUMENTS 5,475,985 A * 12/1995 Heinrichs ..... F04B 39/06 62/117
6,230,506 B1 * 5/2001 Nishida ..... B60H 1/00907 62/160

FOREIGN PATENT DOCUMENTS

| | | | |
|---|---|---|---|
| EP | 2 211 127 A1 | | 7/2010 |
| JP | 07-260262 A | | 10/1995 |
| JP | 08-210709 A | | 8/1996 |
| JP | 09079667 A | * | 3/1997 |
| JP | 10-185343 A | | 7/1998 |
| JP | 10-325622 A | | 12/1998 |

(Continued)

OTHER PUBLICATIONS

International Search Report of the International Searching Authority mailed Aug. 16, 2011 for the corresponding international application No. PCT/JP2011/002857 (and English translation).

(Continued)

*Primary Examiner* — Marc Norman
(74) *Attorney, Agent, or Firm* — Posz Law Group, PLC

(57) ABSTRACT

An air-conditioning apparatus controls an opening degree of at least one of a second expansion device and a third expansion device to adjust the amount of refrigerant to flow through the injection pipe.

12 Claims, 31 Drawing Sheets

(56) References Cited

FOREIGN PATENT DOCUMENTS

| | | | |
|---|---|---|---|
| JP | 2002-107002 | A | 4/2002 |
| JP | 2004-271105 | A | 9/2004 |
| JP | 2006-258343 | A | 9/2006 |
| JP | 2007-263443 | A | 10/2007 |
| JP | 2009-270776 | A | 11/2009 |
| JP | 2010-139205 | A | 6/2010 |
| JP | 2010-156493 | A | 7/2010 |
| JP | 2011-047567 | A | 3/2011 |
| JP | 2011-052883 | A | 3/2011 |
| WO | 2011/052055 | A1 | 5/2011 |

OTHER PUBLICATIONS

Office Action mailed Jan. 6, 2015 issued in corresponding JP patent application No. 2013-516072 (with English translation).
Extended European Search Report mailed Sep. 23, 2014 issued in corresponding EP patent application No. 11866067.9.

* cited by examiner

FIG. 15

| CT [°C] | ET [°C] | SH [°C] | SC [°C] | Gr [kg/h] | Gr,inj [kg/h] | EXPANSION DEVICE 14b | | |
|---|---|---|---|---|---|---|---|---|
| | | | | | | Cv VALUE [-] | NUMBER OF PULSES [-] | AMOUNT OF CHANGE IN NUMBER OF PULSES [-] |
| 59 | 0 | 2 | 5 | 440.6 | 42.8 | 0.010 | 92 | −1 |
| 49 | 0 | 2 | 5 | 430.6 | 40.0 | 0.011 | 93 | 0 |
| 39 | 0 | 2 | 5 | 395.8 | 35.5 | 0.011 | 95 | +2 |

FIG. 16

| CT [°C] | ET [°C] | INTERME-DIATE PRESSURE [°C] | SH [°C] | SC [°C] | Gr [kg/h] | Gr,inj [kg/h] | EXPANSION DEVICE 14b | | | EXPANSION DEVICE 14a | |
|---|---|---|---|---|---|---|---|---|---|---|---|
| | | | | | | | Cv VALUE [-] | NUMBER OF PULSES [-] | AMOUNT OF CHANGE IN NUMBER OF PULSES [-] | Cv VALUE [-] | NUMBER OF PULSES [-] |
| 49 | 0 | 30 | 2 | 5 | 365.5 | 30.9 | 0.012 | 97 | 0 | 0.188 | 642 |
| 49 | 0 | 20 | 2 | 5 | 365.5 | 29.1 | 0.015 | 108 | +10 | 0.286 | 944 |
| 49 | 0 | 10 | 2 | 5 | 365.5 | 27.6 | 0.029 | 149 | +50 | 0.495 | 1591 |

FIG. 17

| CT [°C] | ET [°C] | INTERME-DIATE PRESSURE [°C] | SH [°C] | SC [°C] | Gr [kg/h] | Gr,inj [kg/h] | EXPANSION DEVICE 14b | | | EXPANSION DEVICE 14a | |
|---|---|---|---|---|---|---|---|---|---|---|---|
| | | | | | | | Cv VALUE [-] | NUMBER OF PULSES [-] | AMOUNT OF CHANGE IN NUMBER OF PULSES [-] | Cv VALUE [-] | NUMBER OF PULSES [-] |
| 49 | 0 | 30 | 2 | 5 | 365.5 | 30.9 | 0.012 | 97 | 0 | 0.188 | 642 |
| 49 | 0 | 20 | 2 | 5 | 365.5 | 29.1 | 0.015 | 108 | +10 | 0.286 | 944 |
| 49 | 0 | 10 | 2 | 5 | 365.5 | 27.6 | 0.029 | 149 | +50 | 0.495 | 1591 |

FIG. 18

| CT [°C] | ET [°C] | SH [°C] | SC [°C] | Gr [kg/h] | Gr,inj [kg/h] | EXPANSION DEVICE 14b | | |
|---|---|---|---|---|---|---|---|---|
| | | | | | | Cv VALUE [-] | NUMBER OF PULSES [-] | AMOUNT OF CHANGE IN NUMBER OF PULSES [-] |
| 49 | 0 | 2 | 5 | 430.6 | 41.7 | 0.011 | 96 | 0 |

FIG. 19

| CT [°C] | ET [°C] | INTERMEDIATE PRESSURE [°C] | SH [°C] | SC [°C] | Gr [kg/h] | Gr,inj [kg/h] | EXPANSION DEVICE 14b Cv VALUE [-] | EXPANSION DEVICE 14b NUMBER OF PULSES [-] | EXPANSION DEVICE 14b AMOUNT OF CHANGE IN NUMBER OF PULSES [-] | EXPANSION DEVICE 14a Cv VALUE [-] | EXPANSION DEVICE 14a NUMBER OF PULSES [-] |
|---|---|---|---|---|---|---|---|---|---|---|---|
| 49 | 0 | 17 | 2 | 5 | 365.5 | 28.6 | 0.017 | 113 | −140 | 0.552 | 1770 |
| 49 | 0 | 12 | 2 | 5 | 365.5 | 27.9 | 0.023 | 132 | −120 | 0.710 | 2256 |
| 49 | 0 | 7 | 2 | 5 | 365.5 | 27.2 | 0.062 | 252 | 0 | 0.950 | 3000 |

FIG. 20

| CT [°C] | ET [°C] | INTERMEDIATE PRESSURE [°C] | SH [°C] | SC [°C] | Gr [kg/h] | Gr,inj [kg/h] | EXPANSION DEVICE 14b Cv VALUE [-] | EXPANSION DEVICE 14b NUMBER OF PULSES [-] | EXPANSION DEVICE 14b AMOUNT OF CHANGE IN NUMBER OF PULSES [-] | EXPANSION DEVICE 14a Cv VALUE [-] | EXPANSION DEVICE 14a NUMBER OF PULSES [-] |
|---|---|---|---|---|---|---|---|---|---|---|---|
| 49 | 0 | 7 | 2 | 5 | 365.5 | 27.2 | 0.062 | 252 | 0 | 0.950 | 3000 |
| 49 | −10 | 7 | 2 | 5 | 316.8 | 21.1 | 0.014 | 104 | −150 | 0.592 | 1891 |

FIG. 21

| OPERATION MODE | EXPANSION DEVICE 14a Cv VALUE [-] | EXPANSION DEVICE 14a NUMBER OF PULSES [-] | EXPANSION DEVICE 14a AMOUNT OF CHANGE IN NUMBER OF PULSES [-] | EXPANSION DEVICE 14b Cv VALUE [-] | EXPANSION DEVICE 14b NUMBER OF PULSES [-] | EXPANSION DEVICE 14b AMOUNT OF CHANGE IN NUMBER OF PULSES [-] |
|---|---|---|---|---|---|---|
| HEATING ONLY OPERATION MODE | 0.188 | 642 | ±2360 | 0.012 | 97 | ±160 |
| HEATING MAIN OPERATION MODE | 0.950 | 3000 | | 0.062 | 252 | |

FIG. 22

| OPERATION MODE | EXPANSION DEVICE 14a Cv VALUE [-] | EXPANSION DEVICE 14a NUMBER OF PULSES [-] | EXPANSION DEVICE 14a AMOUNT OF CHANGE IN NUMBER OF PULSES [-] | EXPANSION DEVICE 14b Cv VALUE [-] | EXPANSION DEVICE 14b NUMBER OF PULSES [-] | EXPANSION DEVICE 14b AMOUNT OF CHANGE IN NUMBER OF PULSES [-] |
|---|---|---|---|---|---|---|
| HEATING MAIN OPERATION MODE | 0.950 | 3000 | ±0 | 0.062 | 252 | ±160 |
| COOLING MAIN OPERATION MODE | – | – | | 0.011 | 96 | |

| OPERATION MODE | EXPANSION DEVICE 14b | | |
|---|---|---|---|
| | Cv VALUE [-] | NUMBER OF PULSES [-] | AMOUNT OF CHANGE IN NUMBER OF PULSES [-] |
| COOLING MAIN OPERATION MODE | 0.011 | 96 | ±3 |
| COOLING ONLY OPERATION MODE | 0.011 | 93 | |

| OPERATION MODE | CT [°C] | ET [°C] | INTERMEDIATE PRESSURE [°C] | SH [°C] | SC [°C] | PRESSURE DIFFERENTIAL [°C] | EXPANSION DEVICE 14a | |
|---|---|---|---|---|---|---|---|---|
| | | | | | | | Cv VALUE [-] | NUMBER OF PULSES [-] |
| HEATING ONLY OPERATION MODE | 49 | 0 | 30 | 2 | 5 | 30 | 0.188 | 642 |
| ↑ | 49 | 0 | 20 | 2 | 5 | 20 | 0.286 | 944 |
| ↑ | 49 | 0 | 10 | 2 | 5 | 10 | 0.495 | 1591 |
| HEATING MAIN OPERATION MODE | 49 | 0 | 17 | 2 | 5 | 17 | 0.552 | 1770 |
| ↑ | 49 | 0 | 12 | 2 | 5 | 12 | 0.710 | 2256 |
| ↑ | 49 | 0 | 7 | 2 | 5 | 7 | 0.950 | 3000 |

FIG. 36

| CT [°C] | ET [°C] | SH [°C] | SC [°C] | Gr [kg/h] | Gr,inj [kg/h] | EXPANSION DEVICE 14b | | |
|---|---|---|---|---|---|---|---|---|
| | | | | | | Cv VALUE [-] | NUMBER OF PULSES [-] | AMOUNT OF CHANGE IN NUMBER OF PULSES [-] |
| 59 | 0 | 2 | 5 | 440.6 | 42.8 | 0.010 | 91 | -2 |
| 49 | 0 | 2 | 5 | 430.6 | 40.0 | 0.011 | 93 | 0 |
| 39 | 0 | 2 | 5 | 395.8 | 35.5 | 0.011 | 94 | +1 |

FIG. 37

| CT [°C] | ET [°C] | INTERME-DIATE PRESSURE [°C] | SH [°C] | SC [°C] | Gr [kg/h] | Gr,inj [kg/h] | EXPANSION DEVICE 14b | | | EXPANSION DEVICE 14a | |
|---|---|---|---|---|---|---|---|---|---|---|---|
| | | | | | | | Cv VALUE [-] | NUMBER OF PULSES [-] | AMOUNT OF CHANGE IN NUMBER OF PULSES [-] | Cv VALUE [-] | NUMBER OF PULSES [-] |
| 49 | 0 | 30 | 2 | 5 | 365.5 | 34.0 | 0.013 | 101 | 0 | 0.188 | 642 |
| 49 | 0 | 20 | 2 | 5 | 365.5 | 34.0 | 0.018 | 116 | +15 | 0.286 | 944 |
| 49 | 0 | 10 | 2 | 5 | 365.5 | 34.0 | 0.035 | 170 | +70 | 0.495 | 1591 |

FIG. 38

| CT [°C] | ET [°C] | INTERME-DIATE PRESSURE [°C] | SH [°C] | SC [°C] | Gr [kg/h] | Gr,inj [kg/h] | EXPANSION DEVICE 14b | | | EXPANSION DEVICE 14a | |
|---|---|---|---|---|---|---|---|---|---|---|---|
| | | | | | | | Cv VALUE [-] | NUMBER OF PULSES [-] | AMOUNT OF CHANGE IN NUMBER OF PULSES [-] | Cv VALUE [-] | NUMBER OF PULSES [-] |
| 49 | 0 | 30 | 2 | 5 | 365.5 | 34.0 | 0.013 | 101 | 0 | 0.188 | 642 |
| 49 | -15 | 30 | 2 | 5 | 266.5 | 20.7 | 0.007 | 81 | -20 | 0.121 | 433 |
| 49 | -30 | 30 | 2 | 5 | 152.7 | 10.2 | 0.003 | 70 | -30 | 0.064 | 259 |

FIG. 39

| CT [°C] | ET [°C] | SH [°C] | SC [°C] | QUALITY [-] | Gr [kg/h] | Gr,inj [kg/h] | EXPANSION DEVICE 14b | | |
|---|---|---|---|---|---|---|---|---|---|
| | | | | | | | Cv VALUE [-] | NUMBER OF PULSES [-] | AMOUNT OF CHANGE IN NUMBER OF PULSES [-] |
| 49 | 0 | 2 | 5 | 0.9 | 430.6 | 140.3 | 0.039 | 180 | +50 |
| 49 | 0 | 2 | 5 | 0.6 | 430.6 | 78.5 | 0.022 | 127 | 0 |
| 49 | 0 | 2 | 5 | 0.3 | 430.6 | 54.5 | 0.015 | 106 | -20 |

FIG. 40

| CT [°C] | ET [°C] | INTERMEDIATE PRESSURE [°C] | SH [°C] | SC [°C] | QUALITY [-] | Gr [kg/h] | Gr,inj [kg/h] | EXPANSION DEVICE 14b Cv VALUE [-] | EXPANSION DEVICE 14b NUMBER OF PULSES [-] | EXPANSION DEVICE 14b AMOUNT OF CHANGE IN NUMBER OF PULSES [-] | EXPANSION DEVICE 14a Cv VALUE [-] | EXPANSION DEVICE 14a NUMBER OF PULSES [-] |
|---|---|---|---|---|---|---|---|---|---|---|---|---|
| 49 | 0 | 17 | 2 | 5 | 0.6 | 365.5 | 58.4 | 0.035 | 169 | −275 | 0.552 | 1770 |
| 49 | 0 | 12 | 2 | 5 | 0.6 | 365.5 | 57.1 | 0.048 | 208 | −240 | 0.710 | 2256 |
| 49 | 0 | 7 | 2 | 5 | 0.6 | 365.5 | 55.8 | 0.128 | 455 | 0 | 0.950 | 3000 |

FIG. 41

| CT [°C] | ET [°C] | INTERMEDIATE PRESSURE [°C] | SH [°C] | SC [°C] | QUALITY [-] | Gr [kg/h] | Gr,inj [kg/h] | EXPANSION DEVICE 14b Cv VALUE [-] | EXPANSION DEVICE 14b NUMBER OF PULSES [-] | EXPANSION DEVICE 14b AMOUNT OF CHANGE IN NUMBER OF PULSES [-] | EXPANSION DEVICE 14a Cv VALUE [-] | EXPANSION DEVICE 14a NUMBER OF PULSES [-] |
|---|---|---|---|---|---|---|---|---|---|---|---|---|
| 49 | 0 | 7 | 2 | 5 | 0.6 | 365.5 | 55.8 | 0.128 | 455 | 0 | 0.950 | 3000 |
| 49 | −10 | 7 | 2 | 5 | 0.6 | 316.8 | 40.8 | 0.028 | 146 | −300 | 0.592 | 1891 |

FIG. 42

| OPERATION MODE | EXPANSION DEVICE 14a Cv VALUE [-] | EXPANSION DEVICE 14a NUMBER OF PULSES [-] | EXPANSION DEVICE 14a AMOUNT OF CHANGE IN NUMBER OF PULSES [-] | EXPANSION DEVICE 14b Cv VALUE [-] | EXPANSION DEVICE 14b NUMBER OF PULSES [-] | EXPANSION DEVICE 14b AMOUNT OF CHANGE IN NUMBER OF PULSES [-] |
|---|---|---|---|---|---|---|
| HEATING ONLY OPERATION MODE | 0.188 | 642 | ±2360 | 0.013 | 101 | ±350 |
| HEATING MAIN OPERATION MODE | 0.950 | 3000 | | 0.128 | 455 | |

FIG. 43

| OPERATION MODE | EXPANSION DEVICE 14a | | | EXPANSION DEVICE 14b | | |
|---|---|---|---|---|---|---|
| | Cv VALUE [-] | NUMBER OF PULSES [-] | AMOUNT OF CHANGE IN NUMBER OF PULSES [-] | Cv VALUE [-] | NUMBER OF PULSES [-] | AMOUNT OF CHANGE IN NUMBER OF PULSES [-] |
| HEATING MAIN OPERATION MODE | 0.950 | 3000 | ±0 | 0.128 | 455 | ±330 |
| COOLING MAIN OPERATION MODE | - | - | | 0.022 | 127 | |

FIG. 44

| OPERATION MODE | EXPANSION DEVICE 14b | | |
|---|---|---|---|
| | Cv VALUE [-] | NUMBER OF PULSES [-] | AMOUNT OF CHANGE IN NUMBER OF PULSES [-] |
| COOLING MAIN OPERATION MODE | 0.022 | 127 | ±35 |
| COOLING ONLY OPERATION MODE | 0.011 | 93 | |

FIG. 45

| OPERATION MODE | CT [°C] | ET [°C] | INTERMEDIATE PRESSURE [°C] | SH [°C] | SC [°C] | PRESSURE DIFFERENTIAL [°C] | EXPANSION DEVICE 14a | |
|---|---|---|---|---|---|---|---|---|
| | | | | | | | Cv VALUE [-] | NUMBER OF PULSES [-] |
| HEATING ONLY OPERATION MODE | 49 | 0 | 30 | 2 | 5 | 30 | 0.188 | 642 |
| ↑ | 49 | 0 | 20 | 2 | 5 | 20 | 0.286 | 944 |
| ↑ | 49 | 0 | 10 | 2 | 5 | 10 | 0.495 | 1591 |
| HEATING MAIN OPERATION MODE | 49 | 0 | 17 | 2 | 5 | 17 | 0.552 | 1770 |
| ↑ | 49 | 0 | 12 | 2 | 5 | 12 | 0.710 | 2256 |
| ↑ | 49 | 0 | 7 | 2 | 5 | 7 | 0.950 | 3000 |

FIG. 56

| CT [°C] | ET [°C] | SH [°C] | SC [°C] | Gr [kg/h] | Gr,inj [kg/h] | EXPANSION DEVICE 14b | | |
|---|---|---|---|---|---|---|---|---|
| | | | | | | Cv VALUE [-] | NUMBER OF PULSES [-] | AMOUNT OF CHANGE IN NUMBER OF PULSES [-] |
| 59 | 0 | 2 | 5 | 440.6 | 42.0 | 0.010 | 92 | -2 |
| 49 | 0 | 2 | 5 | 430.6 | 38.1 | 0.011 | 94 | 0 |
| 39 | 0 | 2 | 5 | 395.8 | 34.1 | 0.012 | 96 | +2 |

FIG. 57

| CT [°C] | ET [°C] | INTERME-DIATE PRESSURE [°C] | SH [°C] | SC [°C] | Gr [kg/h] | Gr,inj [kg/h] | EXPANSION DEVICE 14b | | | EXPANSION DEVICE 14a | |
|---|---|---|---|---|---|---|---|---|---|---|---|
| | | | | | | | Cv VALUE [-] | NUMBER OF PULSES [-] | AMOUNT OF CHANGE IN NUMBER OF PULSES [-] | Cv VALUE [-] | NUMBER OF PULSES [-] |
| 49 | 0 | 30 | 2 | 5 | 365.5 | 34.0 | 0.019 | 119 | 0 | 0.188 | 642 |
| 49 | -15 | 30 | 2 | 5 | 266.5 | 20.7 | 0.010 | 90 | -30 | 0.121 | 433 |
| 49 | -30 | 30 | 2 | 5 | 152.7 | 10.2 | 0.004 | 74 | -45 | 0.064 | 259 |

FIG. 58

| CT [°C] | ET [°C] | INTERME-DIATE PRESSURE [°C] | SH [°C] | SC [°C] | Gr [kg/h] | Gr,inj [kg/h] | EXPANSION DEVICE 14b | | | EXPANSION DEVICE 14a | |
|---|---|---|---|---|---|---|---|---|---|---|---|
| | | | | | | | Cv VALUE [-] | NUMBER OF PULSES [-] | AMOUNT OF CHANGE IN NUMBER OF PULSES [-] | Cv VALUE [-] | NUMBER OF PULSES [-] |
| 49 | 0 | 30 | 2 | 5 | 365.5 | 34.0 | 0.019 | 119 | 0 | 0.188 | 642 |
| 49 | 0 | 20 | 2 | 5 | 365.5 | 34.0 | 0.031 | 156 | +40 | 0.286 | 944 |
| 49 | 0 | 10 | 2 | 5 | 365.5 | 34.0 | 0.072 | 283 | +160 | 0.495 | 1591 |

FIG. 59

| CT [°C] | ET [°C] | SH [°C] | SC [°C] | QUALITY [-] | Gr [kg/h] | Gr,inj [kg/h] | EXPANSION DEVICE 14b | | |
|---|---|---|---|---|---|---|---|---|---|
| | | | | | | | Cv VALUE [-] | NUMBER OF PULSES [-] | AMOUNT OF CHANGE IN NUMBER OF PULSES [-] |
| 49 | 0 | 2 | 5 | 0.9 | 430.6 | 140.3 | 0.105 | 384 | +185 |
| 49 | 0 | 2 | 5 | 0.6 | 430.6 | 78.5 | 0.045 | 200 | 0 |
| 49 | 0 | 2 | 5 | 0.3 | 430.6 | 54.5 | 0.024 | 134 | −65 |

FIG. 60

| CT [°C] | ET [°C] | INTERME-DIATE PRESSURE [°C] | SH [°C] | SC [°C] | QUALITY [-] | Gr [kg/h] | Gr,inj [kg/h] | EXPANSION DEVICE 14b | | | EXPANSION DEVICE 14a | |
|---|---|---|---|---|---|---|---|---|---|---|---|---|
| | | | | | | | | Cv VALUE [-] | NUMBER OF PULSES [-] | AMOUNT OF CHANGE IN NUMBER OF PULSES [-] | Cv VALUE [-] | NUMBER OF PULSES [-] |
| 49 | 0 | 17 | 2 | 5 | 0.6 | 365.5 | 58.4 | 0.107 | 391 | −1010 | 0.552 | 1770 |
| 49 | 0 | 12 | 2 | 5 | 0.6 | 365.5 | 57.1 | 0.154 | 536 | −865 | 0.710 | 2256 |
| 49 | 0 | 7 | 2 | 5 | 0.6 | 365.5 | 55.8 | 0.434 | 1403 | 0 | 0.950 | 3000 |

FIG. 61

| CT [°C] | ET [°C] | INTERME-DIATE PRESSURE [°C] | SH [°C] | SC [°C] | QUALITY [-] | Gr [kg/h] | Gr,inj [kg/h] | EXPANSION DEVICE 14b | | | EXPANSION DEVICE 14a | |
|---|---|---|---|---|---|---|---|---|---|---|---|---|
| | | | | | | | | Cv VALUE [-] | NUMBER OF PULSES [-] | AMOUNT OF CHANGE IN NUMBER OF PULSES [-] | Cv VALUE [-] | NUMBER OF PULSES [-] |
| 49 | 0 | 7 | 2 | 5 | 0.6 | 365.5 | 55.8 | 0.434 | 1403 | 0 | 0.950 | 3000 |
| 49 | −10 | 7 | 2 | 5 | 0.6 | 316.8 | 40.8 | 0.094 | 351 | −1050 | 0.592 | 1891 |

FIG. 62

| OPERATION MODE | EXPANSION DEVICE 14a | | | EXPANSION DEVICE 14b | | |
|---|---|---|---|---|---|---|
| | Cv VALUE [-] | NUMBER OF PULSES [-] | AMOUNT OF CHANGE IN NUMBER OF PULSES [-] | Cv VALUE [-] | NUMBER OF PULSES [-] | AMOUNT OF CHANGE IN NUMBER OF PULSES [-] |
| HEATING ONLY OPERATION MODE | 0.188 | 642 | ±2360 | 0.019 | 119 | ±1285 |
| HEATING MAIN OPERATION MODE | 0.950 | 3000 | | 0.434 | 1403 | |

FIG. 63

| OPERATION MODE | EXPANSION DEVICE 14a | | | EXPANSION DEVICE 14b | | |
|---|---|---|---|---|---|---|
| | Cv VALUE [-] | NUMBER OF PULSES [-] | AMOUNT OF CHANGE IN NUMBER OF PULSES [-] | Cv VALUE [-] | NUMBER OF PULSES [-] | AMOUNT OF CHANGE IN NUMBER OF PULSES [-] |
| HEATING MAIN OPERATION MODE | 0.950 | 3000 | ±0 | 0.434 | 1403 | ±1200 |
| COOLING MAIN OPERATION MODE | – | – | | 0.045 | 200 | |

FIG. 64

| OPERATION MODE | EXPANSION DEVICE 14b | | |
|---|---|---|---|
| | Cv VALUE [-] | NUMBER OF PULSES [-] | AMOUNT OF CHANGE IN NUMBER OF PULSES [-] |
| COOLING MAIN OPERATION MODE | 0.045 | 200 | ±105 |
| COOLING ONLY OPERATION MODE | 0.011 | 94 | |

FIG. 65

| OPERATION MODE | CT [°C] | ET [°C] | INTERMEDIATE PRESSURE [°C] | SH [°C] | SC [°C] | PRESSURE DIFFERENTIAL [°C] | EXPANSION DEVICE 14a | |
|---|---|---|---|---|---|---|---|---|
| | | | | | | | Cv VALUE [-] | NUMBER OF PULSES [-] |
| HEATING ONLY OPERATION MODE | 49 | 0 | 30 | 2 | 5 | 30 | 0.188 | 642 |
| ↑ | 49 | 0 | 20 | 2 | 5 | 20 | 0.286 | 944 |
| ↑ | 49 | 0 | 10 | 2 | 5 | 10 | 0.495 | 1591 |
| HEATING MAIN OPERATION MODE | 49 | 0 | 17 | 2 | 5 | 17 | 0.552 | 1770 |
| ↑ | 49 | 0 | 12 | 2 | 5 | 12 | 0.710 | 2256 |
| ↑ | 49 | 0 | 7 | 2 | 5 | 7 | 0.950 | 3000 |

AIR-CONDITIONING APPARATUS

CROSS REFERENCE TO RELATED APPLICATION

This application is a U.S. national stage application of International Application No. PCT/JP2011/002857 filed on May 23, 2011.

TECHNICAL FIELD

The present invention relates to air-conditioning apparatuses applicable to, for example, multi-air-conditioning apparatuses for buildings and the like, and more specifically to an air-conditioning apparatus including an injection circuit.

BACKGROUND ART

Various air-conditioning apparatuses including injection circuits have hitherto been proposed. One of such apparatuses is a "refrigeration apparatus including a liquid injection circuit in which a compressor, a condenser, a receiver, a pressure reducing device, and an evaporator are sequentially connected in a loop and in which a liquid refrigerant is supplied from the receiver to the compressor, wherein the liquid injection circuit is provided with a capillary tube and a flow control valve and the flow regulating valve adjusts the amount of injection on the basis of the discharge temperature of the compressor" (see, for example, Patent Literature 1). This refrigeration apparatus is designed to detect the discharge temperature of the compressor, change the opening degree of the flow regulating valve in accordance with the detected temperature, and control the injection flow rate.

There is also a "heat pump air conditioner for cold climate regions in which at least a heat source side heat exchanger, a pressure reducing device, a use side heat exchanger, and a scroll type compressor are sequentially connected to form a refrigeration cycle, and a refrigerant circuit that injects a liquid refrigerant into a compression mechanism in the scroll compressor is provided" (see, for example, Patent Literature 2). This heat pump air conditioner is designed to perform injection to control the discharge temperature of the compressor even in a case where the circulation path in the refrigeration cycle is reversed (to switch between the cooling and heating operations).

There is also an "air-conditioning apparatus including a compressor, a plurality of indoor heat exchangers, and a plurality of outdoor heat exchangers; a plurality of outdoor-unit-side flow path switching units each connected to a first connecting port of one of the outdoor heat exchangers, a discharge port of the compressor, and a suction port of the compressor, each outdoor-unit-side flow path switching unit switching a refrigerant flow path to a refrigerant flow path through which a refrigerant flows from the discharge port of the compressor to the first connecting port of the corresponding one of the outdoor heat exchangers or to a refrigerant flow path through which a refrigerant flows from the first connecting port of the corresponding one of the outdoor heat exchangers to the suction port of the compressor; a plurality of indoor-unit-side flow path switching units each connected to a first connecting port of one of the indoor heat exchangers, the discharge port of the compressor, and the suction port of the compressor, each indoor-unit-side flow path switching unit switching a refrigerant flow path to a refrigerant flow path through which a refrigerant flows from the discharge port of the compressor to the first connecting port of the corresponding one of the indoor heat exchangers or to a refrigerant flow path through which a refrigerant flows from the first connecting port of the corresponding one of the indoor heat exchangers to the suction port of the compressor; a connecting pipe that connects second connecting ports of the outdoor heat exchangers to second connecting ports of the indoor heat exchangers; a pressure reducing device disposed in the connecting pipe; and an injection circuit whose one end is connected to the connecting pipe between the pressure reducing device and the indoor heat exchangers and whose other end is connected to a compression process in the compressor, the injection circuit injecting a refrigerant flowing through the connecting pipe into the compression process in the compressor" (see, for example, Patent Literature 3). This air-conditioning apparatus is capable of performing injection in the cooling, heating, or cooling and heating mixed operation, and generates an intermediate pressure to perform injection during heating.

CITATION LIST

Patent Literature

Patent Literature 1: Japanese Patent Application Laid-Open (JP-A) No, H07-260262 (Page 4, FIG. 1)
Patent Literature 2: Japanese Patent Application Laid-Open (JP-A) No. H08-210709 (Page 8, FIG. 2, etc.)
Patent Literature 3: Japanese Patent Application Laid-Open (JP-A) No. 2010-139205 (Page 24, FIG. 1, etc.)

SUMMARY OF INVENTION

Technical Problem

In the refrigeration apparatus described in Patent Literature 1, however, injection is performed in a limited operation mode. Hence, the refrigeration apparatus cannot be directly applied to a refrigeration cycle apparatus such as an air-conditioning apparatus having various operation modes.

The air-conditioning apparatus described in Patent Literature 2 is capable of performing injection in a case where the circulation path in the refrigeration cycle is reversed (to switch between the cooling and heating operations) and reducing the discharge temperature of the compressor. However, the air-conditioning apparatus does not support the cooling and heating mixed operation, and thus cannot be directly applied to a refrigeration cycle apparatus such as an air-conditioning apparatus having various operation modes.

The air-conditioning apparatus described in Patent Literature 3 is capable of executing the injection operation in the cooling, heating, or cooling and heating mixed operation. However, a specific way of controlling the intermediate pressure while the injection operation is being executed is not specified. That is, there may be room for further improvement in the control of the intermediate pressure while the injection operation is being executed in the cooling, heating, or cooling and heating mixed operation.

The present invention has been made in order to address the foregoing problems, and an object thereof is to provide an air-conditioning apparatus that is capable of the injection operation regardless of the operation mode currently being executed, and that controls the intermediate pressure and the injection flow rate in accordance with the operation mode currently being executed, and controls the discharge temperature of the refrigerant discharged from a compressor so that the discharge temperature is not excessively high, thereby greatly increasing reliability.

Solution to Problem

An air-conditioning apparatus according to the present invention is an air-conditioning apparatus including a refrigerant circuit formed by connecting a compressor having a low-pressure shell structure, a refrigerant flow switching device, a first heat exchanger, a first expansion device, and second heat exchangers by using a pipe, the air-conditioning apparatus being capable of, by an operation of the refrigerant flow switching device, switching between a cooling operation and a heating operation, the cooling operation being an operation in which a high-pressure refrigerant flows through the first heat exchanger so that the first heat exchanger operates as a condenser and in which a low-pressure refrigerant flows through at least one or all of the second heat exchangers so that the at least one or all of the second heat exchangers operate as an evaporator or evaporators, the heating operation being an operation in which a low-pressure refrigerant flows through the first heat exchanger so that the first heat exchanger operates as an evaporator and in which a high-pressure refrigerant flows through at least one or all of the second heat exchangers so that the at least one or all of the second heat exchangers operate as a condenser or condensers. The air-conditioning apparatus includes an injection pipe through which the refrigerant is directed into a compression chamber of the compressor, which is in a compression process, from outside the compressor via an opening port formed in part of the compression chamber; a second expansion device that reduces a pressure of a refrigerant flowing from the second heat exchanger to the first heat exchanger via the first expansion device in the heating operation; a third expansion device disposed in the injection pipe; and a controller that controls an opening degree of at least one of the second expansion device and the third expansion device to adjust an amount of refrigerant that is to flow through the injection pipe.

Advantageous Effects of Invention

According to an air-conditioning apparatus according to the present invention, it is possible to liquify a refrigerant flowing into a second or third expansion device that controls the injection flow rate. It is also possible to achieve stable injection control regardless of the operation mode and to control the discharge temperature of a refrigerant discharged from a compressor so that the discharge temperature is not excessively high.

BRIEF DESCRIPTION OF DRAWINGS

FIG. 15 is an explanatory diagram for explaining the steady-state opening degree of an expansion device for controlling the injection flow rate in the cooling only operation mode of the air-conditioning apparatus according to Embodiment 1 of the present invention.

FIG. 16 is an explanatory diagram for explaining the steady-state opening degrees of an expansion device for controlling the injection flow rate and an expansion device for controlling the intermediate pressure in the heating only operation mode of the air-conditioning apparatus according to Embodiment 1 of the present invention.

FIG. 17 is an explanatory diagram for explaining the steady-state opening degrees of an expansion device for controlling the injection flow rate and an expansion device for controlling the intermediate pressure when the evaporating temperature changes in the heating only operation mode of the air-conditioning apparatus according to Embodiment 1 of the present invention.

FIG. 18 is an explanatory diagram for explaining the steady-state opening degree of an expansion device for controlling the injection flow rate in the cooling main operation mode of the air-conditioning apparatus according to Embodiment 1 of the present invention.

FIG. 19 is an explanatory diagram for explaining the steady-state opening degree of an expansion device for controlling the injection flow rate in the heating main operation mode of the air-conditioning apparatus according to Embodiment 1 of the present invention.

FIG. 20 is an explanatory diagram for explaining the steady-state opening degree of an expansion device for controlling the injection flow rate when the evaporating temperature changes in the heating main operation mode of the air-conditioning apparatus according to Embodiment 1 of the present invention.

FIG. 21 is a diagram illustrating an example of control target values when the operation mode of the air-conditioning apparatus according to Embodiment 1 of the present invention changes from the heating only operation mode to the heating main operation mode.

FIG. 22 is a diagram illustrating an example of control target values when the operation mode of the air-conditioning apparatus according to Embodiment 1 of the present invention changes from the heating main operation mode to the cooling main operation mode.

FIG. 36 is a table illustrating the steady-state opening degrees of an expansion device for controlling the injection flow rate when the condensing temperature changes in the cooling only operation mode of the air-conditioning apparatus according to Embodiment 2 of the present invention.

FIG. 37 is a table illustrating the steady-state opening degrees of an expansion device for controlling the injection flow rate and an expansion device for controlling the intermediate pressure when the intermediate pressure changes in the heating only operation mode of the air-conditioning apparatus according to Embodiment 2 of the present invention.

FIG. 38 is a table illustrating the steady-state opening degrees of an expansion device for controlling the injection flow rate and an expansion device for controlling the intermediate pressure when the evaporating temperature changes in the heating only operation mode of the air-conditioning apparatus according to Embodiment 2 of the present invention.

FIG. 39 is a table illustrating the steady-state opening degrees of an expansion device for controlling the injection flow rate when the indoor heating load (quality) changes in the cooling main operation mode of the air-conditioning apparatus according to Embodiment 2 of the present invention.

FIG. 40 is a table illustrating the steady-state opening degrees of an expansion device for controlling the injection flow rate and an expansion device for controlling the intermediate pressure when the intermediate pressure changes in the heating main operation mode of the air-conditioning apparatus according to Embodiment 2 of the present invention.

FIG. 41 is a table illustrating the steady-state opening degrees of an expansion device for controlling the injection flow rate and an expansion device for controlling the intermediate pressure when the evaporating temperature changes in the heating main operation mode of the air-conditioning apparatus according to Embodiment 2 of the present invention.

FIG. 42 is a table illustrating the control target values of initial opening degrees of an expansion device when the operation mode of the air-conditioning apparatus according to Embodiment 2 of the present invention changes from the heating only operation mode to the heating main operation mode.

FIG. 43 is a table illustrating the control target values of initial opening degrees of an expansion device when the operation mode of the air-conditioning apparatus according to Embodiment 2 of the present invention changes from the heating main operation mode to the cooling main operation mode.

FIG. 44 is a table illustrating the control target values of initial opening degrees of an expansion device when the operation mode of the air-conditioning apparatus according to Embodiment 2 of the present invention changes from the cooling main operation mode to the cooling only operation mode.

FIG. 45 is a table illustrating the steady-state opening degrees of an expansion device for the respective operation modes of the air-conditioning apparatus according to Embodiment 2 of the present invention and the respective pressure differential target values.

FIG. 56 is a table illustrating the steady-state opening degrees of an expansion device for controlling the injection flow rate when the condensing temperature changes in the cooling only operation mode of the air-conditioning apparatus according to Embodiment 3 of the present invention.

FIG. 57 is a table illustrating the steady-state opening degrees of an expansion device for controlling the injection flow rate and an expansion device for controlling the intermediate pressure when the intermediate pressure changes in the heating only operation mode of the air-conditioning apparatus according to Embodiment 3 of the present invention.

FIG. 58 is a table illustrating the steady-state opening degrees of an expansion device for controlling the injection flow rate and an expansion device for controlling the intermediate pressure when the evaporating temperature changes in the heating only operation mode of the air-conditioning apparatus according to Embodiment 3 of the present invention.

FIG. 59 is a table illustrating the steady-state opening degrees of an expansion device for controlling the injection flow rate when the indoor heating load (quality) changes in the cooling main operation mode of the air-conditioning apparatus according to Embodiment 3 of the present invention.

FIG. 60 is a table illustrating the steady-state opening degrees of an expansion device for controlling the injection flow rate and an expansion device for controlling the intermediate pressure when the intermediate pressure changes in the heating main operation mode of the air-conditioning apparatus according to Embodiment 3 of the present invention.

FIG. 61 is a table illustrating the steady-state opening degrees of an expansion device for controlling the injection flow rate and an expansion device for controlling the intermediate pressure when the evaporating temperature changes in the heating main operation mode of the air-conditioning apparatus according to Embodiment 3 of the present invention.

FIG. 62 is a table illustrating the control target values of initial opening degrees of an expansion device when the operation mode of the air-conditioning apparatus according to Embodiment 3 of the present invention changes from the heating only operation mode to the heating main operation mode.

FIG. 63 is a table illustrating the control target values of initial opening degrees of an expansion device when the operation mode of the air-conditioning apparatus according to Embodiment 3 of the present invention changes from the heating main operation mode to the cooling main operation mode.

FIG. 64 is a table illustrating the control target values of initial opening degrees of an expansion device when the operation mode of the air-conditioning apparatus according to Embodiment 3 of the present invention changes from the cooling main operation mode to the cooling only operation mode.

FIG. 65 is a table illustrating the steady-state opening degrees of an expansion device for the respective operation modes of the air-conditioning apparatus according to Embodiment 3 of the present invention and the respective pressure differential target values.

DESCRIPTION OF EMBODIMENTS

Embodiments of the pre ent invention will be described hereinafter with reference to the drawings.

Embodiment 1

Figure 1:
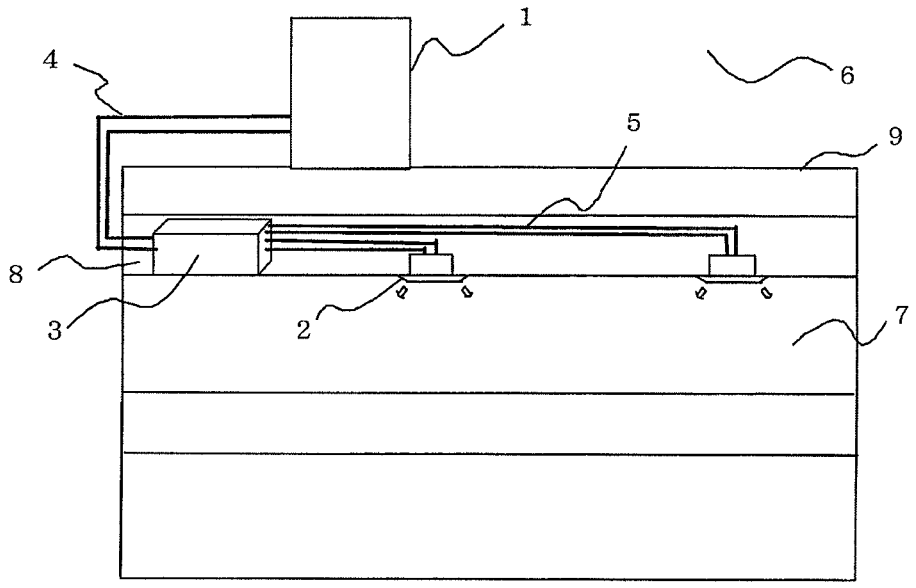
FIG. 1 is a schematic diagram illustrating an example of the installation of an air-conditioning apparatus according to Embodiment 1 of the present invention.

FIG. 1 is a schematic diagram illustrating an example of the installation of an air-conditioning apparatus according to Embodiment 1 of the present invention. An example of the installation of the air-conditioning apparatus will be described with reference to FIG. 1. The illustrated air-conditioning apparatus is configured to allow each indoor unit to select a cooling mode or a heating mode, as desired, as an operation mode by utilizing a refrigeration cycle (refrigerant circuit A and heat medium circuit B) in which refrigerants (heat source side refrigerant and heat medium) circulate. In the following drawings, including FIG. 1, the dimensional relationships between constituent members may be different from the actual ones.

In FIG. 1, the air-conditioning apparatus according to Embodiment 1 includes a single outdoor unit 1, which is a heat source unit, a plurality of indoor units 2, and a heat medium relay unit 3 interposed between the outdoor unit 1 and the indoor units 2. The heat medium relay unit 3 is configured to exchange heat between a heat source side refrigerant and a heat medium. The outdoor unit 1 and the heat medium relay unit 3 are connected via refrigerant pipes 4 through which a heat source side refrigerant travels. The heat medium relay unit 3 and the indoor units 2 are connected via pipes (heat medium pipes) 5 through which a heat medium travels. Cooling energy or heating energy generated in the outdoor unit 1 is delivered to the indoor units 2 via the heat medium relay unit 3.

The outdoor unit 1 is generally installed in an outdoor space 6, which is an outside space (for example, a roof) of a structure 9 such as a building, and is configured to supply cooling energy or heating energy to the indoor units 2 via the heat medium relay unit 3. The indoor units 2 are installed at positions at which the indoor units 2 are capable of supplying cooling air or heating air to an indoor space 7, which is an inside space (for example, a living room) of the structure 9, and are configured to supply cooling air or heating air to the indoor space 7 that is to be air-conditioned. The heat medium relay unit 3 is configured as a separate housing from the outdoor unit 1 and the indoor units 2 such that the heat medium relay unit 3 can be installed in a location different from the outdoor space 6 and the indoor space 7. The heat medium relay unit 3 is connected to the outdoor unit 1 and the indoor units 2 through the refrigerant pipes 4 and the pipes 5, respectively, and is configured to transmit the cooling energy or heating energy supplied from the outdoor unit 1 to the indoor units 2.

As illustrated in FIG. 1, in the air-conditioning apparatus according to Embodiment 1, the outdoor unit 1 and the heat medium relay unit 3 are connected using two refrigerant pipes 4, and the heat medium relay unit 3 and each of the indoor units 2 are connected using two pipes 5. In this manner, the connection of each of the units (the outdoor unit 1, the indoor units 2, and the heat medium relay unit 3) using two pipes (the refrigerant pipes 4 and the pipes 5) facilitates construction of the air-conditioning apparatus according to Embodiment 1.

In FIG. 1, the installation of the heat medium relay unit 3 in a space which is inside the structure 9 but is a space different from the indoor space 7, such as a space above a ceiling (hereinafter referred to simply as a space 8), is illustrated by way of example. The heat medium relay unit 3 may also be installed in any other place such as a common space where an elevator and the like are located. In FIG. 1, furthermore, the indoor units 2 that are of a ceiling cassette type are illustrated by way of example. However, this is a non-limiting example, and the indoor units 2 may be of any type capable of blowing out heating air or cooling air to the indoor space 7 directly or through ducts or the like, such as a ceiling-concealed type or a ceiling-suspended type.

While FIG. 1 illustrates, by way of example, the installation of the outdoor unit 1 in the outdoor space 6, this is a non-limiting example. For example, the outdoor unit 1 may be installed in an enclosed space such as a machine room with a ventilation opening, or may be installed inside the structure 9 so long as waste heat can be exhausted to the outside of the structure 9 through exhaust ducts. Alternatively, the outdoor unit 1 may be of a water-cooled type, and may be installed inside the structure 9. No particular problem will occur regardless of the place where the outdoor unit 1 is installed.

Further, the heat medium relay unit 3 may be installed in the vicinity of the outdoor unit 1. It should be noted that if the distances from the heat medium relay unit 3 to the indoor units 2 are excessively long, considerably high power may be required to convey a heat medium, resulting in a reduction in the energy-saving effect. The numbers of connected outdoor units 1, indoor units 2 and heat medium relay units 3 are not limited to those illustrated in FIG. 1, and may be determined in accordance with the structure 9 where the air-conditioning apparatus according to Embodiment 1 is installed.

In a case where a plurality of heat medium relay units 3 are connected to a single outdoor unit 1, the plurality of the heat medium relay units 3 may be installed in scattered locations in a common space in a structure such as a building or a space above a ceiling. With this installation, intermediate heat exchangers in the heat medium relay units 3 can meet the air conditioning load. The indoor units 2 may also be installed at positions spaced apart a distance or at heights within the conveyance capabilities of a heat medium conveying device in each of the heat medium relay units 3. Accordingly, the indoor units 2 can be arranged over an entire structure such as a building.

Figure 2:
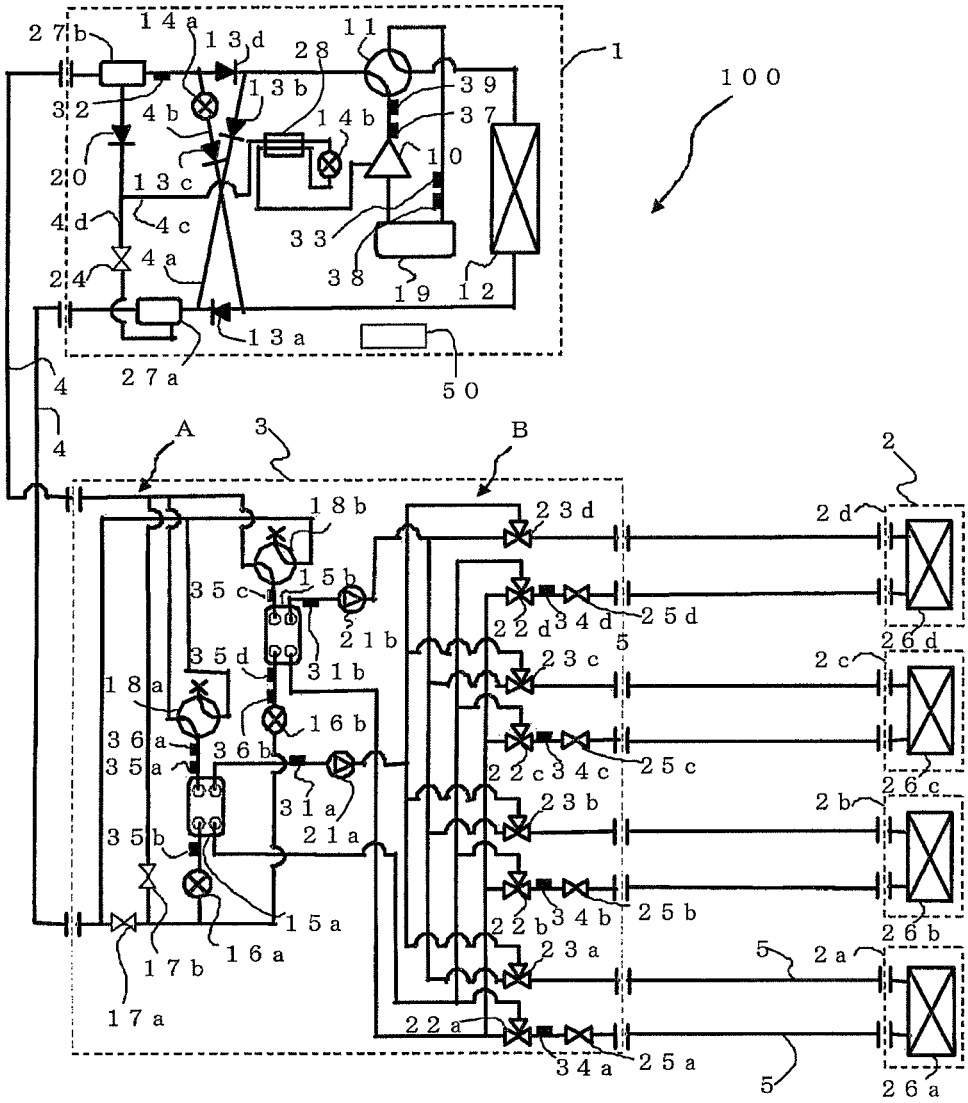
FIG. 2 is a schematic circuit configuration diagram illustrating an example circuit configuration of the air-conditioning apparatus according to Embodiment 1 of the present invention.

FIG. 2 is a schematic circuit configuration diagram illustrating an example circuit configuration of the air-conditioning apparatus according to Embodiment 1 (hereinafter referred to as the air-conditioning apparatus 100). The configuration of the air-conditioning apparatus 100 will be briefly described with reference to FIG. 2. As illustrated in FIG. 2, the outdoor unit 1 and the heat medium relay unit 3 are connected using the refrigerant pipes 4 via an intermediate heat exchanger 15*a* and an intermediate heat exchanger 15*b* which are included in the heat medium relay unit 3. Further, the heat medium relay unit 3 and the indoor units 2 are connected using the pipes 5 via the intermediate heat exchanger 15*a* and the intermediate heat exchanger 15*b*. The refrigerant pipes 4 and the pipes 5 will be described in detail later.

[Outdoor Unit 1]

The outdoor unit 1 includes a compressor 10, a first refrigerant flow switching device 11 such as a four-way valve, a heat source side heat exchanger 12, and an accumulator 19, which are connected in series using the refrigerant pipes 4. The outdoor unit 1 also includes a first connecting pipe 4*a*, a second connecting pipe 4*b*, a check valve 13*a*, a check valve 13*b*, a check valve 13*c*, and a check valve 13*d*. The provision of the first connecting pipe 4*a*, the second connecting pipe 4*b*, the check valve 13*a*, the check valve 13*b*, the check valve 13*c*, and the check valve 13*d* allows a heat source side refrigerant to flow into the heat medium relay unit 3 in a constant direction regardless of the operation requested by the indoor units 2. The components included in the outdoor unit 1 will be described together with the following operation modes.

The compressor 10 is configured to suck a heat source side refrigerant in and compress the heat source side refrigerant into a high-temperature and high-pressure state, and may be, for example, a capacity-controllable inverter compressor or the like. The first refrigerant flow switching device 11 is configured to switch between the flow of a heat source side refrigerant in a heating operation (heating only operation mode and heating main operation mode) and the flow of a heat source side refrigerant in a cooling operation (cooling only operation mode and cooling main operation mode). The heat source side heat exchanger 12 functions as an evaporator in the heating operation, and functions as a condenser (or a radiator) in the cooling operation. The heat source side heat exchanger 12 is configured to exchange heat between air supplied from a fan (not illustrated) and a heat source side refrigerant to evaporate and gasify or condense and liquify the heat source side refrigerant. The accumulator 19 is disposed on the suction side of the compressor 10, and is configured to accumulate the excess refrigerant generated due to the difference between the heating operation and the cooling operation or the excess refrigerant generated due to a transient change between the operations.

The check valve 13*d* is disposed in the refrigerant pipe 4 between the heat medium relay unit 3 and the first refrigerant flow switching device 11, and is configured to permit the flow of a heat source side refrigerant only in a certain direction (the direction from the heat medium relay unit 3 to the outdoor unit 1). The check valve 13*a* is disposed in the refrigerant pipe 4 between the heat source side heat exchanger 12 and the heat medium relay unit 3, and is configured to permit the flow of a heat source side refrigerant only in a certain direction (the direction from the outdoor unit 1 to the heat medium relay unit 3). The check valve 13*b* is disposed in the first connecting pipe 4*a*, and is configured to distribute a heat source side refrigerant discharged from the compressor 10 in the heating operation to the heat medium relay unit 3. The check valve 13*c* is disposed in the second connecting pipe 4*b*, and is configured to distribute a heat source side refrigerant returning from the heat medium relay unit 3 in the heating operation to the suction side of the compressor 10.

The first connecting pipe 4*a* is configured to connect, in the outdoor unit 1, the refrigerant pipe 4 between the first refrigerant flow switching device 11 and the check valve 13*d* to the refrigerant pipe 4 between the check valve 13*a* and the heat medium relay unit 3. The second connecting pipe 4*b* is configured to connect, in the outdoor unit 1, the refrigerant pipe 4 between the check valve 13*d* and the heat medium relay unit 3 to the refrigerant pipe 4 between the heat source side heat exchanger 12 and the check valve 13*a*.

In the refrigeration cycle, an increase in the temperature of a refrigerant causes deterioration of the refrigerant and refrigerating machine oil which circulate in the circuit, and hence the upper limit value of the refrigerant temperature is set. The upper limit temperature is generally 120° C. Since the refrigerant temperature (discharge temperature) on the discharge side of the compressor 10 is the highest temperature in the refrigeration cycle, control may be performed so that the discharge temperature is not greater than or equal to 120° C. If R410A or the like is used as a refrigerant, the discharge temperature does not usually reach 120° C. in the normal operation. If R32 is used as a refrigerant, however, due to the physical properties, the discharge temperature is high. It is thus necessary to provide the refrigeration cycle with a means for reducing the discharge temperature.

Accordingly, the outdoor unit 1 includes a gas-liquid separator 27*a*, a gas-liquid separator 27*b*, an opening/closing device 24, a backflow prevention device 20, an expansion device 14*a*, an expansion device 14*b*, a branch pipe 4*d*, an injection pipe 4*c*, a refrigerant-refrigerant heat exchanger 28, an intermediate-pressure detecting device 32, a discharge refrigerant temperature detecting device 37, a high-pressure detecting device 39, a suction pressure detecting device 33, a suction refrigerant temperature detecting device 38, and a controller 50. The compressor 10 has a compression chamber in a sealed container, and is of the low-pressure shell type in which the sealed container is placed in a low-pressure refrigerant pressure atmosphere and the low-pressure refrigerant in the sealed container is sucked into the compression chamber for compression.

The gas-liquid separator 27*a* is installed downstream of the check valve 13*a* on the heat medium relay unit 3 side with respect to a connection portion of the first connecting pipe 4*a*. The gas-liquid separator 27*a* is configured to separate a heat source side refrigerant that has flowed thereinto into gas and liquid components and to direct the separated components of the heat source side refrigerant to the refrigerant pipe 4 and the branch pipe 4*d*. The gas-liquid separator 27*b* is installed upstream of the check valve 13*d* on the heat medium relay unit 3 side with respect to a connection portion of the second connecting pipe 4*b*. The gas-liquid separator 27*b* is configured to separate a heat source side refrigerant that has flowed thereinto into gas and liquid components and to direct the separated components of the heat source side refrigerant to the refrigerant pipe 4 and the branch pipe 4*d*.

The branch pipe 4*d* is a refrigerant pipe that connects the gas-liquid separator 27*a* and the gas-liquid separator 27*b*. The injection pipe 4*c* is a refrigerant pipe that connects the branch pipe 4*d* located between the opening/closing device 24 and the backflow prevention device 20 to an injection port (not illustrated) of the compressor 10. The injection port is configured to communicate with an opening port formed in part of the compression chamber of the compressor 10. That is, the injection pipe 4*c* allows a refrigerant to be directed (injected) into the inside of the compression chamber from the outside of the sealed container of the compressor 10.

The opening/closing device 24 is installed on the gas-liquid separator 27*a* side with respect to a connection portion between the branch pipe 4*d* and the injection pipe 4*c*, and is configured to open and close the branch pipe 4*d*. The backflow prevention device 20 is installed on the gas-liquid separator 27*b* side with respect to the connection portion between the branch pipe 4*d* and the injection pipe 4*c*, and is configured to permit the flow of a heat source side refrigerant only in a certain direction (the direction from the gas-liquid separator 27*b* to the gas-liquid separator 27*a*). The expansion device 14*a* is disposed upstream of the check valve 13*c* in the second connecting pipe 4*b*, and has functions of a pressure reducing valve and an expansion valve to reduce the pressure of a heat source side refrigerant and expand the heat source side refrigerant.

The expansion device 14*b* is disposed at a position that is the primary-side downstream and secondary-side upstream of the refrigerant-refrigerant heat exchanger 28 in the injection pipe 4*c*, and has functions of a pressure reducing valve and an expansion valve to reduce the pressure of a heat source side refrigerant and expand the heat source side refrigerant. The refrigerant-refrigerant heat exchanger 28 is configured to exchange heat between heat source side refrigerants flowing through the injection pipe 4*c*. That is, the refrigerant-refrigerant heat exchanger 28 is located at a position at which the refrigerant-refrigerant heat exchanger 28 is capable of exchanging heat between a heat source side refrigerant (primary side) that has flowed into the injection pipe 4*c* and a heat source side refrigerant (secondary side) that has passed through the expansion device 14*b*, and is configured to exchange heat between these heat source side refrigerants.

The intermediate-pressure detecting device 32 is disposed on the upstream side of the check valve 13*d* and the expansion device 14*a* and on the downstream side of the gas-liquid separator 27*b*, and is configured to detect the pressure of a refrigerant flowing through the refrigerant pipe 4 at the installation position of the intermediate-pressure detecting device 32. The discharge refrigerant temperature detecting device 37 is disposed on the discharge side of the compressor 10, and is configured to detect the temperature of a refrigerant discharged from the compressor 10. The suction refrigerant temperature detecting device 38 is disposed on the suction side of the compressor 10, and is configured to detect the temperature of a refrigerant to be sucked into the compressor 10. The high-pressure detecting device 39 is disposed on the discharge side of the compressor 10, and is configured to detect the pressure of a refrigerant discharged from the compressor 10. The suction pressure detecting device 33 is disposed on the suction side of the compressor 10, and is configured to detect the pressure of a refrigerant to be sucked into the compressor 10.

The controller 50 is configured to reduce the temperature of a refrigerant discharged from the compressor 10 or the degree of superheat (discharge superheat) of a refrigerant discharged from the compressor 10 by directing a refrigerant into the compression chamber of the compressor 10 from the injection pipe 4*c*. That is, the controller 50 reduces the discharge temperature of the compressor 10 by controlling the opening/closing device 24, the expansion device 14*a*, the expansion device 14*b*, and so forth, thereby achieving a safe operation.

A specific control operation executed by the controller 50 will be described together with the description of the operation of individual operation modes described below. The controller 50 is constituted by a microcomputer and the like, and is configured to perform control in accordance with the detection information obtained by various detection devices and instructions from a remote control. The controller 50 is designed to control the actuators (for example, the opening/closing device 24, the expansion device 14*a*, the expansion device 14*b*, etc.) described above and also control the driving frequency of the compressor 10, the rotation speed (including ON/OFF) of the fan (not illustrated), the switching operation of the first refrigerant flow switching device 11, and so forth to execute the individual operation modes described below.

A brief description will be made of the difference in discharge temperature between the case where R410A is used as a refrigerant and the case where R32 is used as a refrigerant. Consideration will be given here to a case where the evaporating temperature and condensing temperature of the refrigeration cycle are 0° C. and 49° C., respectively, and the superheat (degree of superheat) of a refrigerant sucked into the compressor is 0° C.

It is assumed that R410A is used as a refrigerant and adiabatic compression (isentropic compression) has been performed. Due to the physical properties of R410A, the discharge temperature of the compressor 10 is approximately 70° C. In contrast, it is assumed that R32 is used as a refrigerant and adiabatic compression (isentropic compression) has been performed. Due to the physical properties of R32, the discharge temperature of the compressor 10 is approximately 86° C. That is, in a case where R32 is used as a refrigerant, the discharge temperature is approximately 16° C. higher than that in a case where R410A is used as a refrigerant.

In the actual operation, polytropic compression is performed in the compressor 10, which makes the compressor 10 operate less efficiently than when adiabatic compression is performed. Hence, the discharge temperature is higher than the value described above. In a case where R410A is used as a refrigerant, the operation of the compressor 10 with a discharge temperature exceeding 100° C. frequently occurs. If R32 is used as a refrigerant under the condition where the compressor 10 operates with a discharge temperature exceeding 104° C. when R410A is used, the discharge temperature would exceed the upper limit, that is, 120° C., and thus it is necessary to reduce the discharge temperature.

It is assumed that a compressor of the high-pressure shell type in which a suction refrigerant is sucked directly into the compression chamber and a refrigerant discharged from the compression chamber is discharged into the sealed container around the compression chamber is used. In this case, the discharge temperature can be reduced by making the suction refrigerant wetter than that in the saturation state and sucking the refrigerant in a two-phase state into the compression chamber. In contrast, in a case where the compressor 10 is of the low-pressure shell type, even if the suction refrigerant is made wet, a liquid refrigerant is merely stored in the shell of the compressor 10 and a two-phase refrigerant is not sucked into the compression chamber. Accordingly, in a case where the compressor 10 is of the low-pressure shell type and a refrigerant that causes an increase in discharge temperature, such as R32, is used, the discharge temperature may be reduce by injecting a low-temperature refrigerant into the compression chamber in the process of compression from outside the compressor 10 to reduce the temperature of the refrigerant. Therefore, the discharge temperature may be reduced using the method described above.

The injection flow rate into the compression chamber of the compressor 10 may be controlled in such a manner that the discharge temperature is controlled to be equal to a target value, for example, 100° C., and the control target value is changed in accordance with the outdoor air temperature. The injection flow rate into the compression chamber of the compressor 10 may also be controlled in such a manner that injection is performed if the discharge temperature is likely to exceed a target value, for example, 110° C., and injection is not performed if the discharge temperature is less than or equal to the target value. Alternatively, the injection flow rate into the compression chamber of the compressor 10 may be controlled in such a manner that the discharge temperature is controlled to fall within a target range, for example, from 80° C. to 100° C., and the injection flow rate is increased if the discharge temperature is likely to exceed the upper limit of the target range while the injection flow rate is reduced if the discharge temperature is likely to be below the lower limit of the target range.

The injection flow rate into the compression chamber of the compressor 10 may also be controlled in the following manner: The discharge superheat (degree of discharge heating) is calculated using a high pressure detected by the high-pressure detecting device 39 and a discharge temperature detected by the discharge refrigerant temperature detecting device 37; the injection flow rate is controlled so that the discharge superheat is equal to a target value, for example, 30° C.; and the control target value is changed in accordance with the outdoor air temperature. Alternatively, the injection flow rate into the compression chamber of the compressor 10 may be controlled in such a manner that injection is performed if the discharge superheat is likely to exceed a target value, for example, 40° C., and injection is not performed if the discharge superheat is less than or equal to the target value.

The injection flow rate into the compression chamber of the compressor 10 may also be controlled in such a manner that the discharge superheat is controlled to fall within a target range, for example, from 10° C. to 40° C., and the injection flow rate is increased if the discharge superheat is likely to exceed the upper limit of the target range while the injection flow rate is reduced if the discharge superheat is likely to be below the lower limit of the target range.

While a description has been given of a case where R32 circulates in the refrigerant pipes 4, this is a non-limiting example. Any refrigerant whose discharge temperature is higher than that of R410A, which is an existing refrigerant, when the condensing temperature, the evaporating temperature, the superheat (degree of superheat), the subcool (degree of subcooling), and the compressor efficiency are the same as those of R410A may be used. The discharge temperature of such a refrigerant can be reduced with the configuration of Embodiment 1, and similar advantages can be achieved. In particular, a refrigerant whose discharge temperature is higher than that of R410A by 3° C. or more will be more effective.

Figure 3:
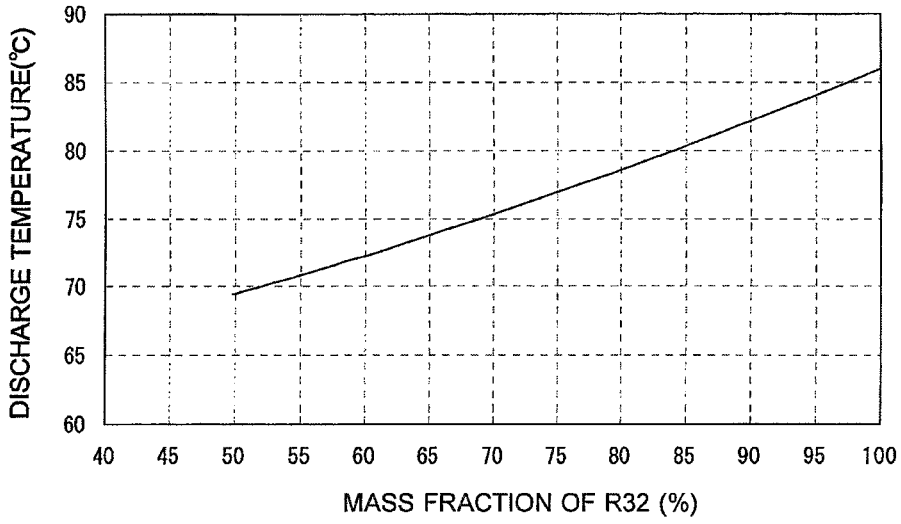
FIG. 3 is a graph illustrating a relationship between the mass fraction of R32 in the case of use of a refrigerant mixture including R32, and a discharge temperature.

FIG. 3 is a graph illustrating a relationship between the mass fraction of R32 in the case of use of a refrigerant mixture (refrigerant mixture of R32 and HFO1234yf, which is a tetrafluoropropene-based refrigerant having a low global warming potential and having the chemical formula $CF_3CF{=}CH_2$), and the discharge temperature. A change in the discharge temperature with respect to the mass fraction of R32 in the case of use of the refrigerant mixture described above, when an estimate of the discharge temperature is made using a method similar to that described above, will be described with reference to FIG. 3.

It can be seen from FIG. 3 that the discharge temperature is approximately 70° C., which is substantially the same as that in the case of R410A when the mass fraction of R32 is 52%, and that the discharge temperature is approximately 73° C., which is higher than that in the case of R410A by 3° C., when the mass fraction of R32 is 62%. Accordingly, in a refrigerant mixture of R32 and HFO1234yf, it is effective to reduce the discharge temperature through injection when the mass fraction of R32 is greater than or equal to 62% in the refrigerant mixture.

Furthermore, a description will be given of a change in the discharge temperature with respect to the mass fraction of R32 when a refrigerant mixture of R32 and HFO1234ze, which is a tetrafluoropropene-based refrigerant having a low global warming potential and having the chemical formula $CF_3CH{=}CHF$, is used and when an estimate of the discharge temperature is made using a method similar to that described above. In this case, it has been found that the discharge temperature is approximately 70° C., which is substantially the same as that in the case of R410A, when the mass fraction of R32 is 34% and that the discharge temperature is approximately 73° C., which is higher than that in the case of R410A by 3° C., when the mass fraction of R32 is 43%. Accordingly, in a refrigerant mixture of R32 and HFO1234ze, it is effective to reduce the discharge temperature through injection if the mass fraction of R32 is greater than or equal to 43% in the refrigerant mixture.

The estimates described above were calculated using REFPROP, Version 8.0 released by NIST (National Institute of Standards and Technology). The type of refrigerant in a refrigerant mixture is not limited to that described above, and a refrigerant mixture containing a small amount of other refrigerant component does not greatly influence the discharge temperature, and similar advantages are achieved. For example, a refrigerant mixture containing R32, HFO1234yf, and a small amount of other refrigerant may also be used. As explained earlier, the calculations described above were made on the assumption of adiabatic compression. Since actual compression is performed using polytropic compression, temperatures higher than the temperatures described herein by several tens of degrees or more, for example, by 20° C. or more, are obtained.

[Indoor Unit 2]

Each of the indoor units 2 has a use side heat exchanger 26. The use side heat exchangers 26 are connected to heat medium flow control devices 25 and second heat medium flow switching devices 23 of the heat medium relay unit 3 using the pipes 5. Each of the use side heat exchangers 26 is configured to exchange heat between air supplied from a fan (not illustrated) and a heat medium to generate heating air or cooling air to be supplied to the indoor space 7.

In the illustration of FIG. 2, by way of example, four indoor units 2 are connected to the heat medium relay unit 3, and are illustrated as an indoor unit 2*a*, an indoor unit 2*b*, an indoor unit 2*c*, and an indoor unit 2*d* in this order from bottom to top in the drawing. In correspondence with the indoor units 2*a* to 2*d*, the use side heat exchangers 26 are also illustrated as a use side heat exchanger 26*a*, a use side heat exchanger 26*b*, a use side heat exchanger 26*c*, and a use side heat exchanger 26*d* in this order from bottom to top in the drawing. As in FIG. 1, the number of indoor units 2 is not limited to four, which is illustrated in FIG. 2.

[Heat Medium Relay Unit 3]

The heat medium relay unit 3 has two intermediate heat exchangers 15, two expansion devices 16, two opening/closing devices 17, two second refrigerant flow switching devices 18, two pumps 21, four first heat medium flow switching devices 22, four second heat medium flow switching devices 23, and four heat medium flow control devices 25. The individual devices in the heat medium relay unit 3 will be described together with the description of the operation modes described below.

Each of the two intermediate heat exchangers 15 (intermediate heat exchanger 15*a* and intermediate heat exchanger 15*b*) functions as a condenser (radiator) or an evaporator, and is configured to exchange heat between a heat source side refrigerant and a heat medium and to transmit the cooling energy or heating energy generated by the outdoor unit 1 and stored in the heat source side refrigerant to the heat medium. The intermediate heat exchanger 15*a* is disposed between the expansion device 16*a* and the second refrigerant flow switching device 18*a* in the refrigerant circuit A, and is configured to serve to cool a heat medium in the cooling and heating mixed operation mode. The intermediate heat exchanger 15*b* is disposed between the expansion device 16*b* and the second refrigerant flow switching device 18*b* in the refrigerant circuit A, and is configured to serve to heat a heat medium in the cooling and heating mixed operation mode.

Each of the two expansion devices 16 (expansion device 16*a* and expansion device 16*b*) functions as a pressure reducing valve and an expansion valve, and is configured to reduce the pressure of a heat source side refrigerant and to expand the heat source side refrigerant. The expansion device 16*a* is disposed on the upstream side of the intermediate heat exchanger 15*a* in the flow of a heat source side refrigerant in the cooling operation. The expansion device 16*b* is provided on the upstream side of the intermediate heat exchanger 15*b* in the flow of a heat source side refrigerant in the cooling operation. Each of the two expansion devices 16 may be a device whose opening degree (opening area) is variably controllable, such as an electronic expansion valve.

Each of the two opening/closing devices 17 (opening/closing device 17*a* and opening/closing device 17*b*) is constituted by a two-way valve and the like, and is configured to open and close the refrigerant pipe 4. The opening/closing device 17*a* is disposed in the refrigerant pipe 4 on the heat-source-side-refrigerant inlet side. The opening/closing device 17*b* is disposed in a pipe (bypass pipe 24*d*) that connects the refrigerant pipes 4 on the heat-source-side-refrigerant inlet and outlet sides. Each of the opening/closing devices 17 may be configured to be capable of opening and closing the refrigerant pipe 4, and may be a device whose opening degree is variably controllable, such as an electronic expansion valve.

Each of the two second refrigerant flow switching devices 18 (second refrigerant flow switching device 18*a* and second refrigerant flow switching device 18*b*) is constituted by a four-way valve and the like, and is configured to switch the flow of a heat source side refrigerant so that each of the intermediate heat exchangers 15 serves as a condenser or an evaporator in accordance with the operation mode. The second refrigerant flow switching device 18*a* is disposed on the downstream side of the intermediate heat exchanger 15*a* in the flow of a heat source side refrigerant in the cooling operation. The second refrigerant flow switching device 18*b* is disposed on the downstream side of the intermediate heat exchanger 15*b* in the flow of a heat source side refrigerant in the cooling only operation.

Each of the two pumps 21 (pump 21*a* and pump 21*b*) is configured to cause a heat medium which travels through the pipes 5 to circulate in the heat medium circuit B. The pump 21*a* is disposed in the pipe 5 between the intermediate heat exchanger 15*a* and the second heat medium flow switching devices 23. The pump 21*b* is disposed in the pipe 5 between the intermediate heat exchanger 15*b* and the second heat medium flow switching devices 23. Each of the two pumps 21 may be, for example, a capacity-controllable pump or the iike, and may be configured to adjust the flow rate thereof in accordance with the magnitude of the load on the indoor units 2.

Each of the four first heat medium flow switching devices 22 (first heat medium flow switching devices 22*a* to 22*d*) is constituted by a three-way valve and the like, and is configured to switch the flow path of a heat medium. The first heat medium flow switching devices 22, the number of which corresponds to the number of indoor units 2 installed (here, four), are disposed. In each of the first heat medium flow switching devices 22, one of the three ways is connected to the intermediate heat exchanger 15*a*, another of the three ways is connected to the intermediate heat exchanger 15*b*, and the other of the three ways is connected to the corresponding one of the heat medium flow control devices 25. The first heat medium flow switching devices 22 are disposed on the heat medium flow path outlet side of the use side heat exchangers 26. In correspondence with the indoor units 2, the first heat medium flow switching device 22*a*, the first heat medium flow switching device 22*b*, the first heat medium flow switching device 22*c*, and the first heat medium flow switching device 22*d* are illustrated in this order from bottom to top in the drawing. The switching of the heat medium flow path includes not only complete switching from one to another but also partial switching from one to another.

Each of the four second heat medium flow switching devices 23 (second heat medium flow switching devices 23*a* to 23*d*) is constituted by a three-way valve and the like, and is configured to switch the flow path of a heat medium. The second heat medium flow switching devices 23, the number of which corresponds to the number of indoor units 2 installed (here, four), are disposed. In each of the second heat medium flow switching devices 23, one of the three ways is connected to the intermediate heat exchanger 15*a*, another of the three ways is connected to the intermediate heat exchanger 15*b*, and the other of the three ways is connected to the corresponding one of the use side heat exchangers 26. The second heat medium flow switching devices 23 are disposed on the heat medium flow path inlet side of the use side heat exchangers 26. In correspondence with the indoor units 2, the second heat medium flow switching device 23*a*, the second heat medium flow switching device 23*b*, the second heat medium flow switching device 23*c*, and the second heat medium flow switching device 23*d* are illustrated in this order from bottom to top in the drawing. The switching of the heat medium flow path includes not only complete switching from one to another but also partial switching from one to another.

Each of the four heat medium flow control devices 25 (heat medium flow control devices 25*a* to 25*d*) is constituted by a two-way valve whose opening area is controllable, and the like, and is configured to control the flow rate of the flow through the pipe 5. The heat medium flow control devices 25, the number of which corresponds to the number of indoor units 2 installed (here, four), are disposed. In each of the heat medium flow control devices 25, one is connected to the corresponding one of the use side heat exchangers 26 and the other is connected to the corresponding one of the first heat medium flow switching devices 22. The heat medium flow control devices 25 are disposed on the heat medium flow path outlet side of the use side heat exchangers 26. That is, each of the heat medium flow control devices 25 is designed to adjust the amount of heat medium flowing into the corresponding one of the indoor units 2 in accordance with the temperature of a heat medium flowing into the indoor unit 2 and the temperature of a heat medium flowing out of the indoor unit 2, so that optimum heat medium amounts can be provided to the indoor units 2 in accordance with the indoor load.

In correspondence with the indoor units 2, the heat medium flow control device 25*a*, the heat medium flow control device 25*b*, the heat medium flow control device 25*c*, and the heat medium flow control device 25*d* are illustrated in this order from bottom to top in the drawing. The heat medium flow control devices 25 may also be disposed on the heat medium flow path inlet side of the use side heat exchangers 26. The heat medium flow control devices 25 may also be disposed on the heat medium flow path inlet side of the use side heat exchangers 26 between the second heat medium flow switching devices 23 and the use side heat exchangers 26. Furthermore, when the indoor units 2 do not require any loads, such as when the indoor units 2 are not in operation or are in a thermostat-off state, the heat medium flow control devices 25 are fully closed, thereby making it possible to stop the supply of a heat medium to the indoor units 2.

The heat medium relay unit 3 further includes various detection devices (two first temperature sensors 31, four second temperature sensors 34, four third temperature sensors 35, and two pressure sensors 36). Information (temperature information and pressure information) detected by these detection devices is sent to a controller (for example, the controller 50) that controls the overall operation of the air-conditioning apparatus 100, and is used to control the driving frequency of the compressor 10, the rotation speed of the fan (not illustrated), the switching operation of the first refrigerant flow switching device 11, the driving frequency of the pumps 21, the switching operation of the second refrigerant flow switching device 18, the switching of the flow path of the heat medium, and so forth. While a description has been made in the context of the controller 50 being mounted in the outdoor unit 1, this is a non-limiting example. The controller 50 may be mounted in the heat medium relay unit 3 or the indoor units 2, or may be mounted in each unit so as to be capable of communicating with one another.

Each of the two first temperature sensors 31 (first temperature sensor 31*a* and first temperature sensor 31*b*) is configured to detect the temperature of a heat medium that has flowed out of one of the intermediate heat exchangers 15, that is, the temperature of a heat medium at the outlet of one of the intermediate heat exchangers 15, and may be, for example, a thermistor or the like. The first temperature sensor 31*a* is disposed in the pipe 5 on the inlet side of the pump 21*a*. The first temperature sensor 31*b* is disposed in the pipe 5 on the inlet side of the pump 21*b*.

Each of the four second temperature sensors 34 (second temperature sensors 34*a* to 34*d*) is disposed between the corresponding one of the first heat medium flow switching devices 22 and the corresponding one of the heat medium flow control devices 25, and is configured to detect the temperature of a heat medium that has flowed out of the corresponding one of the use side heat exchangers 26. The second temperature sensors 34 may be each a thermistor or the like. The second temperature sensors 34, the number of which corresponds to the number of indoor units 2 installed (here, four), are disposed. In correspondence with the indoor units 2, the second temperature sensor 34*a*, the second temperature sensor 34*b*, the second temperature sensor 34*c*, and the second temperature sensor 34*d* are illustrated in this order from bottom to top in the drawing.

Each of the four third temperature sensors 35 (third temperature sensors 35*a* to 35*d*) is disposed on the heat-source-side-refrigerant inlet or outlet side of the corresponding one of the intermediate heat exchangers 15, and is configured to detect the temperature of a heat source side refrigerant that is to flow into the corresponding one of the intermediate heat exchangers 15 or the temperature of a heat source side refrigerant that has flowed out of the corresponding one of the intermediate heat exchangers 15. The third temperature sensors 35 may be a thermistor or the like. The third temperature sensor 35*a* is disposed between the intermediate heat exchanger 15*a* and the second refrigerant flow switching device 18*a*. The third temperature sensor 35*b* is disposed between the intermediate heat exchanger 15*a* and the expansion device 16*a*. The third temperature sensor 35*c* is disposed between the intermediate heat exchanger 15*b* and the second refrigerant flow switching device 18*b*. The third temperature sensor 35*d* is disposed between the intermediate heat exchanger 15*b* and the expansion device 16*b*.

A pressure sensor 36*b* is disposed between, similarly to the installation position of the third temperature sensor 35*d*, the intermediate heat exchanger 15*b* and the expansion device 16*b*, and is configured to detect the pressure of a heat source side refrigerant flowing between the intermediate heat exchanger 15*b* and the expansion device 16*b*. A pressure sensor 36*a* is disposed between, similarly to the installation position of the third temperature sensor 35*a*, the intermediate heat exchanger 15*a* and the second refrigerant flow switching device 18*a*, and is configured to detect the pressure of a heat source side refrigerant flowing between the intermediate heat exchanger 15*a* and the second refrigerant flow switching device 18*a*.

A controller (for example, the controller 50 provided in the outdoor unit 1) is constituted by a microcomputer and the like, and is configured to control the driving of the pumps 21, the opening degree of the expansion devices 16, the opening and closing of the opening/closing devices 17, the switching operation of the second refrigerant flow switching devices 18, the switching operation of the first heat medium flow switching devices 22, the switching operation of the second heat medium flow switching devices 23, the opening degree of the heat medium flow control devices 25, and so forth in accordance with the detection information obtained by the various detection devices and instructions from the remote control to execute operation modes described below. A controller may be disposed in one of the outdoor unit 1 and the heat medium relay unit 3.

The pipes 5 through which a heat medium travels include pipes connected to the intermediate heat exchanger 15*a* and pipes connected to the intermediate heat exchanger 15*b*. The pipes 5 have branches (here, four branches), the number of which corresponds to the number of indoor units 2 connected to the heat medium relay unit 3. The pipes 5 are connected at the first heat medium flow switching devices 22 and the second heat medium flow switching devices 23. The first heat medium flow switching devices 22 and the second heat medium flow switching devices 23 are controlled to determine whether to cause a heat medium supplied from the intermediate heat exchanger 15*a* to flow into the use side heat exchangers 26 or to cause a heat medium supplied from the intermediate heat exchanger 15*b* to flow into the use side heat exchangers 26.

In the air-conditioning apparatus 100, the refrigerant circuit A is formed by connecting the compressor 10, the first refrigerant flow switching device 11, the heat source side heat exchanger 12, the opening/closing devices 17, the second refrigerant flow switching devices 18, the refrigerant flow paths of the intermediate heat exchangers 15, the expansion devices 16, and the accumulator 19 using the refrigerant pipes 4. Further, the heat medium circuit B is formed by connecting the heat medium flow path of the intermediate heat exchanger 15*a*, the pumps 21, the first heat medium flow switching devices 22, the heat medium flow control devices 25, the use side heat exchangers 26, and the second heat medium flow switching devices 23 using the pipes 5. That is, a plurality of use side heat exchangers 26 are connected in parallel to each of the intermediate heat exchangers 15, thereby providing the heat medium circuit B having a plurality of channels.

In the air-conditioning apparatus 100, accordingly, the outdoor unit 1 and the heat medium relay unit 3 are connected via the intermediate heat exchanger 15*a* and the intermediate heat exchanger 15*b*, which are disposed in the heat medium relay unit 3, and the heat medium relay unit 3 and the indoor units 2 are also connected via the intermediate heat exchanger 15*a* and the intermediate heat exchanger 15*b*. That is, in the air-conditioning apparatus 100, the intermediate heat exchanger 15*a* and the intermediate heat exchanger 15*b* exchange heat between a heat source side refrigerant circulating in the refrigerant circuit A and a heat medium circulating in the heat medium circuit B.

[Operation Modes]

The operation modes executable by the air-conditioning apparatus 100 will be described. The air-conditioning apparatus 100 allows each of the indoor units 2 to perform a cooling operation or a heating operation in accordance with an instruction from the indoor unit 2. That is, the air-conditioning apparatus 100 is configured to allow all the indoor units 2 to perform the same operation and also allow the indoor units 2 to perform different operations.

The operation modes executable by the air-conditioning apparatus 100 include a cooling only operation mode in which all the indoor units 2 that are in operation perform a cooling operation, a heating only operation mode in which all the indoor units 2 that are in operation perform a heating operation, and a cooling and heating mixed operation mode. The cooling and heating mixed operation mode includes a cooling main operation mode in which the cooling load is larger than the heating load, and a heating main operation mode in which the heating load is larger than the cooling load. The individual operation modes will be described hereinafter in conjunction with the description of the flow of a heat source side refrigerant and a heat medium.

[Cooling Only Operation Mode]

Figure 4:
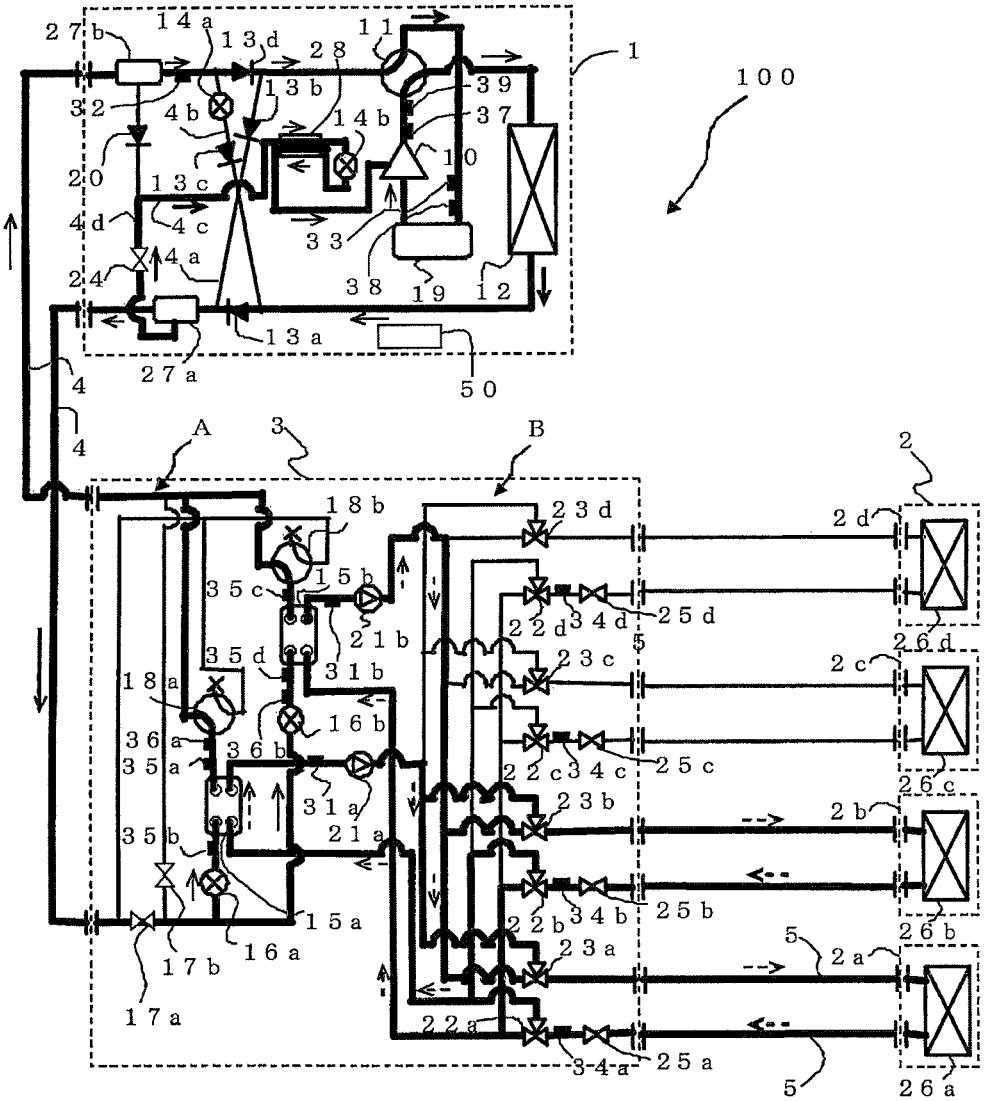
FIG. 4 is a refrigerant circuit diagram illustrating a refrigerant flow when the air-conditioning apparatus according to Embodiment 1 of the present invention is in a cooling only operation mode.

FIG. 4 is a refrigerant circuit diagram illustrating a refrigerant flow when the air-conditioning apparatus 100 is in the cooling only operation mode. Referring to FIG. 4, a description will be given of the cooling only operation mode in the context of the cooling energy load being generated only in the use side heat exchanger 26*a* and the use side heat exchanger 26*b*, by way of example. In FIG. 4, the pipes indicated by the thick lines represent pipes through which refrigerants (heat source side refrigerant and heat medium) flow. In FIG. 4, furthermore, the direction of the flow of a heat source side refrigerant is indicated by the solid line arrows, and the flow direction of a heat medium is indicated by the broken line arrows.

In the cooling only operation mode illustrated in FIG. 4, in the outdoor unit 1, the first refrigerant flow switching device 11 is switched so as to cause a heat source side refrigerant discharged from the compressor 10 to flow into the heat source side heat exchanger 12. In the heat medium relay unit 3, the pump 21*a* and the pump 21*b* are driven to open the heat medium flow control device 25*a* and the heat medium flow control device 25*b* and to set the heat medium flow control device 25*c* and the heat medium flow control device 25*d* to a fully closed state, thereby allowing a heat medium to circulate between each of the intermediate heat exchanger 15*a* and the intermediate heat exchanger 15*b* and the use side heat exchanger 26*a* and between each of the intermediate heat exchanger 15*a* and the intermediate heat exchanger 15*b* and the use side heat exchanger 26*b*.

First, the flow of a heat source side refrigerant in the refrigerant circuit A will be described.

A low-temperature and low-pressure refrigerant is compressed by the compressor 10, and is discharged as a high-temperature and high-pressure gaseous refrigerant. The high-temperature and high-pressure gaseous refrigerant discharged from the compressor 10 flows into the heat source side heat exchanger 12 via the first refrigerant flow switching device 11. Then, the gaseous refrigerant is condensed and liquified in the heat source side heat exchanger 12 while transferring heat to the outdoor air, and is converted into a high-pressure liquid refrigerant. The high-pressure liquid refrigerant that has flowed out of the heat source side heat exchanger 12 passes through the check valve 13*a*. Part of the high-pressure liquid refrigerant flows out of the outdoor unit 1 via the gas-liquid separator 27*a*, and flows into the heat medium relay unit 3 through the refrigerant pipe 4. The high-pressure liquid refrigerant that has flowed into the heat medium relay unit 3 flows through the opening/closing device 17*a*, and then the flow of the high-pressure liquid refrigerant is split into flows to the expansion device 16*a* and the expansion device 16*b*, so that the refrigerant is expanded in each of the expansion devices. Accordingly, a low-temperature and low-pressure two-phase refrigerant is obtained.

The two-phase refrigerant flows into the intermediate heat exchanger 15*a* and the intermediate heat exchanger 15*b*, each of which serves as an evaporator, and removes heat from a heat medium circulating in the heat medium circuit B to cool the heat medium, thereby being converted into a low-temperature and low-pressure gaseous refrigerant. The gaseous refrigerants that has flowed out of the intermediate heat exchanger 15*a* and the intermediate heat exchanger 15*b* flow out of the heat medium relay unit 3 via the second refrigerant flow switching device 18*a* and the second refrigerant flow switching device 18*b*, respectively, and again flow into the outdoor unit 1 through the refrigerant pipe 4. The refrigerant that has flowed into the outdoor unit 1 passes through the check valve 13*d* via the gas-liquid separator 27*b*, and is again sucked into the compressor 10 via the first refrigerant flow switching device 11 and the accumulator 19.

In this case, the opening degree (opening area) of the expansion device 16*a* is controlled so that the superheat (degree of superheat) obtained as a difference between the temperature detected by the third temperature sensor 35*a* and the temperature detected by the third temperature sensor 35*b* is constant. Similarly, the opening degree of the expansion device 16*b* is controlled so that the superheat obtained as a difference between the temperature detected by the third temperature sensor 35*c* and the temperature detected by the third temperature sensor 35*d* is constant. Furthermore, the opening/closing device 17*a* is in an opened state, and the opening/closing device 17*b* is in a closed state.

Figure 5:
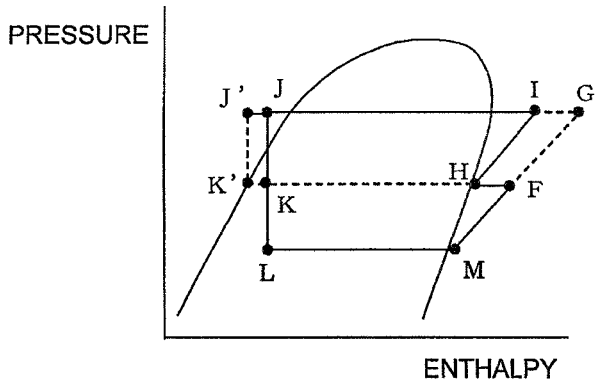
FIG. 5 is a P-h diagram illustrating a state transition of a heat source side refrigerant when the air-conditioning apparatus according to Embodiment 1 of the present invention is in the cooling only operation mode.

If R32 is used as a heat source side refrigerant, the discharge temperature of the compressor 19 may be high. Hence, the discharge temperature is reduced using an injection circuit. The operation performed in this case will be described with reference to FIG. 4 and FIG. 5. FIG. 5 is a P-h diagram (pressure-enthalpy diagram) illustrating a state transition of a heat source side refrigerant in the cooling only operation mode. In FIG. 5, the vertical axis represents pressure and the horizontal axis represents enthalpy.

In the compressor 10, a low-temperature and low-pressure gaseous refrigerant sucked from the suction port of the compressor 10 is directed into the sealed container, and the low-temperature and low-pressure gaseous refrigerant filled in the sealed container is sucked into the compression chamber (not illustrated). The internal volume of the compression chamber decreases while the compression chamber is rotated 0 to 360 degrees with a motor (not illustrated). The inside refrigerant that has been sucked into the compression chamber is compressed so that the pressure and the temperature increase in accordance with the decrease in the internal volume of the compression chamber. When the rotation angle of the motor reaches a certain angle, the opening (formed in part of the compression chamber) is opened (the state indicated by point F in FIG. 5), thereby bringing the inside of the compression chamber and the injection pipe 4*c* located outside the compressor 10 into communication with each other.

In the cooling only operation mode, the refrigerant compressed by the compressor 10 is condensed and liquified in the heat source side heat exchanger 12 into a high-pressure liquid refrigerant (point J in FIG. 5), and reaches the gas-liquid separator 27*a* via the check valve 13*a*. The opening/closing device 24 is set to an opened state. The high-pressure liquid refrigerant is split at the gas-liquid separator 27*a*, and part of the liquid refrigerant flows into the injection pipe 4*c* via the opening/closing device 24 through the branch pipe 4*d*. The refrigerant that has flowed into the injection pipe 4*c* undergoes pressure reduction in the expansion device 14*b* via the refrigerant-refrigerant heat exchanger 28, and is converted into a low-temperature and intermediate-pressure two-phase refrigerant. The refrigerant-refrigerant heat exchanger 28 exchanges heat between the heat source side refrigerant (refrigerant on the primary side) before undergoing pressure reduction in the expansion device 14*b* and the refrigerant (refrigerant on the secondary side) after having undergone pressure reduction in the expansion device 14*b*.

The heat source side refrigerant that has flowed into the expansion device 14*b* is cooled with the heat source side refrigerant whose pressure and temperature have been reduced through pressure reduction in the refrigerant-refrigerant heat exchanger 28 (point J' in FIG. 5). The heat source side refrigerant is throttled by the expansion device 14*b* (point K' in FIG. 5), and is then heated with the heat source side refrigerant before undergoing pressure reduction in the refrigerant-refrigerant heat exchanger 28 (point K in FIG. 5). Then, the heat source side refrigerant is directed (injected) into the compression chamber through the opening port formed in the compression chamber of the compressor 10. In the compression chamber of the compressor 10, due to mixing of the intermediate-pressure gaseous refrigerant (point F of FIG. 5) and the low-temperature and intermediate-pressure two-phase refrigerant (point K of FIG. 5), the temperature of the refrigerant decreases (point H of FIG. 5). This results in a reduction in the discharge temperature of the refrigerant to be discharged from the compressor 10 (point I of FIG. 5). The discharge temperature of the compressor 10 obtained without using such injection is indicated by point G of FIG. 5. It is found that the discharge temperature is reduced from point G to point I due to the injection.

The expansion device 14*b* may not be able to perform stable control if a refrigerant in a two-phase state flows into the expansion device 14*b*. The air-conditioning apparatus 100 having the configuration described above ensures that a liquid refrigerant is reliably supplied to the expansion device 14*b* even if the subcool (degree of subcooling) at the outlet of the heat source side heat exchanger 12 is low due to factors such as a small amount of enclosed refrigerant, thereby allowing stable control.

In this case, the refrigerant in the flow path from the opening/closing device 24 to the backflow prevention device 20 in the branch pipe 4*d* is a high-pressure refrigerant, and the refrigerant returning to the outdoor unit 1 from the heat medium relay unit 3 through the refrigerant pipe 4 and reaching the gas-liquid separator 27*b* is a low-pressure refrigerant. The backflow prevention device 20 is configured to prevent the flow of the refrigerant from the branch pipe 4*d* to the gas-liquid separator 27*b*. Due to the operation of the backflow prevention device 20, the high-pressure refrigerant in the branch pipe 4*d* is prevented from being mixed with the low-pressure refrigerant in the gas-liquid separator 27*b*.

The opening/closing device 24 may be a device capable of switching between an opened state and a closed state, such as a solenoid valve, or may be a device whose opening area is changeable, such as an electronic expansion valve. Any device capable of switching a flow path between an opened state and a closed state may be used as the opening/closing device 24. In addition, the backflow prevention device 20 may be a check valve or a device capable of switching a flow path between an opened state and a closed state, for example, a device capable of switching between an opened state and a closed state, such as a solenoid valve, or a device whose opening area is changeable, such as an electronic expansion valve. Since a refrigerant does not flow through the expansion device 14*a*, the opening degree of the expansion device 14*a* may be set as desired.

The expansion device 14*b* is a device whose opening area is changeable, such as an electronic expansion valve, and the opening area of the expansion device 14*b* is controlled so that the discharge temperature of the compressor 10 detected by the discharge refrigerant temperature detecting device 37 is not excessively high. The opening area of the expansion device 14*b* may be controlled so that the expansion device 14*b* is opened by a constant opening degree, for example, in steps of 10 pulses, when the discharge temperature exceeds a certain value, for example, 110° C. or the like. Another control method may be to control the opening degree so that the discharge temperature is equal to a target value, for example, 100° C. Alternatively, a capillary tube may be used as the expansion device 14*b*, and an amount of refrigerant corresponding to a pressure difference may be injected.

Next, the flow of a heat medium in the heat medium circuit B will be described.

In the cooling only operation mode, the cooling energy of a heat source side refrigerant is transmitted to a heat medium in both the intermediate heat exchanger 15*a* and the intermediate heat exchanger 15*b*, and the cooled heat medium is caused by the pump 21*a* and the pump 21*b* to flow through the pipes 5. The heat medium pressurized by and flowing out of the pump 21*a* and the pump 21*b* flows into the use side heat exchanger 26*a* and the use side heat exchanger 26*b* via the second heat medium flow switching device 23*a* and the second heat medium flow switching device 23*b*, respectively. The heat medium then removes heat from the indoor air in the use side heat exchanger 26*a* and the use side heat exchanger 26*b*, thereby cooling the indoor space 7.

Then, the heat medium flows out of the use side heat exchanger 26*a* and the use side heat exchanger 26*b*, and flows into the heat medium flow control device 25*a* and the heat medium flow control device 25*b*, respectively. In this case, the flow rate of the heat medium is controlled to be equal to the flow rate that is necessary to meet the air conditioning load required for the room by using the operation of the heat medium flow control device 25*a* and the heat medium flow control device 25*b*. Then, the heat medium flows into the use side heat exchanger 26*a* and the use side heat exchanger 26*b*. The heat medium that has flowed out of the heat medium flow control device 25*a* and the heat medium flow control device 25*b* flows into the intermediate heat exchanger 15*a* and the intermediate heat exchanger 15*b* via the first heat medium flow switching device 22*a* and the first heat medium flow switching device 22*b*, and is again sucked into the pump 21*a* and the pump 21*b*.

In the pipes 5 for the use side heat exchangers 26, a heat medium flows in the direction from the second heat medium flow switching devices 23 to the first heat medium flow switching devices 22 via the heat medium flow control devices 25. The air conditioning load required for the indoor space 7 can be met by performing control so that the difference between the temperature detected by the first temperature sensor 31*a* or the temperature detected by the first temperature sensor 31*b* and the temperature detected by the second temperature sensor 34 is maintained at a target value. The outlet temperature of each of the intermediate heat exchangers 15 may be either the temperature of the first temperature sensor 31*a* or the temperature of the first temperature sensor 31*b*, or may be the average of these temperatures. In this case, the opening degrees of the first heat medium flow switching devices 22 and the second heat medium flow switching devices 23 are set to an intermediate opening degree so as to ensure flow paths to both the intermediate heat exchanger 15*a* and the intermediate heat exchanger 15*b*.

Since no heat medium needs to flow to a use side heat exchanger 26 with no heat load (including a use side heat exchanger 26 that is in a thermostat-off state) during the execution of the cooling only operation mode, the associated heat medium flow control device 25 closes the flow path to the use side heat exchanger 26 to prevent a heat medium from flowing through the use side heat exchanger 26. In FIG. 4, a heat medium flows through the use side heat exchanger 26*a* and the use side heat exchanger 26*b* because of the presence of heat load, whereas the use side heat exchanger 26*c* and the use side heat exchanger 26*d* have no heat load. Accordingly the corresponding heat medium flow control device 25*c* and heat medium flow control device 25*d* are in a fully closed state. When a heat load is generated in the use side heat exchanger 26*c* or the use side heat exchanger 26*d*, the heat medium flow control device 25*c* or the heat medium flow control device 25*d* may be opened, thereby allowing a heat medium to circulate therethrough.

[Heating Only Operation Mode]

Figure 6:
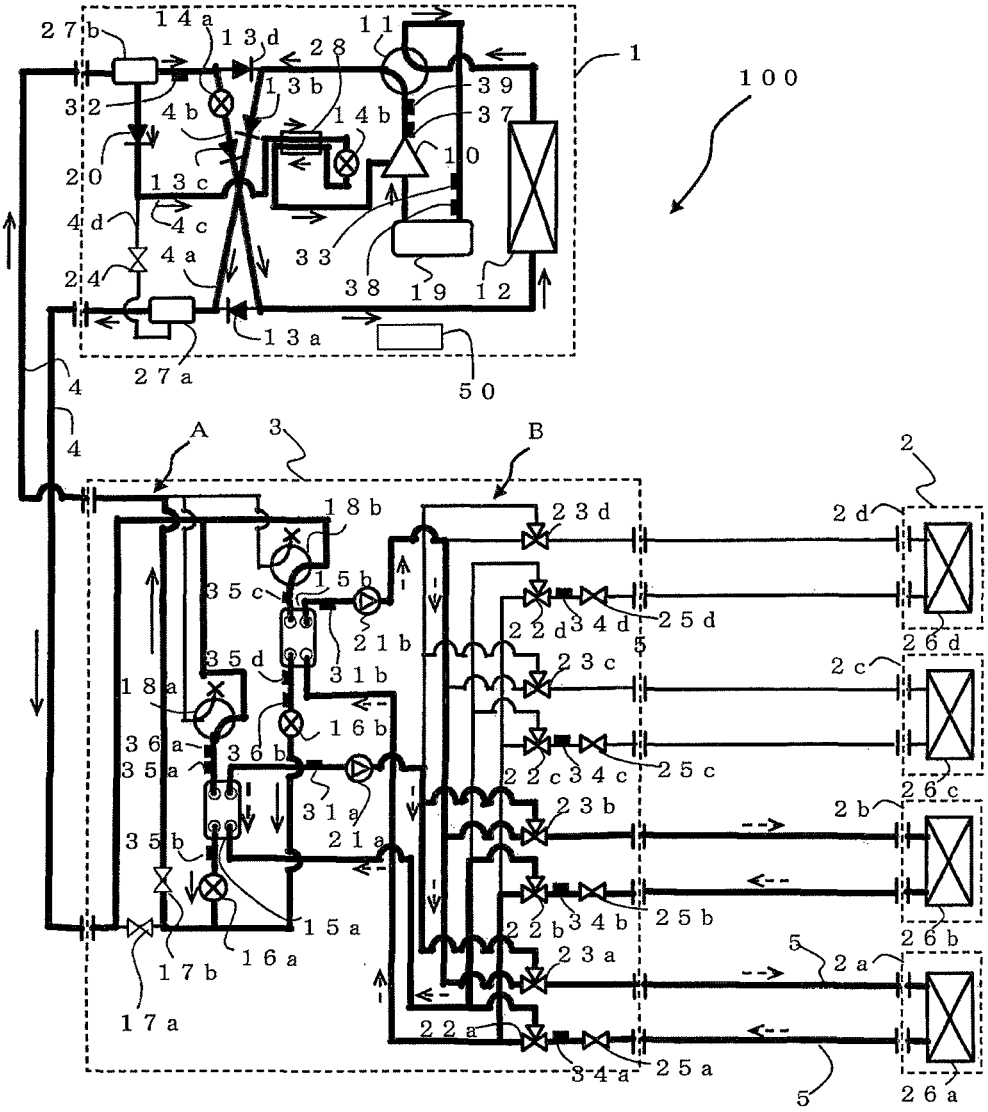
FIG. 6 is a refrigerant circuit diagram illustrating a refrigerant flow when the air-conditioning apparatus according to Embodiment 1 of the present invention is in a heating only operation mode.

FIG. 6 is a refrigerant circuit diagram illustrating a refrigerant flow when the air-conditioning apparatus 100 is in the heating only operation mode. Referring to FIG. 6, a description will be given of the heating only operation mode in the context of the heating energy load being generated only in the use side heat exchanger 26*a* and the use side heat exchanger 26*b*. In FIG. 6, the pipes indicated by the thick lines represent pipes through which refrigerants (heat source side refrigerant and heat medium) flow. In FIG. 6, furthermore, the direction of the flow of a heat source side refrigerant is indicated by the solid line arrows, and the flow direction of a heat medium is indicated by the broken line arrows.

In the heating only operation mode illustrated in FIG. 6, in the outdoor unit 1, the first refrigerant flow switching device 11 is switched so as to cause a heat source side refrigerant discharged from the compressor 10 to flow into the heat medium relay unit 3 without passing through the heat source side heat exchanger 12. In the heat medium relay unit 3, the pump 21*a* and the pump 21*b* are driven to open the heat medium flow control device 25*a* and the heat medium flow control device 25*b* and to set the heat medium flow control device 25*c* and the heat medium flow control device 25*d* to a fully closed state, thereby allowing a heat medium to circulate between each of the intermediate heat exchanger 15*a* and the intermediate heat exchanger 15*b* and the use side heat exchanger 26*a* and between each of the intermediate heat exchanger 15*a* and the intermediate heat exchanger 15*b* and the use side heat exchanger 26*b*.

First, the flow of a heat source side refrigerant in the refrigerant circuit A will be described.

A low-temperature and low-pressure refrigerant is compressed by the compressor 10, and is discharged as a high-temperature and high-pressure gaseous refrigerant. The high-temperature and high-pressure gaseous refrigerant discharged from the compressor 10 passes through the first refrigerant flow switching device 11, travels through the first connecting pipe 4*a*, and flows out of the outdoor unit 1 via the check valve 13*b* and the gas-liquid separator 27*a*. The high-temperature and high-pressure gaseous refrigerant that has flowed out of the outdoor unit 1 flows into the heat medium relay unit 3 through the refrigerant pipe 4. The flow of the high-temperature and high-pressure gaseous refrigerant that has flowed into the heat medium relay unit 3 is split into flows into the intermediate heat exchanger 15*a* and the intermediate heat exchanger 15*b* through the second refrigerant flow switching device 18*a* and the second refrigerant flow switching device 18*b*, respectively.

The high-temperature and high-pressure gaseous refrigerants that has flowed into the intermediate heat exchanger 15*a* and the intermediate heat exchanger 15*b* are condensed and liquified while transferring heat to a heat medium circulating in the heat medium circuit B, and are converted into high-pressure liquid refrigerants. The liquid refrigerants that has flowed out of the intermediate heat exchanger 15*a* and the intermediate heat exchanger 15*b* are expanded by the expansion device 16*a* and the expansion device 16*b*, respectively, into an intermediate-temperature and intermediate-pressure two-phase refrigerant. This two-phase refrigerant flows out of the heat medium relay unit 3 via the opening/closing device 17*b*, and again flows into the outdoor unit 1 through the refrigerant pipe 4. The refrigerant that has flowed into the outdoor unit 1 passes through the gas-liquid separator 27*b*. Part of the refrigerant flows into the second connecting pipe 4*b*, and passes through the expansion device 14*a*. The refrigerant is then throttled by the expansion device 14*a*, and is converted into a low-temperature and low-pressure two-phase refrigerant. The resulting two-phase refrigerant flows into the heat source side heat exchanger 12, which serves as an evaporator, through the check valve 13*c*.

The refrigerant that has flowed into the heat source side heat exchanger 12 removes heat from the outdoor air in the heat source side heat exchanger 12, and is converted into a low-temperature and low-pressure gaseous refrigerant. The low-temperature and low-pressure gaseous refrigerant that has flowed out of the heat source side heat exchanger 12 is again sucked into the compressor 10 via the first refrigerant flow switching device 11 and the accumulator 19.

In this case, the opening degree of the expansion device 16*a* is controlled so that the subcool (degree of subcooling) obtained as a difference between the value of the saturation temperature converted from the pressure detected by the pressure sensor 36*a* and the temperature detected by the third temperature sensor 35*b* is constant. Similarly, the opening degree of the expansion device 16*b* is controlled so that the subcool obtained as a difference between the value of the saturation temperature converted from the pressure detected by the pressure sensor 36*b* and the temperature detected by the third temperature sensor 35*d* is constant. Furthermore, the opening/closing device 17*a* is in a closed state, and the opening/closing device 17*b* is in an opened state. If it is possible to measure the temperatures at intermediate positions of the intermediate heat exchangers 15, the temperatures measured at the intermediate positions may be used instead of those obtained by the pressure sensors 36. The system can thus be constructed at low cost.

Figure 7:
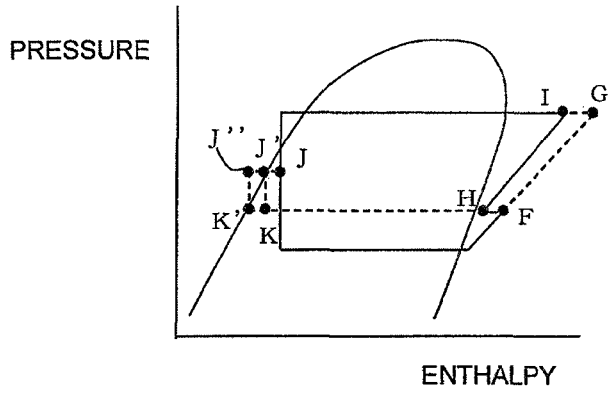
FIG. 7 is a P-h diagram illustrating a state transition of a heat source side refrigerant when the air-conditioning apparatus according to Embodiment 1 of the present invention is in the heating only operation mode.

If R32 is used as a heat source side refrigerant, the discharge temperature of the compressor 10 may be high. Hence, the discharge temperature is reduced using an injection circuit. The operation performed in this case will be described with reference to FIG. 6 and FIG. 7. FIG. 7 is a P-h diagram (pressure-enthalpy diagram) illustrating a state transition of a heat source side refrigerant in the heating only operation mode. In FIG. 7, the vertical axis represents pressure and the horizontal axis represents enthalpy.

In the compressor 10, a low-temperature and low-pressure gaseous refrigerant sucked from the suction port of the compressor 10 is directed into the sealed container, and the low-temperature and low-pressure gaseous refrigerant filled in the sealed container is sucked into the compression chamber (not illustrated). The internal volume of the compression chamber decreases while the compression chamber is rotated 0 to 360 degrees with a motor (not illustrated). The inside refrigerant that has been sucked into the compression chamber is compressed so that the pressure and the temperature increase in accordance with the decrease in the internal volume of the compression chamber. When the rotation angle of the motor reaches a certain angle, the opening (formed in part of the compression chamber) is opened (the state indicated by point F in FIG. 7), thereby bringing the inside of the compression chamber and the injection pipe 4*c* located outside the compressor 10 into communication with each other.

In the heating only operation mode, due to the operation of the expansion device 14*a*, the pressure of the refrigerant returning to the outdoor unit 1 from the heat medium relay unit 3 through the refrigerant pipe 4 is controlled to have an intermediate-pressure state on the upstream side of the expansion device 14*a* (point J in FIG. 7). The two-phase refrigerant, which has been set to an intermediate-pressure state due to the operation of the expansion device 14*a*, is separated into a liquid refrigerant and a two-phase refrigerant by the gas-liquid separator 27*b*, and the liquid refrigerant (saturated liquid refrigerant (point J' in FIG. 7)) flows into the branch pipe 4*d*. This liquid refrigerant flows through the injection pipe 4*c* via the backflow prevention device 20, and flows into the expansion device 14*b* via the refrigerant-refrigerant heat exchanger 28 to undergo pressure reduction. A low-temperature and intermediate-pressure two-phase refrigerant whose pressure has been slightly reduced through the pressure reduction is obtained. The refrigerant-refrigerant heat exchanger 28 exchanges heat between the heat source side refrigerant (refrigerant on the primary side) before undergoing pressure reduction in the expansion device 14*b* and the refrigerant (refrigerant on the secondary side) after having undergone pressure reduction in the expansion device 14*b*.

The heat source side refrigerant that has flowed into the expansion device 14*b* is cooled with the heat source side refrigerant whose pressure and temperature have been reduced through pressure reduction in the refrigerant-refrigerant heat exchanger 28, and is converted into a subcooled liquid refrigerant (point J" in FIG. 7). The heat source side refrigerant is throttled by the expansion device 14*b* (point K' in FIG. 7), and is then heated with the refrigerant before undergoing pressure reduction in the refrigerant-refrigerant heat exchanger 28 (point K in FIG. 7). Then, the heat source side refrigerant is directed into the compression chamber through the opening port formed in the compression chamber of the compressor 10. In the compression chamber of the compressor 10, due to mixing of the intermediate-pressure gaseous refrigerant (point F in FIG. 7) and the low-temperature and intermediate-pressure two-phase refrigerant (point K in FIG. 7), the temperature of the refrigerant decreases (point H in FIG. 7). This results in a reduction in the discharge temperature of the refrigerant to be discharged from the compressor 10 (point I in FIG. 7). The discharge temperature of the compressor 10 obtained without using such injection is indicated by point G in FIG. 7. It is found that the discharge temperature is reduced from point G to point I due to the injection.

A refrigerant in a saturated liquid state actually contains a small amount of fine gaseous refrigerant, and changes to a two-phase state in response to only a small pressure drop. The expansion device 14*b* may not be able to perform stable control if a refrigerant in a two-phase state flows into the expansion device 14*b*. The air-conditioning apparatus 100 having the configuration described above allows a refrigerant in an intermediate-pressure saturated liquid state to be converted into an intermediate-pressure, subcooled liquid refrigerant before flowing into the expansion device 14*b*, and can achieve stable control.

In this case, the opening/closing device 24 is in a closed state, which prevents a refrigerant in a high-pressure state supplied from the gas-liquid separator 27*a* from being mixed with a refrigerant in an intermediate-pressure state that has passed through the backflow prevention device 20. The opening/closing device 24 may be a device capable of switching between an opened state and a closed state, such as a solenoid valve, or may be a device whose opening area is changeable, such as an electronic expansion valve. Any device capable of switching a flow path between an opened state and a closed state may be used as the opening/closing device 24. In addition, the backflow prevention device 20 may be a check valve or a device capable of switching a flow path between an opened state and a closed state, for example, a device capable of switching between an opened state and a closed state, such as a solenoid valve, or a device whose opening area is changeable, such as an electronic expansion valve.

The expansion device 14*a* is preferably a device whose opening area is changeable, such as an electronic expansion valve. If an electronic expansion valve is used as the expansion device 14*a*, the intermediate pressure on the upstream side of the expansion device 14*a* may be controlled to be equal to any pressure. For example, control is performed so that the intermediate pressure detected by the intermediate-pressure detecting device 32 is equal to a certain value, thereby allowing the expansion device 14*b* to stably control the discharge temperature. However, the expansion device 14*a* is not limited to this type. For example, the expansion device 14*a* may be formed by using small opening and closing valves such as solenoid valves in combination so that a plurality of opening areas may be selectable although controllability is slightly low. Alternatively, a capillary tube may be used as the expansion device 14*a* so that an intermediate pressure is formed in accordance with the pressure drop of the refrigerant. Furthermore, the intermediate-pressure detecting device 32 may be a pressure sensor, or may be configured to compute an intermediate pressure using a temperature sensor through computation.

The expansion device 14*b* is a device whose opening area is changeable, such as an electronic expansion valve, and the opening area of the expansion device 14*b* is controlled so that the discharge temperature of the compressor 10 detected by the discharge refrigerant temperature detecting device 37 is not excessively high. The opening area of the expansion device 14*b* may be controlled so that the expansion device 14*b* is opened by a constant opening degree, for example, in steps of 10 pulses, when the discharge temperature exceeds a certain value, for example, 110° C. or the like. Another control method may be to control the opening degree so that the discharge temperature is equal to a target value, for example, 100° C. Alternatively, a capillary tube may be used as the expansion device 14*b*, and the amount of refrigerant corresponding to the pressure difference may be injected.

In the heating only operation mode, each of the intermediate heat exchanger 15*a* and the intermediate heat exchanger 15*b* heats a heat medium. Thus, the pressure (intermediate pressure) of the refrigerant on the upstream side of the expansion device 14*a* may be controlled to be high in a range within which the expansion device 16*a* and the expansion device 16*b* can control the subcool. Controlling the intermediate pressure to be high in the manner described above can increase a pressure differential between the intermediate pressure and the pressure of the inside of the compression chamber. This can increase the amount of refrigerant to be injected into the compression chamber. Even if the outdoor air temperature is low, a refrigerant can be supplied to the compression chamber at an injection flow rate sufficient to reduce the discharge temperature.

In addition, the control method for the expansion device 14*a* and the expansion device 14*b* is not limited to that described above. The expansion device 14*a* and the expansion device 14*b* may be controlled in such a manner that the expansion device 14*b* is set to a fully opened state and the expansion device 14*a* controls a pressure differential between the intermediate pressure and the pressure at the compressor suction unit, thereby controlling the discharge temperature of the compressor 10. This method makes it easy to perform control, and, advantageously, a low-cost device can be used as the expansion device 14*b*.

Next, the flow of a heat medium in the heat medium circuit B will be described.

In the heating only operation mode, the heating energy of a heat source side refrigerant is transmitted to a heat medium in both the intermediate heat exchanger 15*a* and the intermediate heat exchanger 15*b*, and the heated heat medium is caused by the pump 21*a* and the pump 21*b* to flow through the pipes 5. The heat medium pressurized by and flowing out of the pump 21*a* and the pump 21*b* flows into the use side heat exchanger 26*a* and the use side heat exchanger 26*b* via the second heat medium flow switching device 23*a* and the second heat medium flow switching device 23*b*, respectively. The heat medium then transfers heat to the indoor air in the use side heat exchanger 26*a* and the use side heat exchanger 26*b*, thereby heating the indoor space 7.

Then, the heat medium flows out of the use side heat exchanger 26*a* and the use side heat exchanger 26*b*, and flows into the heat medium flow control device 25*a* and the heat medium flow control device 25*b*, respectively. In this case, the flow rate of the heat medium is controlled to be equal to the flow rate that is necessary to meet the air conditioning load required for the room by using the operation of the heat medium flow control device 25*a* and the heat medium flow control device 25*b*. Then, the heat medium flows into the use side heat exchanger 26*a* and the use side heat exchanger 26*b*. The heat medium flowing out of the heat medium flow control device 25*a* and the heat medium flow control device 25*b* flows into the intermediate heat exchanger 15*a* and the intermediate heat exchanger 15*b* via the first heat medium flow switching device 22*a* and the first heat medium flow switching device 22*b*, and is again sucked into the pump 21*a* and the pump 21*b*.

In the pipes 5 for the use side heat exchangers 26, a heat medium flows in the direction from the second heat medium flow switching devices 23 to the first heat medium flow switching devices 22 via the heat medium flow control devices 25. The air conditioning load required for the indoor space 7 can be met by performing control so that the difference between the temperature detected by the first temperature sensor 31*a* or the temperature detected by the first temperature sensor 31*b* and the temperature detected by the second temperature sensor 34 is maintained at a target value. The outlet temperature of each of the intermediate heat exchangers 15 may be either the temperature of the first temperature sensor 31*a* or the temperature of the first temperature sensor 31*b*, or may be the average of these temperatures.

In this case, the opening degrees of the first heat medium flow switching devices 22 and the second heat medium flow switching devices 23 are set to an intermediate opening degree so as to ensure flow paths to both the intermediate heat exchanger 15*a* and the intermediate heat exchanger 15*b*. Additionally, the use side heat exchanger 26*a* should be controlled by the difference between the temperatures at the inlet and outlet thereof. However, since the heat medium temperature on the inlet side of the use side heat exchanger 26 is almost the same as the temperature detected by the first temperature sensor 31*b*, the use of the first temperature sensor 31*b* may reduce the number of temperature sensors. Accordingly, the system can be constructed at low cost.

As in the cooling only operation mode, the opening degrees of the heat medium flow control devices 25 may be controlled in accordance with the presence or absence of the heat load in the use side heat exchangers 26.

[Cooling Main Operation Mode]

Figure 8:
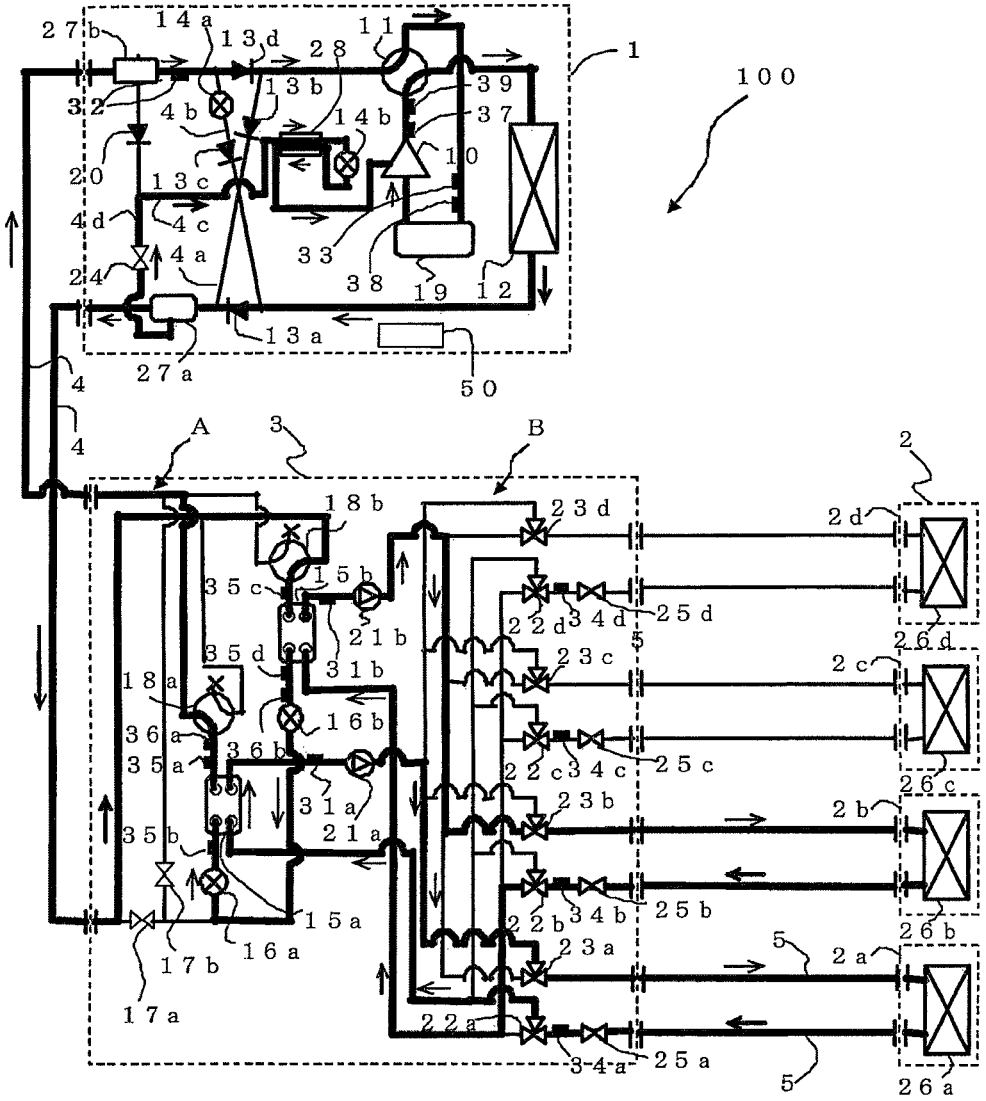
FIG. 8 is a refrigerant circuit diagram illustrating a refrigerant flow when the air-conditioning apparatus according to Embodiment 1 of the present invention is in a cooling main operation mode.

FIG. 8 is a refrigerant circuit diagram illustrating a refrigerant flow when the air-conditioning apparatus 100 is in the cooling main operation mode. Referring to FIG. 8, a description will be given of the cooling main operation mode in the context of the cooling energy load being generated in the use side heat exchanger 26*a* and the heating energy load being generated in the use side heat exchanger 26*b*. In FIG. 8, the pipes indicated by the thick lines represent pipes through which refrigerants (heat source side refrigerant and heat medium) circulate. In FIG. 8, furthermore, the direction of the flow of a heat source side refrigerant is indicated by the solid line arrows, and the flow direction of a heat medium is indicated by the broken line arrows.

In the cooling main operation mode illustrated in FIG. 8, in the outdoor unit 1, the first refrigerant flow switching device 11 is switched so as to cause a heat source side refrigerant discharged from the compressor 10 to flow into the heat source side heat exchanger 12. In the heat medium relay unit 3, the pump 21*a* and the pump 21*b* are driven to open the heat medium flow control device 25*a* and the heat medium flow control device 25*b* and to set the heat medium flow control device 25*c* and the heat medium flow control device 25*d* to a fully closed state, thereby allowing a heat medium to circulate between the intermediate heat exchanger 15*a* and the use side heat exchanger 26*a* and between the intermediate heat exchanger 15*b* and the use side heat exchanger 26*b*.

First, the flow of a heat source side refrigerant in the refrigerant circuit A will be described.

A low-temperature and low-pressure refrigerant is compressed by the compressor 10, and is discharged as a high-temperature and high-pressure gaseous refrigerant. The high-temperature and high-pressure gaseous refrigerant discharged from the compressor 10 flows into the heat source side heat exchanger 12 via the first refrigerant flow switching device 11. Then, the gaseous refrigerant is condensed in the heat source side heat exchanger 12 while transferring heat to the outdoor air, and is converted into a two-phase refrigerant. The two-phase refrigerant that has flowed out of the heat source side heat exchanger 12 passes through the check valve 13*a*. Part of the two-phase refrigerant flows out of the outdoor unit 1 via the gas-liquid separator 27*a*, and flows into the heat medium relay unit 3 through the refrigerant pipe 4. The two-phase refrigerant that has flowed into the heat medium relay unit 3 flows through the second refrigerant flow switching device 18*b*, and then flows into the intermediate heat exchanger 15*b*, which serves as a condenser.

The two-phase refrigerant that has flowed into the intermediate heat exchanger 15*b* is condensed and liquified while transferring heat to a heat medium circulating in the heat medium circuit B, and is converted into a liquid refrigerant. The liquid refrigerant that has flowed out of the intermediate heat exchanger 15*b* is expanded by the expansion device 16*b* into a low-pressure two-phase refrigerant. The low-pressure two-phase refrigerant flows into the intermediate heat exchanger 15*a*, which serves as an evaporator, via the expansion device 16*a*. The low-pressure two-phase refrigerant that has flowed into the intermediate heat exchanger 15*a* removes heat from a heat medium circulating in the heat medium circuit B to cool the heat medium, thereby being converted into a low-pressure gaseous refrigerant. The gaseous refrigerant flows out of the intermediate heat exchanger 15*a*, flows out of the heat medium relay unit 3 via the second refrigerant flow switching device 18*a*, and again flows into the outdoor unit 1 through the refrigerant pipe 4. The refrigerant that has flowed into the outdoor unit 1 passes through the check valve 13*d* via the gas-liquid separator 27*b*, and is again sucked into the compressor 10 via the first refrigerant flow switching device 11 and the accumulator 19.

In this case, the opening degree of the expansion device 16*b* is controlled so that the superheat obtained as a difference between the temperature detected by the third temperature sensor 35*a* and the temperature detected by the third temperature sensor 35*b* is constant. The expansion device 16*a* is in a fully opened state, the opening/closing device 17*a* is in a closed state, and the opening/closing device 17*b* is in a closed state. The opening degree of the expansion device 16*b* may be controlled so that the subcool obtained as a difference between the value of the saturation temperature converted from the pressure detected by the pressure sensor 36*b* and the temperature detected by the third temperature sensor 35*d* is constant. Furthermore, the expansion device 16*b* may be set to a fully opened state, and the superheat or the subcool may be controlled by the expansion device 16*a*.

Figure 9:
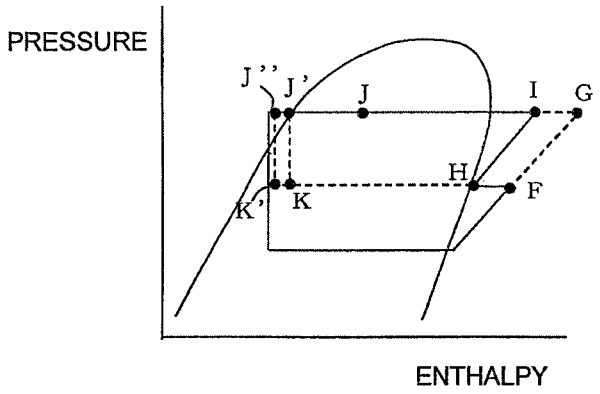
FIG. 9 is a P-h diagram illustrating a state transition of a heat source side refrigerant when the air-conditioning apparatus according to Embodiment 1 of the present invention is in the cooling main operation mode.

If R32 is used as a heat source side refrigerant, the discharge temperature of the compressor 10 may be high. Hence, the discharge temperature is reduced using an injection circuit. The operation performed in this case will be described with reference to FIG. 8 and FIG. 9. FIG. 9 is a P-h diagram (pressure-enthalpy diagram) illustrating a state transition of a heat source side refrigerant in the cooling main operation mode. In FIG. 9, the vertical axis represents pressure and the horizontal axis represents enthalpy.

In the compressor 10, a low-temperature and low-pressure gaseous refrigerant sucked from the suction port of the compressor 10 is directed into the sealed container, and the low-temperature and low-pressure gaseous refrigerant filled in the sealed container is sucked into the compression chamber (not illustrated). The internal volume of the compression chamber decreases while the compression chamber is rotated 0 to 360 degrees with a motor (not illustrated). The inside refrigerant that has been sucked into the compression chamber is compressed in accordance with the decrease in the internal volume of the compression chamber, so that the pressure and the temperature thereof increase. When the rotation angle of the motor reaches a certain angle, the opening (formed in part of the compression chamber) is opened (the state indicated by point F in FIG. 9), thereby bringing the inside of the compression chamber and the injection pipe 4*c* located outside the compressor 10 into communication with each other.

In the cooling main operation mode, the refrigerant compressed by the compressor 10 is condensed in the heat source side heat exchanger 12 into a high-pressure two-phase refrigerant (point J in FIG. 9), and reaches the gas-liquid separator 27*a* via the check valve 13*a*. The opening/closing device 24 is set to an opened state. The liquid refrigerant (saturated liquid refrigerant (point J' in FIG. 9)) separated by the gas-liquid separator 27*a* flows into the injection pipe 4*c* via the opening/closing device 24 through the branch pipe 4*d*. The refrigerant that has flowed into the injection pipe 4*c* undergoes pressure reduction in the expansion device 14*b* via the refrigerant-refrigerant heat exchanger 28, and is converted into a low-temperature and intermediate-pressure two-phase refrigerant. The refrigerant-refrigerant heat exchanger 28 exchanges heat between the heat source side refrigerant (refrigerant on the primary side) before undergoing pressure reduction in the expansion device 14*b* and the refrigerant (refrigerant on the secondary side) after having undergone pressure reduction in the expansion device 14*b*.

The heat source side refrigerant that has flowed into the expansion device 14*b* is cooled with the refrigerant whose pressure and temperature have been reduced through pressure reduction in the refrigerant-refrigerant heat exchanger 28, and is converted into a subcooled liquid refrigerant (point J" in FIG. 9). The heat source side refrigerant is throttled by the expansion device 14*b* (point K' in FIG. 9), and is then heated with the refrigerant before undergoing pressure reduction in the refrigerant-refrigerant heat exchanger 28 (point K in FIG. 9). Then, the heat source side refrigerant is directed into the compression chamber through the opening port formed in the compression chamber of the compressor 10. In the compression chamber of the compressor 10, due to mixing of the intermediate-pressure gaseous refrigerant (point F in FIG. 9) and the low-temperature and intermediate-pressure two-phase refrigerant (point K in FIG. 9), the temperature of the refrigerant decreases (point H in FIG. 9). This results in a reduction in the discharge temperature of the refrigerant to be discharged from the compressor 10 (point I in FIG. 9). The discharge temperature of the compressor 10 obtained without using such injection is indicated by point G in FIG. 9. It is found that the discharge temperature is reduced from point G to point I due to the injection.

A refrigerant in a saturated liquid state actually contains a small amount of fine gaseous refrigerant, and changes to a two-phase state in response to only a small pressure drop. The expansion device 14*b* may not be able to perform stable control if a refrigerant in a two-phase state flows into the expansion device 14*b*. The air-conditioning apparatus 100 having the configuration described above allows a high-pressure refrigerant in a saturated liquid state separated from the two-phase refrigerant that has flowed into the gas-liquid separator 27*a* to be converted into a high-pressure, subcooled liquid refrigerant and to flow into the expansion device 14*b*, thereby achieving stable control.

In this case, the refrigerant in the flow path from the opening/closing device 24 to the backflow prevention device 20 in the branch pipe 4*d* is a high-pressure refrigerant, and the refrigerant returning to the outdoor unit 1 from the heat medium relay unit 3 through the refrigerant pipe 4 and reaching the gas-liquid separator 27*b* is a low-pressure refrigerant. The backflow prevention device 20 is configured to prevent the flow of a refrigerant from the branch pipe 4*d* to the gas-liquid separator 27*b*. Due to the operation of the backflow prevention device 20, the high-pressure refrigerant in the branch pipe 4*d* is prevented from being mixed with the low-pressure refrigerant in the gas-liquid separator 27*b*.

The opening/closing device 24 may be a device capable of switching between an opened state and a closed state, such as a solenoid valve, or may be a device whose opening area is changeable, such as an electronic expansion valve. Any device capable of switching a flow path between an opened state and a closed state may be used as the opening/closing device 24. In addition, the backflow prevention device 20 may be a check valve or a device capable of switching a flow path between an opened state and a closed state, for example, a device capable of switching between an opened state and a closed state, such as a solenoid valve, or a device whose opening area is changeable, such as an electronic expansion valve. Since a refrigerant does not flow through the expansion device 14*a*, the opening degree of the expansion device 14*a* may be set as desired.

The expansion device 14*b* is a device whose opening area is changeable, such as an electronic expansion valve, and the opening area of the expansion device 14*b* is controlled so that the discharge temperature of the compressor 10 detected by the discharge refrigerant temperature detecting device 37 is not excessively high. The opening area of the expansion device 14*b* may be controlled so that the expansion device

14*b* is opened by a constant opening degree, for example, in steps of 10 pulses, when the discharge temperature exceeds a certain value, for example, 110° C. or the like. Another control method may be to control the opening degree so that the discharge temperature is equal to a target value, for example, 100° C. Alternatively, a capillary tube may be used as the expansion device 14*b*, and an amount of refrigerant corresponding to a pressure difference may be injected.

Next, the flow of a heat medium in the heat medium circuit B will be described.

In the cooling main operation mode, the heating energy of a heat source side refrigerant is transmitted to a heat medium in the intermediate heat exchanger 15*b*, and the heated heat medium is caused by the pump 21*b* to flow through the pipes 5. In the cooling main operation mode, furthermore, the cooling energy of a heat source side refrigerant is transmitted to a heat medium in the intermediate heat exchanger 15*a*, and the cooled heat medium is caused by the pump 21*a* to flow through the pipes 5. The heat medium pressurized by and flowing out of the pump 21*a* and the pump 21*b* flows into the use side heat exchanger 26*a* and the use side heat exchanger 26*b* via the second heat medium flow switching device 23*a* and the second heat medium flow switching device 23*b*, respectively.

In the use side heat exchanger 26*b*, the heat medium transfers heat to the indoor air, thereby heating the indoor space 7. In the use side heat exchanger 26*a*, the heat medium removes heat from the indoor air, thereby cooling the indoor space 7. In this case, the flow rate of the heat medium is controlled to be equal to the flow rate that is necessary to meet the air conditioning load required for the room by using the operation of the heat medium flow control device 25*a* and the heat medium flow control device 25*b*, and the heat medium flows into the use side heat exchanger 26*a* and the use side heat exchanger 26*b*. The heat medium passes through the use side heat exchanger 26*b*, so that the temperature of the heat medium is slightly reduced. The resulting heat medium flows into the intermediate heat exchanger 15*b* via the heat medium flow control device 25*b* and the first heat medium flow switching device 22*b*, and is again sucked into the pump 21*b*. The heat medium passes through the use side heat exchanger 26*a*, so that the temperature of the heat medium is slightly increased. The resulting heat medium flows into the intermediate heat exchanger 15*a* via the heat medium flow control device 25*a* and the first heat medium flow switching device 22*a*, and is again sucked into the pump 21*a*.

During this operation, due to the operation of the first heat medium flow switching device 22 and the second heat medium flow switching device 23, the warm heat medium and the cold heat medium are directed into use side heat exchangers 26 having a heating energy load and a cooling energy load, respectively, without being mixed. In the pipes 5 for the use side heat exchangers 26, a heat medium flows in the direction from the second heat medium flow switching devices 23 to the first heat medium flow switching devices 22 via the heat medium flow control devices 25 regardless of the heating or cooling side. The air conditioning load required for the indoor space 7 can be met by performing control so that, on the heating side, the difference between the temperature detected by the first temperature sensor 31*b* and the temperature detected by the second temperature sensor 34 is maintained at a target value, and, on the cooling side, the difference between the temperature detected by the second temperature sensor 34 and the temperature detected by the first temperature sensor 31*a* is maintained at a target value.

As in the cooling only operation mode and the heating only operation mode, the opening degrees of the heat medium flow control devices 25 may be controlled in accordance with the presence or absence of the heat load in the use side heat exchangers 26.

The high discharge temperature state occurs in the cooling operation with a high outdoor air temperature when the frequency of the compressor 10 increases to keep the evaporating temperature at a target temperature, for example, 0 degrees C., and when the condensing temperature is high. The high discharge temperature state also occurs in the heating operation with a low outdoor air temperature when the frequency of the compressor 10 increases to keep the condensing temperature at a target temperature, for example, 49 degrees C., and when the evaporating temperature is low.

In the cooling main operation mode, both the condensing temperature and the evaporating temperature need to be kept at target temperatures, for example, 49° C. and 0° C., respectively. In the cooling main operation mode with a high outdoor air temperature, both the condensing temperature and the evaporating temperature are higher than the target temperatures. For this reason, the state where the frequency of the compressor 10 is significantly high as in the cooling operation with a high outdoor air temperature is less likely to occur, and there are limitations on the increase in the frequency of the compressor 10 to prevent an excessive increase in condensing temperature. That is, in the cooling main operation mode, the discharge temperature is less likely to increase.

Figure 13:
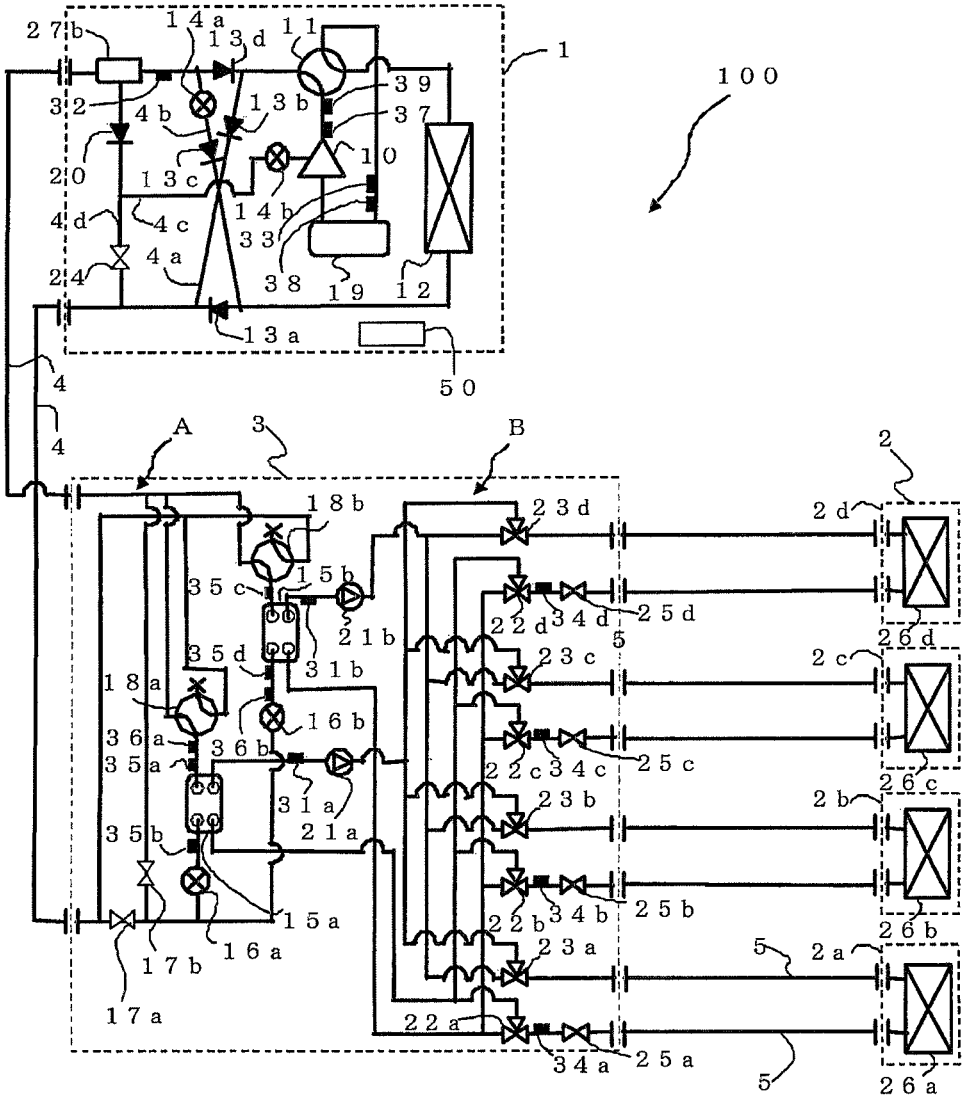
FIG. 13 is a schematic circuit configuration diagram illustrating another example circuit configuration of the air-conditioning apparatus according to Embodiment 1 of the present invention.

Accordingly, a configuration may be used in which, as illustrated in FIG. 13, a branch portion at which the flow of a refrigerant branches may be provided in place of the gas-liquid separator 27*a*. In the cooling main operation mode, the opening/closing device 24 may be set to a closed state so that injection is not carried out. FIG. 13 is a schematic circuit configuration diagram illustrating another example circuit configuration of the air-conditioning apparatus 100.

[Heating Main Operation Mode]

Figure 10:
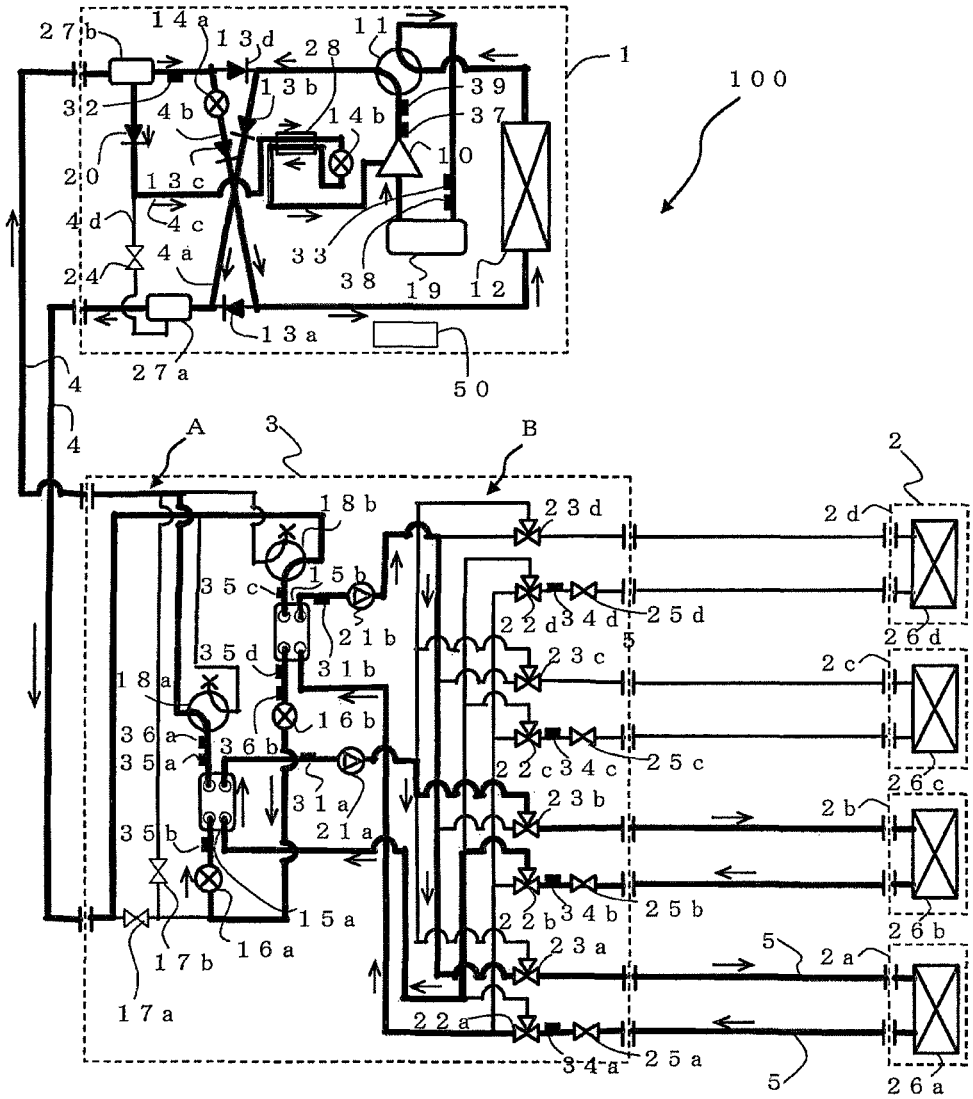
FIG. 10 is a refrigerant circuit diagram illustrating a refrigerant flow when the air-conditioning apparatus according to Embodiment 1 of the present invention is in a heating main operation mode.

FIG. 10 is a refrigerant circuit diagram illustrating a refrigerant flow when the air-conditioning apparatus 100 is in the heating main operation mode. Referring to FIG. 10, a description will be given of the heating main operation mode in the context of the heating energy load being generated in the use side heat exchanger 26*a* and the cooling energy load being generated in the use side heat exchanger 26*b*. In FIG. 10, the pipes indicated by the thick lines represent pipes through which refrigerants (heat source side refrigerant and heat medium) circulate. In FIG. 10, furthermore, the direction of the flow of a heat source side refrigerant is indicated by the solid line arrows, and the flow direction of a heat medium is indicated by the broken line arrows.

In the heating main operation mode illustrated in FIG. 10, in the outdoor unit 1, the first refrigerant flow switching device 11 is switched so as to cause a heat source side refrigerant discharged from the compressor 10 to flow into the heat medium relay unit 3 without passing through the heat source side heat exchanger 12. In the heat medium relay unit 3, the pump 21*a* and the pump 21*b* are driven to open the heat medium flow control device 25*a* and the heat medium flow control device 25*b* and to set the heat medium flow control device 25*c* and the heat medium flow control device 25*d* to a fully closed state, thereby allowing a heat medium to circulate between the intermediate heat exchanger 15*a* and the use side heat exchanger 26*b* and between the intermediate heat exchanger 15*b* and the use side heat exchanger 26*a*.

First, the flow of a heat source side refrigerant in the refrigerant circuit A will be described.

A low-temperature and low-pressure refrigerant is compressed by the compressor 10, and is discharged as a high-temperature and high-pressure gaseous refrigerant. The high-temperature and high-pressure gaseous refrigerant discharged from the compressor 10 passes through the first refrigerant flow switching device 11, travels through the first connecting pipe 4*a*, and flows out of the outdoor unit 1 via the check valve 13*b* and the gas-liquid separator 27*a*. The high-temperature and high-pressure gaseous refrigerant that has flowed out of the outdoor unit 1 flows into the heat medium relay unit 3 through the refrigerant pipe 4. The high-temperature and high-pressure gaseous refrigerant that has flowed into the heat medium relay unit 3 flows into the intermediate heat exchanger 15*b*, which serves as a condenser, via the second refrigerant flow switching device 18*b*.

The gaseous refrigerant that has flowed into the intermediate heat exchanger 15*b* is condensed and liquified while transferring heat to the heat medium circulating in the heat medium circuit B, and is converted into a liquid refrigerant. The liquid refrigerant that has flowed out of the intermediate heat exchanger 15*b* is expanded by the expansion device 16*b* into an intermediate-pressure two-phase refrigerant. The intermediate-pressure two-phase refrigerant flows into the intermediate heat exchanger 15*a*, which serves as an evaporator, via the expansion device 16*a*. The intermediate-pressure two-phase refrigerant that has flowed into the intermediate heat exchanger 15*a* evaporates by removing heat from a heat medium circulating in the heat medium circuit B, and cools the heat medium. The intermediate-pressure two-phase refrigerant flows out of the intermediate heat exchanger 15*a*, flows out of the heat medium relay unit 3 via the second refrigerant flow switching device 18*a*, and again flows into the outdoor unit 1 through the refrigerant pipe 4.

The refrigerant that has flowed into the outdoor unit 1 passes through the gas-liquid separator 27*b*. Part of the refrigerant flows into the second connecting pipe 4*b*, and passes through the expansion device 14*a*. The refrigerant is then throttled by the expansion device 14*a*, and is converted into a low-temperature and low-pressure two-phase refrigerant. The resulting two-phase refrigerant flows into the heat source side heat exchanger 12, which serves as an evaporator, via the check valve 13*c*. The refrigerant that has flowed into the heat source side heat exchanger 12 removes heat from the outdoor air in the heat source side heat exchanger 12, and is converted into a low-temperature and low-pressure gaseous refrigerant. The low-temperature and low-pressure gaseous refrigerant that has flowed out of the heat source side heat exchanger 12 is again sucked into the compressor 10 via the first refrigerant flow switching device 11 and the accumulator 19.

In this case, the opening degree of the expansion device 16*b* is controlled so that the subcool obtained as a difference between the value of the saturation temperature converted from the pressure detected by the pressure sensor 36 and the temperature detected by the third temperature sensor 35*b* is constant. The expansion device 16*a* is in a fully opened state, the opening/closing device 17*a* is in a closed state, and the opening/closing device 17*b* is in a closed state. The expansion device 16*b* may be set to a fully opened state, and the subcool may be controlled by the expansion device 16*a*.

Figure 11:
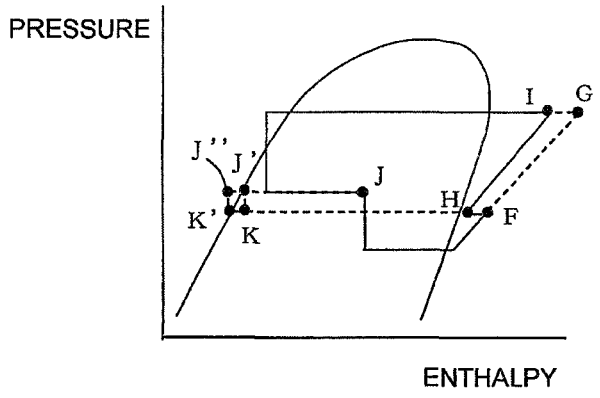
FIG. 11 is a P-h diagram illustrating a state transition of a heat source side refrigerant when the air-conditioning apparatus according to Embodiment 1 of the present invention is in the heating main operation mode.

If R32 is used as a heat source side refrigerant, the discharge temperature of the compressor 10 may be high. Hence, the discharge temperature is reduced using an injection circuit. The operation performed in this case will be described with reference to FIG. 10 and FIG. 11. FIG. 11 is a P-h diagram (pressure-enthalpy diagram) illustrating a state transition of a heat source side refrigerant in the heating main operation mode. In FIG. 11, the vertical axis represents pressure and the horizontal axis represents enthalpy.

In the compressor 10, a low-temperature and low-pressure gaseous refrigerant sucked from the suction port of the compressor 10 is directed into the sealed container, and the low-temperature and low-pressure gaseous refrigerant filled in the sealed container is sucked into the compression chamber (not illustrated). The internal volume of the compression chamber decreases while the compression chamber is rotated 0 to 360 degrees with a motor (not illustrated). The inside refrigerant that has been sucked into the compression chamber is compressed so that the pressure and the temperature increase in accordance with the decrease in the internal volume of the compression chamber. When the rotation angle of the motor reaches a certain angle, the opening port (formed in part of the compression chamber) is opened (the state indicated by point F in FIG. 11), thereby bringing the inside of the compression chamber and the injection pipe 4*c* located outside the compressor 10 into communication with each other.

In the heating main operation mode, due to the operation of the expansion device 14*a*, the pressure of the refrigerant returning to the outdoor unit 1 from the heat medium relay unit 3 through the refrigerant pipe 4 is controlled to have an intermediate-pressure state on the upstream side of the expansion device 14*a* (point J in FIG. 11). The two-phase refrigerant, which has been set to an intermediate-pressure state due to the operation of the expansion device 14*a*, is separated into a liquid refrigerant and a two-phase refrigerant by the gas-liquid separator 27*b*, and the liquid refrigerant (saturated liquid refrigerant (point J' in FIG. 11)) flows into the branch pipe 4*d*. The liquid refrigerant flows through the injection pipe 4*c* via the backflow prevention device 20, and flows into the expansion device 14*b* via the refrigerant-refrigerant heat exchanger 28 to undergo pressure reduction. A low-temperature and intermediate-pressure two-phase refrigerant whose pressure has been slightly reduced through the pressure reduction is obtained. The refrigerant-refrigerant heat exchanger 28 exchanges heat between the heat source side refrigerant (refrigerant on the primary side) before undergoing pressure reduction in the expansion device 14*b* and the refrigerant (refrigerant on the secondary side) after having undergone pressure reduction in the expansion device 14*b*.

The heat source side refrigerant that has flowed into the expansion device 14*b* is cooled with the heat source side refrigerant whose pressure and temperature have been reduced through pressure reduction in the refrigerant-refrigerant heat exchanger 28, and is converted into a subcooled liquid refrigerant (point J" in FIG. 11). The heat source side refrigerant is throttled by the expansion device 14*b* (point K' in FIG. 11), and is then heated with the refrigerant before undergoing pressure reduction in the refrigerant-refrigerant heat exchanger 28 (point K in FIG. 11). Then, the heat source side refrigerant is directed into the compression chamber through the opening port formed in the compression chamber of the compressor 10. In the compression chamber of the compressor 10, due to mixing of the intermediate-pressure gaseous refrigerant (point F in FIG. 11) and the low-temperature and intermediate-pressure two-phase refrigerant (point K in FIG. 11), the temperature of the refrigerant decreases (point H in FIG. 11). This results in a reduction in the discharge temperature of the refrigerant to be discharged from the compressor 10 (point I in FIG. 11). The discharge temperature of the compressor 10 obtained without using such injection is indicated by point G in FIG. 11. It is found that the discharge temperature is reduced from point G to point I due to the injection.

A refrigerant in a saturated liquid state actually contains a small amount of fine gaseous refrigerant, and changes to a two-phase state in response to only a small pressure drop. The expansion device 14*b* may not be able to perform stable control if a refrigerant in a two-phase state flows into the expansion device 14*b*. The air-conditioning apparatus 100 having the configuration described above allows a refrigerant in an intermediate-pressure saturated liquid state to be converted into an intermediate-pressure, subcooled liquid refrigerant and to flow into the expansion device 14*b*, thereby achieving stable control.

In this case, the opening/closing device 24 is in a closed state, which prevents a refrigerant in a high-pressure state supplied from the gas-liquid separator 27*a* from being mixed with a refrigerant in an intermediate-pressure state that has passed through the backflow prevention device 20. The opening/closing device 24 may be a device capable of switching between an opened state and a closed state, such as a solenoid valve, or may be a device whose opening area is changeable, such as an electronic expansion valve. Any device capable of switching a flow path between an opened state and a closed state may be used as the opening/closing device 24. In addition, the backflow prevention device 20 may be a check valve or may be a device capable of switching a flow path between an opened state and a closed state, for example, a device capable of switching between an opened state and a closed state, such as a solenoid valve, or a device whose opening area is changeable, such as an electronic expansion valve.

The expansion device 14*a* is preferably a device whose opening area is changeable, such as an electronic expansion valve. If an electronic expansion valve is used as the expansion device 14*a*, the intermediate-pressure on the upstream side of the expansion device 14*a* may be controlled to be equal to any pressure. For example, control is performed so that the intermediate pressure detected by the intermediate-pressure detecting device 32 is equal to a certain value, thereby allowing the expansion device 14*b* to stably control the discharge temperature. However, the expansion device 14*a* is not limited to this type. For example, the expansion device 14*a* may be formed by using small opening and closing valves such as solenoid valves in combination so that a plurality of opening areas may be selectable although controllability is slightly low. Alternatively, a capillary tube may be used as the expansion device 14*a* so that an intermediate pressure is formed in accordance with the pressure drop of the refrigerant. Furthermore, the intermediate-pressure detecting device 32 may be a pressure sensor, or may be configured to compute an intermediate pressure using a temperature sensor through computation.

The expansion device 14*b* is a device whose opening area is changeable, such as an electronic expansion valve, and the opening area of the expansion device 14*b* is controlled so that the discharge temperature of the compressor 10 detected by the discharge refrigerant temperature detecting device 37 is not excessively high. The opening area of the expansion device 14*b* may be controlled so that the expansion device 14*b* is opened by a constant opening degree, for example, in steps of 10 pulses, when the discharge temperature exceeds a certain value, for example, 110° C. or the like. Another control method may be to control the opening degree so that the discharge temperature is equal to a target value, for example, 100° C. Alternatively, a capillary tube may be used as the expansion device 14*b*, and the amount of refrigerant corresponding to the pressure difference may be injected.

In the heating main operation mode, it is necessary to cool the heat medium in the intermediate heat exchanger 15*b*, and it is not possible to control the pressure (intermediate pressure) of the refrigerant on the upstream side of the expansion device 14*a* to be so high. If it is not possible to increase the intermediate pressure, the amount of refrigerant injected into the compression chamber is small, resulting in a small reduction in discharge temperature. However, it is necessary to prevent freezing of the heat medium. To this end, the air-conditioning apparatus 100 does not enter the heating main operation mode when the outdoor air temperature is low, for example, when the outdoor air temperature is −5° C. or less. Men the outdoor air temperature is high, the discharge temperature is not so high and not so high injection flow rate is required. No special problem arises.

According to the air-conditioning apparatus 100, due to the operation of the expansion device 14*a*, an intermediate pressure that allows a heat medium to be cooled in the intermediate heat exchanger 15*b* and that allows a refrigerant to be supplied to the compression chamber at an injection flow rate sufficient to reduce the discharge temperature can be set. More safe operation can thus be performed.

The control method for the expansion device 14*a* and the expansion device 14*b* is not limited to that described above. The expansion device 14*a* and the expansion device 14*b* may be controlled in such a manner that the expansion device 14*b* is set to a fully opened state and the expansion device 14*a* controls the discharge temperature of the compressor 10. This method makes it easy to perform control, and, advantageously, a low-cost device can be used as the expansion device 14*b*.

Next, the flow of a heat medium in the heat medium circuit B will be described.

In the heating main operation mode, the heating energy of a heat source side refrigerant is transmitted to a heat medium in the intermediate heat exchanger 15*b*, and the heated heat medium is caused by the pump 21*b* to flow through the pipes 5. In the heating main operation mode, furthermore, the cooling energy of a heat source side refrigerant is transmitted to a heat medium in the intermediate heat exchanger 15*a*, and the cooled heat medium is caused by the pump 21*a* to flow through the pipes 5. The heat medium pressurized by and flowing out of the pump 21*a* and the pump 21*b* flows into the use side heat exchanger 26*a* and the use side heat exchanger 26*b* via the second heat medium flow switching device 23*a* and the second heat medium flow switching device 23*b*, respectively.

In the use side heat exchanger 26*b*, the heat medium removes heat from the indoor air, thereby cooling the indoor space 7. In the use side heat exchanger 26*a*, the heat medium transfers heat to the indoor air, thereby heating the indoor space 7. In this case, the flow rate of the heat medium is controlled to be equal to the flow rate that is necessary to meet the air conditioning load required for the room by using the operation of the heat medium flow control device 25*a* and the heat medium flow control device 25*b*, and the heat medium flows into the use side heat exchanger 26*a* and the use side heat exchanger 26*b*. The heat medium passes through the use side heat exchanger 26*b*, so that the temperature of the heat medium is slightly increased. The resulting heat medium flows into the intermediate heat exchanger 15*a* via the heat medium flow control device 25*b* and the first heat medium flow switching device 22*b*, and is again sucked into the pump 21*a*. The heat medium passes through the use side heat exchanger 26*a*, so that the temperature of the heat medium is slightly reduced. The resulting heat medium flows into the intermediate heat exchanger 15*b* via the heat medium flow control device 25*a* and the first heat medium flow switching device 22*a*, and is again sucked into the pump 21*b*.

During this operation, due to the operation of the first heat medium flow switching device 22 and the second heat medium flow switching device 23, the warm heat medium and the cold heat medium are directed into use side heat exchangers 26 having a heating energy load and a cooling energy load, respectively, without being mixed. In the pipes 5 for the use side heat exchangers 26, a heat medium flows in the direction from the second heat medium flow switching devices 23 to the first heat medium flow switching devices 22 via the heat medium flow control devices 25 regardless of the heating or cooling side. The air conditioning load required for the indoor space 7 can be met by performing control so that, on the heating side, the difference between the temperature detected by the first temperature sensor 31*b* and the temperature detected by the second temperature sensor 34 is maintained at a target value, and, on the cooling side, the difference between the temperature detected by the second temperature sensor 34 and the temperature detected by the first temperature sensor 31*a* is maintained at a target value.

As in the cooling only operation mode, the heating only operation mode, and the cooling main operation mode, the opening degrees of the heat medium flow control devices 25 may be controlled in accordance with the presence or absence of the heat load in the use side heat exchangers 26.

[Defrosting Operation Mode]

Figure 12:
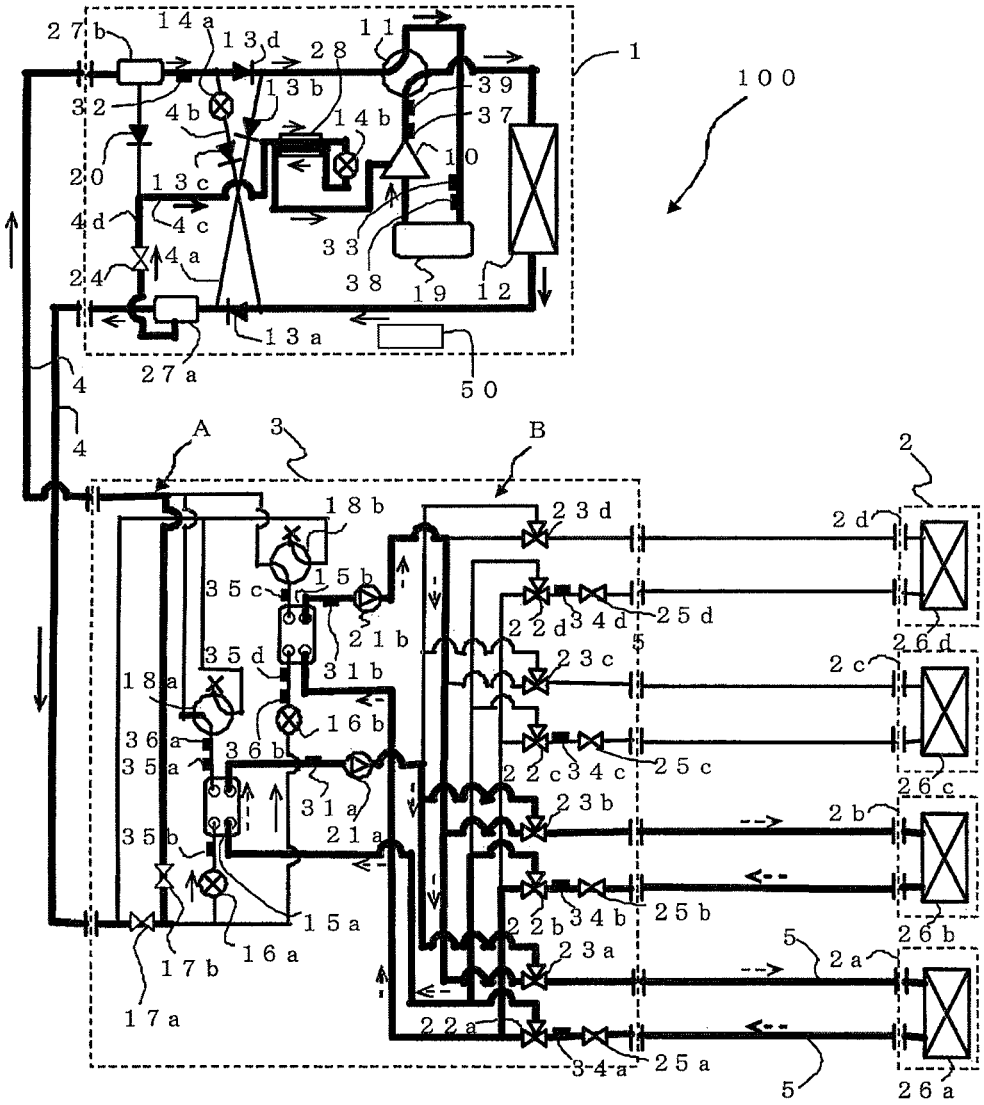
FIG. 12 is a refrigerant circuit diagram illustrating a refrigerant flow when the air-conditioning apparatus according to Embodiment 1 of the present invention is in a defrosting operation mode.

FIG. 12 is a refrigerant circuit diagram illustrating a refrigerant flow when the air-conditioning apparatus 100 is in a defrosting operation mode. Referring to FIG. 12, a description will be given of the defrosting operation executed by the air-conditioning apparatus 100 according to Embodiment 1. In FIG. 12, the pipes indicated by the thick lines represent pipes through which refrigerants (heat source side refrigerant and heat medium) flow. In FIG. 12, furthermore, the direction of the flow of a heat source side refrigerant is indicated by the solid line arrows, and the flow direction of a heat medium is indicated by the broken line arrows.

If the ambient air temperature around the heat source side heat exchanger 12 is low in the heating only operation mode or the heating main operation mode, a low-temperature and low-pressure refrigerant that is below freezing flows inside the pipe for the heat source side heat exchanger 12. Hence, frost may build up around the heat source side heat exchanger 12. If there is frost building up on the heat source side heat exchanger 12, a frost layer provides thermal resistance, and thus the flow path through which the ambient air around the heat source side heat exchanger 12 flows becomes narrow, thereby making it difficult for air to flow through the flow path. As a result, inhibition of heat exchange between the refrigerant and air occurs, and reduces the heating capacity and operation efficiency of the unit. The air-conditioning apparatus 100 is capable of executing a defrosting operation for defrosting the surrounding area of the heat source side heat exchanger 12 in response to an increase in the amount of frost building up on the heat source side heat exchanger 12.

In the defrosting operation mode illustrated in FIG. 12, in the outdoor unit 1, the first refrigerant flow switching device 11 is switched so as to cause a heat source side refrigerant discharged from the compressor 10 to flow into the heat source side heat exchanger 12. In the heat medium relay unit 3, the pump 21*a* and the pump 21*b* are driven to open the heat medium flow control device 25*a* and the heat medium flow control device 25*b* and to set the heat medium flow control device 25*c* and the heat medium flow control device 25*d* to a fully closed state, thereby allowing a heat medium to circulate between each of the intermediate heat exchanger 15*a* and the intermediate heat exchanger 15*b* and the use side heat exchanger 26*a* and between each of the intermediate heat exchanger 15*a* and the intermediate heat exchanger 15*b* and the use side heat exchanger 26*b*. However, the expansion device 16*a* and the expansion device 16*b* are controlled to be in a fully closed state (or to have a small opening degree so as not to cause a refrigerant to flow), the opening/closing device 17*a* to an opened state, and the opening/closing device 17*b* to an opened state, thereby preventing the heat source side refrigerant from flowing into the intermediate heat exchanger 15*a* and the intermediate heat exchanger 15*b*.

A low-temperature and low-pressure refrigerant is compressed by the compressor 10, and is discharged as a high-temperature and high-pressure gaseous refrigerant. The high-temperature and high-pressure gaseous refrigerant discharged from the compressor 10 flows into the heat source side heat exchanger 12 via the first refrigerant flow switching device 11. The gaseous refrigerant transfers heat to the outdoor air in the heat source side heat exchanger 12 to melt the frost on the heat source side heat exchanger 12. The refrigerant that has flowed out of the heat source side heat exchanger 12 passes through the check valve 13*a*, and is separated by the gas-liquid separator 27*a*.

Part of the refrigerant separated by the gas-liquid separator 27*a* flows out of the outdoor unit 1, and flows into the heat medium relay unit 3 through the refrigerant pipe 4. The refrigerant that has flowed into the heat medium relay unit 3 flows out of the heat medium relay unit 3 via the opening/closing device 17*a* and the opening/closing device 17*b*, and again flows into the outdoor unit 1 through the refrigerant pipe 4. The refrigerant that has flowed into the outdoor unit 1 passes through the check valve 13*d* via the gas-liquid separator 27*b*, and is again sucked into the compressor 10 via the first refrigerant flow switching device 11 and the accumulator 19.

The other part of the refrigerant separated by the gas-liquid separator 27*a* flows into the branch pipe 4*d*, and flows into the injection pipe 4*c* via the opening/closing device 24, which is controlled to be in an opened state. The refrigerant that has flowed into the injection pipe 4*c* is injected into the compression chamber of the compressor 10 via the refrigerant-refrigerant heat exchanger 28 and the expansion device 14*b*. This refrigerant joins the refrigerant sucked into the compressor 10 through the accumulator 19 (part of the refrigerant split by the gas-liquid separator 27*a*) in the compressor 10.

In FIG. 12, the pump 21*b* is activated to cause the heat medium to circulate in a use side heat exchanger 26 in which a heating requesting occurs (In FIG. 12, the use side heat exchanger 26*a* and the use side heat exchanger 26*b*). With this operation, the heating energy accumulated in the heat medium allows the heating operation to continue during the defrosting operation. In defrosting after the heating only operation, the pump 21*a* may also be activated. Alternatively, both the pump 21*a* and the pump 21*b* may be stopped to terminate the heating operation during the defrosting operation.

As described above, in the defrosting operation, while melting the frost on and around the heat source side heat exchanger 12, the flow of a refrigerant is split at the gas-liquid separator 27*a* and part of the refrigerant is injected into the compression chamber of the compressor 10. With this operation, the residual heat of the compressor 10 can be easily transmitted directly to the refrigerant, and an efficient defrosting operation can be performed. In addition, the flow rate of the refrigerant that is to circulate in the heat medium relay unit 3, which is away from the outdoor unit 1, can be reduced by an amount of injection. The power of the compressor 10 can be reduced.

While Embodiment 1 has been described in the context of the air-conditioning apparatus 100 including the accumulator 19 by way of example, the air-conditioning apparatus 100 may not necessarily be provided with the accumulator 19. Furthermore, while each of the heat source side heat exchanger 12 and the use side heat exchangers 26*a* to 26*d* generally has a fan, and blowing of air may help condensation or evaporation, this is a non-limiting example. For example, a panel heater that utilizes radiation or a similar device may be used as each of the use side heat exchangers 26*a* to 26*d*, and a water-cooled device that causes migration of heat by using water or an antifreeze may be used as the heat source side heat exchanger 12. Any type of device having a structure which allows transfer or removal of heat may be used.

In Embodiment 1, a description has been made of a case where four use side heat exchangers 26*a* to 26*d* are used, by way of example; however, any number of use side heat exchangers may be connected. Further, a description has been made of a case where two intermediate heat exchangers 15*a* and 15*b* are used, by way of example; however, as a matter of course, this is a non-limiting example. Any number of intermediate heat exchangers configured to be capable of cooling or/and heating a heat medium may be installed. In addition, the numbers of pumps 21*a* and the number of pumps 21*b* are not each limited to one, and a plurality of small-capacity pumps may be connected in parallel.

A standard gas-liquid separator has a function to separate a two-phase refrigerant into a gaseous refrigerant and a liquid refrigerant. Compared to this, as described above, gas-liquid separators 27 used in the air-conditioning apparatus 100 have a function to separate part of a liquid refrigerant from a two-phase refrigerant when a refrigerant in a two-phase state flows into the inlet of the gas-liquid separators 27 (the gas-liquid separators 27*a* and the gas-liquid separators 27*b*). The liquid refrigerant flows through the branch pipe 4*d* and the remaining portion of the two-phase refrigerant (the two-phase refrigerant with slightly increased quality) flows out of the gas-liquid separators 27.

In the air-conditioning apparatus 100, by way of example, as illustrated in FIG. 2 and like, each of the gas-liquid separators 27 has a structure that is elongated in the lateral direction (in a direction parallel to the refrigerant pipes 4). That is, it is desirable that the air-conditioning apparatus 100 include a transverse gas-liquid separator having a structure in which an inlet pipe and an outlet pipe are laterally connected to the gas-liquid separator 27 (connected in parallel to the refrigerant pipe 4) and the liquid refrigerant exit pipe (the branch pipe 4*d*) is connected to the bottom or top of the gas-liquid separator 27 (connected perpendicularly to the refrigerant pipe 4). However, each of the gas-liquid separators 27 may be of any type capable of separating part of a liquid refrigerant from a two-phase refrigerant that has flowed thereinto and allowing the remaining portion of the two-phase refrigerant to flow out thereof.

In Embodiment 1, furthermore, the system configuration of the air-conditioning apparatus 100 is also applicable to, for example, a direct expansion system in which: the compressor 10, the first refrigerant flow switching device 11, the heat source side heat exchanger 12, the expansion device 14*a*, the expansion device 14*b*, the opening/closing devices 17 (the opening/closing device 17*a* and the opening/closing device 17*b*), and the backflow prevention device 20 are accommodated in the outdoor unit 1; the use side heat exchangers 26 and the expansion devices 16 are accommodated in the indoor units 2; a relay device separately formed from the outdoor unit 1 and the indoor units 2 is provided; the outdoor unit 1 and the relay device are connected using a pair of two pipes; each of the indoor units 2 and the relay device are connected using a pair of two pipes: and a refrigerant is caused to circulate between the outdoor unit 1 and the indoor units 2 via the relay device so that the cooling only operation, the heating only operation, the cooling main operation, and the heating main operation can be performed. Similar advantages are achieved.

[Injection Control]

Figure 14:
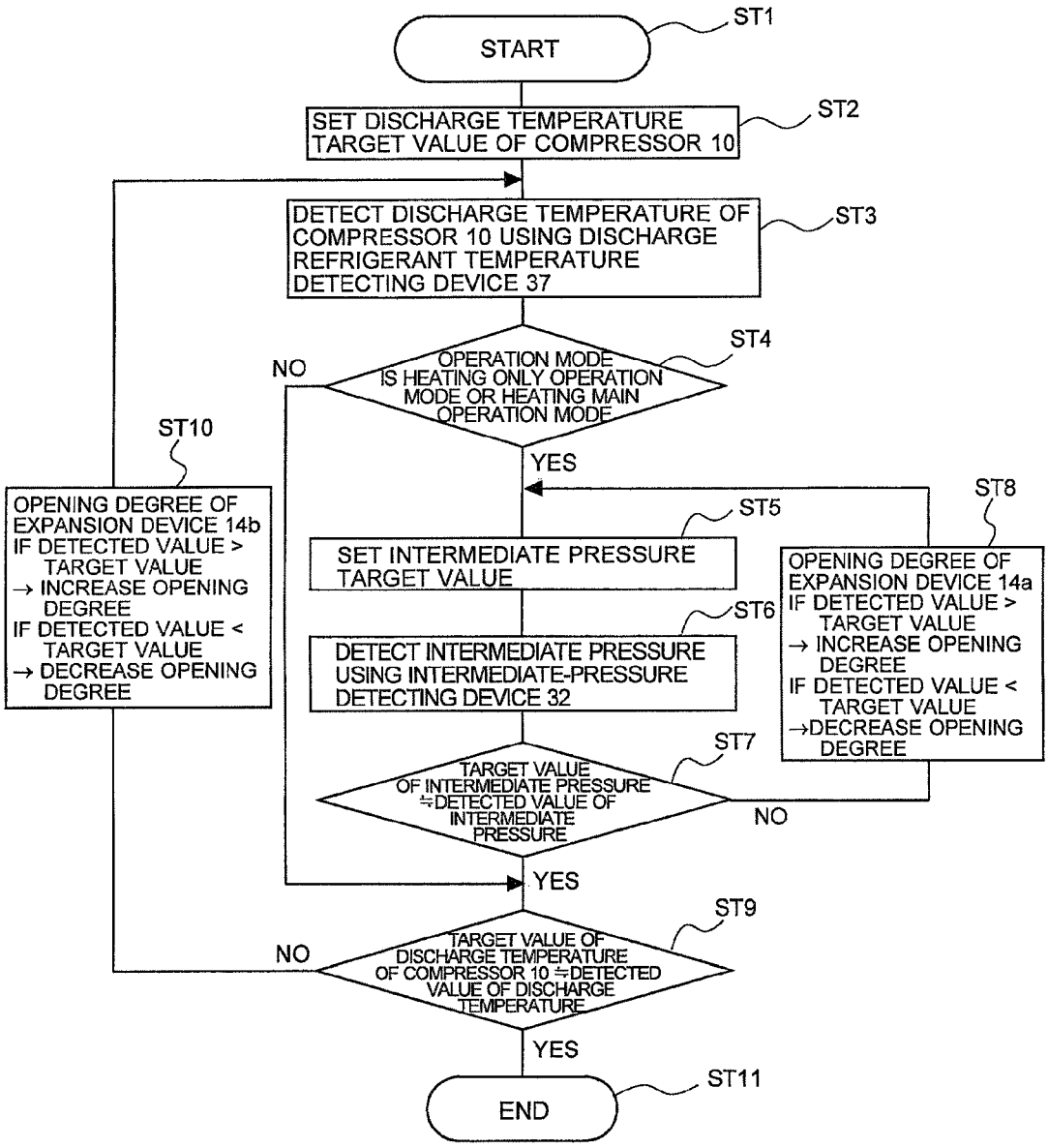
FIG. 14 is a flowchart illustrating the processing flow for injection which is executed by the air-conditioning apparatus according to Embodiment 1 of the present invention.

A specific control method for the air-conditioning apparatus 100 according to Embodiment 1 during injection will be described. FIG. 14 is a flowchart illustrating the processing flow during injection, which is executed by the air-conditioning apparatus 100. The flow for a control process during injection for reducing the discharge temperature of the compressor 10, which is executed by the air-conditioning apparatus 100, will be described with reference to FIG. 14. The illustrated control process for the air-conditioning apparatus 100 is performed by the controller 50 described above.

When the outdoor unit 1 is activated and the process starts (ST1), first, the controller 50 sets a discharge temperature target value that is a discharge temperature control target value of the compressor 10 (ST2). The discharge temperature target value differs depending on the operation mode. For example, in a cooling operation mode, the operation efficiency is high for a high flow rate of a refrigerant flowing through the intermediate heat exchanger 15. Hence, the target value of the discharge temperature is set high, for example, 100° C. or the like, in order to reduce the injection flow rate. In a heating operation mode, the pressure drop in the heat source side heat exchanger 12 is small for a high injection flow rate. Hence, the target value of the discharge temperature is set low, for example, 80° C. or the like, in order to increase the injection flow rate.

Then, the controller 50 detects the discharge temperature of the compressor 10 using the information supplied from the discharge refrigerant temperature detecting device 37 (ST3). Then, the controller 50 determines whether or not the current operation mode is the heating only operation mode or the heating main operation mode (ST4). If the current operation mode is the heating only operation mode or the heating main operation mode (ST4, YES), the controller 50 needs an intermediate pressure in order to inject the refrigerant throttled by the expansion device 16*a* or the expansion device 16*b*. Accordingly, the controller 50 sets an intermediate target pressure value that is the control target of the intermediate pressure (ST5).

The intermediate target pressure value differs depending on the heating only operation mode or the heating main operation mode. For example, in the heating only operation mode, desirably, the intermediate pressure is increased to increase the injection flow rate, and the pressure difference between the intermediate pressure and the pressure at an injection unit (the refrigerant that has flowed out of the secondary side of the refrigerant-refrigerant heat exchanger 28 in the injection pipe 4*c*) is increased. For example, the intermediate pressure is set to 1.89 MPa or the like. In the heating main operation mode, in contrast, it is not possible to increase the evaporating temperature because of the presence of an indoor unit that is in cooling operation. That is, it is not possible to increase the intermediate pressure, and the intermediate pressure is in a range from, for example, 0.81 MPa to 1.11 MPa, which are saturation pressures in a range from 0° C. to 10° C. An estimate of the values described above was made assuming that R32 is used as a refrigerant (in the following, an estimate is also made assuming that R32 is used as a refrigerant).

Then, the controller 50 detects an intermediate pressure using the information supplied from the intermediate-pressure detecting device 32 (ST6). The controller 50 compares the detected value of the intermediate pressure with a preset target value (ST7). If the detected value of the intermediate pressure and the target value do not match (ST7; NO) and if the detected value of the intermediate pressure is higher than the target value, the controller 50 increases the opening degree of the expansion device 14*a* (the upper case in ST8). If the detected value of the intermediate pressure and the target value do not match (ST7; NO) and the detected value of the intermediate pressure is lower than the target value, the controller 50 decreases the opening degree of the expansion device 14*a* (the lower case in ST8). Thereafter, if the difference between the detected value of the intermediate pressure and the target value is smaller than a preset value, for example, 0.10 MPa, the controller 50 returns to the setting of the intermediate target pressure value (ST5).

If the detected value of the intermediate pressure and the target value substantially match (ST7; YES), the controller 50 compares the detected value of the discharge temperature of the compressor 10 with the target value set in ST2 (ST9). If the detected value of the discharge temperature of the compressor 10 and the target value do not match (ST9; NO) and if the detected value of the discharge temperature of the compressor 10 is higher than the target value, the controller 50 increases the opening degree of the expansion device 14*b* (the upper case in ST10). If the detected value of the discharge temperature of the compressor 10 and the target value do not match (ST9; NO) and if the detected value of the discharge temperature of the compressor 10 is lower than the target value, the controller 50 decreases the opening degree of the expansion device 14*b* (the lower case in ST10).

Thereafter, if the difference between the detected value of the discharge temperature of the compressor 10 and the target value is smaller than a preset temperature difference, for example, 0.5° C., that is, if the detected value of the intermediate pressure and the target value substantially match (ST9; YES), the controller 50 terminates the control of the discharge temperature, and completes the process (ST11).

The description has been given of the control of the expansion device 14*b* so that the detected value of the discharge temperature of the compressor 10 is substantially equal to the target value, by way of example. This is a non-limiting example, and any other control method may be used.

For example, there may be a range of target values of the discharge temperature of the compressor 10. If the detected value of the discharge temperature of the compressor 10 is larger than the upper limit (for example, 100° C.) of the target range, the opening degree of the expansion device 14*b* may be increased, whereas, if the detected value of the discharge temperature of the compressor 10 is smaller than the lower limit (for example, 80° C.) of the target range, the opening degree of the expansion device 14*b* may be reduced. Alternatively, if the detected value of the discharge degree of superheat calculated from the discharge temperature and the discharge pressure of the compressor 10 is larger than a target value, the opening degree of the expansion device 14*b* may be increased, whereas, if the detected value of the discharge degree of superheat is smaller than the target value, the opening degree of the expansion device 14*b* may be reduced. In addition, there may be a range of target values of the discharge degree of superheat of the compressor 10. If the detected value of the discharge degree of superheat of the compressor 10 is larger than the upper limit of the target range, the opening degree of the expansion device 14*b* may be increased, whereas, if the detected value of the discharge degree of superheat of the compressor 10 is smaller than the lower limit of the target range, the opening degree of the expansion device 14*b* may be reduced.

The control flow described above can ensure the front-rear pressure differential of the expansion device 14*b* all the time, and can ensure a stable liquid injection flow rate. The reliability of the air-conditioning apparatus 100 can be improved.

[Injection Flow Rate]

First, the injection flow rate will be described with reference to FIG. 5. When the discharge temperature of the compressor 10 is decreased by 20° C. through injection, if $Gr_{inj}$ (kg/h) denotes the injection flow rate, Gr (kg/h) denotes the refrigerant mass flow rate in the compressor suction unit, $h_{inj}$ (kJ/kg) denotes the enthalpy of a refrigerant during injection (point K in FIG. 5), $h_d$ (kJ/kg) denotes the discharge enthalpy of the compressor 10 without performing injection (point G in FIG. 5), and $h_d'$ (kJ/kg) denotes the discharge enthalpy when injection is performed and the discharge temperature is decreased by 20° C. (point I in FIG. 5), the conservation of energy equation given in Equation (1) is established.

[Math. 1]

$$Gr_{inj}h_{inj}Grh_d=(Gr+Gr_{inj})h'_d \quad \text{Equation (1)}$$

Modifying Equation (1) yields Equation (2).

[Math. 2]

$$Gr_{inf} = \frac{h_d - h'_d}{h'_d - h_{inf}} Gr \quad \text{Equation (2)}$$

As can be seen from Equation (2), the calculation of the injection flow rate $Gr_{inj}$ (kg/h) requires the refrigerant flow Gr (kg/h) in the compressor suction unit, the discharge enthalpies $h_d$ (kJ/kg) and $h_d'$ (kJ/kg) of the compressor 10, and the enthalpy $h_{inj}$ (kJ/kg) of a refrigerant during injection.

Then, the discharge enthalpies $h_d$ and $h_d'$ of the compressor 10 and the enthalpy $h_{inj}$ (kJ/kg) of a refrigerant during injection are determined. Note that REFPROP, Version 8.0, released by NIST, was used for the calculation of the values of the physical properties in Embodiment 1.

Since information such as temperatures and pressures is required for the calculation of the discharge enthalpy of the compressor 10, the discharge temperature $T_d$ (° C.) of a compressor was calculated using Equation (3) for polytropic compression, which is generally well known. Polytropic compression is similar to adiabatic compression, in which the entry and exit of heat in the compression process are taken into account. In Equation (3), polytropic index n is determined by, as given in Equation (4), multiplying the specific heat ratio κ (–), which is obtained at an evaporating temperature of 0° C. and a superheat (degree of superheat) of 2° C., by a variation from the theoretical, namely, 0.9. The specific heat ratio κ is the ratio of the specific heat at constant pressure cp (kJ/kg·K) to the specific heat at constant volume $c_v$, (kJ/kg·K). In Equation (3), furthermore, $T_s$ (° C.) denotes the suction temperature of the compressor 10 (point M in FIG. 5), $P_d$ (MPa) denotes the discharge pressure of the compressor 10 (point G in FIG. 5), and $P_s$ (MPa) denotes the suction pressure of the compressor 10 (point M in FIG. 5).

[Math. 3]

$$Td = (Ts + 273.15)\left(\frac{Pd}{Ps}\right)^{\frac{n-1}{n}} - 273.15 \quad \text{Equation (3)}$$

[Math. 4]

$$n = 0.9\kappa = 0.9 \times \frac{c_p}{c_v} \quad \text{Equation (4)}$$

As given in Equation (5), the refrigerant mass flow rate Gr in the compressor suction unit was calculated by, for example, dividing a rated capacity W (kW) at 10 horsepower by the enthalpy difference Δh of a condensation unit or an evaporation unit. Here, the rated capacity W(kW) at 10 horsepower is 31.5 (kW) for the heating only operation mode and the heating main operation mode, and is 28.0 (kW) for the cooling only operation mode and the cooling main operation mode. Further, in the case of the heating only operation mode and the heating main operation mode, the enthalpy difference Δh (kJ/kg) is an enthalpy difference between the enthalpy at point I in FIG. 5 and the enthalpy at point J in FIG. 5. In the case of the cooling only operation mode and the cooling main operation mode, the enthalpy difference Δh is an enthalpy difference between the enthalpy at point M in FIG. 5 and the enthalpy at point L in FIG. 5.

[Math. 5]

$$Gr = \frac{W}{\Delta h} \times 3600 \quad \text{Equation (5)}$$

Since the frequency f (Hz) of the compressor 10 has an upper limit value, it is probable that the refrigerant mass flow rate Gr in the compressor suction unit calculated using Equation (5) is not realized. To address this, the frequency f of the compressor 10 which is necessary to realize the refrigerant mass flow rate Gr in the compressor suction unit calculated using Equation (5) was calculated using Equation (6). In Equation (6), Gr denotes the refrigerant mass flow rate in the compressor suction unit, $V_{st}$ (cc) denotes the stroke volume of the compressor 10, $\rho_s$ (kg/m$^3$) denotes the suction density of the compressor 10 (FIG. 5, point M), and $\eta_v$ (–) denotes the volumetric efficiency of the compressor 10. In addition, it was assumed that the stroke volume $V_{st}$ (cc) of the compressor 10 was 52 (cc), for example, and the volumetric efficiency $\eta_v$ (–) of the compressor 10 was 0.9, for example.

[Math. 6]

$$f = \frac{10^6 \times Gr}{3600 \times V_{st} \times \rho_s \times \eta_v} \quad \text{Equation (6)}$$

If the frequency f of the compressor 10 calculated using Equation (6) is higher than the upper limit value, for example, 120 Hz, the re-calculation of the refrigerant mass flow rate Gr in the compressor suction unit is needed. Equation (7), which is a modification of Equation (6), is used for the re-calculation, and the calculation result obtained by substituting the upper limit value, that is, 120 Hz, into the frequency f of the compressor 10 is used as the refrigerant mass flow rate Gr in the compressor suction unit.

[Math. 7]

$$Gr = V_{st} \times 10^{-6} \times f \times 3600 \times \rho_s \times \eta_v \quad \text{Equation (7)}$$

[Opening Degree of Expansion Device 14*a* and Expansion Device 14*b*]

Next, a method for determining the opening degree of the expansion device 14*b* will be described. A Cv value (denoted by Cv), which is a general representation of the capacity of the expansion device 14*b*, is used as the index indicating the opening degree of the expansion device 14*b*. The Cv value of the expansion device 14*b* which is necessary for the passage of the injection flow rate $Gr_{inj}$, which is calculated using Equation (2), is calculated using Equation (8) for the case of a liquid being used as a refrigerant that is to flow into the expansion device 14*b*, or using Equation (9) for the case of a gas. The source of Equation (8) and Equation (9) is as follows:

Valve Course Compilation Committee (1998) *Shoho to Jitsuyo no Barubu Kouza* (*Valve Fundamentals and Applications Course*), Revised Edition (Fourth Edition, Jun. 30, 1998), Sakutaro Kobayashi, Japan Industrial Publishing Co., Ltd.

[Math. 8]

$$Cv = 1.17Q\sqrt{\frac{\gamma}{P_1 - P_2}} \quad \text{Equation (8)}$$

In Equation (8), Q(m$^3$/h) denotes the refrigerant flow rate, γ(–) denotes the specific gravity, $P_1$ (kgf/cm$^2$abs) denotes the expansion device inlet-side pressure (point J' in FIG. 5), and $P_2$ (kgf/cm$^2$abs) denotes the expansion device outlet-side pressure (point K' in FIG. 5).

[Math. 9]

$$Cv = \frac{Q}{287}\sqrt{\frac{\gamma(273 + T_f)}{\Delta P(P_1 - P_2)}} \quad \text{Equation (9)}$$

In Equation (9), Q (m$^3$/h) denotes the maximum refrigerant flow rate at 15.6° C., γ(–) denotes the specific gravity, $P_1$ (kgf/cm$^2$abs) denotes the expansion device inlet-side pressure (point J' in FIG. 5), $P_2$ (kgf/cm$^2$abs) denotes the expansion device outlet-side pressure (point K in FIG. 5), ΔP denotes the difference between the expansion device inlet-side pressure $P_1$ (kgf/cm$^2$abs) and the expansion device outlet-side pressure $P_2$ (kgf/cm$^2$abs), and $T_f$ (° C.) denotes the refrigerant temperature that is set constant at 15.6° C.

By changing, in Equation (8) and Equation (9), the unit of pressure from kgf/cm$^2$ to MPa and changing the signs of the expansion device inlet-side pressure (point J' in FIG. 5) and the expansion device outlet-side pressure (point K' in FIG. 5) to $P_{in}$ (MPa) and $P_{out}$ (MPa), respectively, Equation (10) and Equation (11) are obtained. Equation (10) and Equation (11) were used for the calculation of Cv values.

[Math. 10]

$$Cv = 1.17Q\sqrt{\frac{\gamma}{(P_{in} - P_{out}) \times 100/9.8}} \quad \text{Equation (10)}$$

[Math. 11]

$$Cv = \frac{Q}{287}\sqrt{\frac{\gamma(273 + T_f)}{\Delta P(P_{in} - P_{out}) \times (100/9.8)^2}} \quad \text{Equation (11)}$$

The outlet-side pressure $P_{out}$ of the expansion device 14*b* was determined by adding the pressure drop $\Delta P_{inj}$ (MPa), which is caused by injection, to the pressure (point F in FIG. 5) $P_{inj}$ of the injection unit of the compressor 10. The pressure (point F in FIG. 5) $P_{inj}$ of the injection unit of the compressor 10 was calculated using Equation (12) assuming the rotation angle θ of the compression chamber in which the injection unit is opened was, for example, 5 degrees. As a matter of course, the value of the opening angle of the injection differs depending on the actual structure of the compressor.

[Math. 12]

$$P_{inf} = (P_d - P_s) \times \frac{\theta}{360^\circ} \quad \text{Equation (12)}$$

In Equation (12), $P_d$ (MPa) denotes the discharge pressure of the compressor 10, and $P_s$ (MPa) denotes the suction pressure of the compressor 10. Due to a sudden fluid expansion and reduction, there may be a pressure drop $\Delta P_{inj}$ at the injection port (opening) of the compressor 10. $\Delta P_{inj}$ is the difference between the outlet-side pressure $P_{out}$ of the expansion device 14*b* and the pressure (point F in FIG. 5) $P_{inj}$ of the inside of the compression chamber of the compressor 10. For example, a pressure drop corresponding to a saturation temperature of 5° C. is assumed to exist.

The opening degree (Cv value) of the expansion device 14*b* when a refrigerant in a two-phase state flows into the expansion device 14*b* was calculated by using a two-phase density for the calculation of the specific gravity γ (–) in Equation (10) in the case of a liquid flowing into the expansion device 14*b*, that is, according to Equation (13). In Equation (13), $\rho_{TP}$ (kg/m$^3$) denotes the two-phase refrigerant density.

[Math. 13]

$$Cv = 1.17Q\sqrt{\frac{\rho_{TP}/\rho_W}{(P_{in} - P_{out}) \times 100/9.8}} \quad \text{Equation (13)}$$

In Equation (13), the two-phase refrigerant density $\rho_{TP}$ (kg/m$^3$) was determined using Equation (14). In Equation (14), $\rho_G$, (kg/m$^3$) denotes the saturated gaseous refrigerant density, $\rho_L$ (kg/m$^3$) denotes the saturated liquid refrigerant density, and α (–) denotes the void fraction.

[Math. 14]

$$\rho_{TP} = \rho_G\alpha + \rho_L(1\alpha) \quad \text{Equation (14)}$$

In Equation (14), the void fraction α was determined using Equation (15). The source of Equation (15) is Smith's equation, which is found in the following literature:

The Japan Society of Mechanical Engineers (1995), *Handbook of gas-liquid two-phase flow technology* (Published on Jul. 10, 1995, Second Printing of the First Edition, CORONA PUBLISHING CO., LTD.).

In Equation (15), $\rho_G$ (kg/m$^3$) denotes the saturated gaseous refrigerant density, $\rho_L$·(kg/m$^3$) denotes the saturated liquid refrigerant density, x (–) denotes the quality, and e (–) denotes the ratio of liquid flow rate in the homogeneous mixture phase to the overall liquid flow rate. The value 0.4 was used as e (–) because it was recommended.

[Math. 15]

$$\alpha = \left[1 + \frac{\rho_G}{\rho_L}e\left(\frac{1}{x} - 1\right) + \frac{\rho_G}{\rho_L}(1 - e)\left(\frac{1}{x} - 1\right)\right]^{-1} \left\{\frac{\rho_L/\rho_G + e(1/x - 1)}{1 + e(1/x - 1)}\right\}^{1/2} \quad \text{Equation (15)}$$

In Embodiment 1, an electronic expansion valve in which the opening area (Cv value) of an expansion section is changeable as desired was used as the expansion device 14*b*. Since an electronic expansion valve is configured such that the opening area (Cv value) of an expansion section is changed by moving up and down the valve body using a stepping motor, the relationship between the number of pulses of the stepping motor and the Cv value can be linearly approximated. In the case of an electronic expansion valve having a maximum Cv value of 0.95, a maximum number of pulses of 3000, and a minimum number of pulses of 60, the relationship between the Cv value and pulses is expressed by Equation (16). In Equation (16), pulse denotes the number of pulses, Cv denotes the Cv value, $\text{pulse}_{max}$ denotes the maximum number of pulses, and $\text{pulse}_{min}$ denotes the minimum number of pulses.

[Math. 16]

$$\text{pulse} = \frac{Cv}{Cv_{max}/(\text{pulse}_{max} - \text{pulse}_{min})} + \text{pulse}_{min} \quad \text{Equation (16)}$$

Accordingly, the injection flow rate $Gr_{inj}$ required to reduce the discharge temperature of the compressor 10 by 20° C., and the opening degree of the expansion device 14*b* can be determined.

Next, the steady-state opening degree of the expansion device 14*b* for controlling the injection flow rate in the cooling only operation mode will be described. FIG. 15 is an explanatory diagram for explaining the steady-state opening degrees of the expansion device 14*b* for controlling the injection flow rate in the cooling only operation mode. In FIG. 15, the results of an estimate of the refrigerant mass flow rate Gr, the injection flow rate $Gr_{inj}$, and the Cv value, the number of pulses, and the amount of change in the number of pulses of the expansion device 14*b* when the condensing temperature changes in the cooling only operation mode are presented in a table. The details of the estimate will be described hereinafter.

The refrigeration cycle is in balance at a condensing temperature of 49° C., an evaporating temperature of 0° C., a superheat (degree of superheat) of 2° C., and a subcool (degree of subcooling) of 5° C. In this case, the discharge temperature of the compressor 10 is 104° C. The injection flow rate for reducing the discharge temperature of the compressor 10 by 20° C. is determined.

The rated capacity W at 10 horsepower is 28.0 (kW), and the enthalpy difference Δh of the evaporation unit is 234.1 (kJ/kg). From Equation (5), the refrigerant mass flow rate Gr in the compressor suction unit is 430.6 (kg/h). Further, the refrigerant mass flow rate Gr in the compressor suction unit is 430.6 (kg/h), the enthalpy (point K in FIG. 5) $h_{inj}$ of the refrigerant during injection is 283.7 (kJ/kg), the discharge point enthalpy (point G in FIG. 5) $h_d$ of the compressor 10 without performing injection is 593.9 (kJ/kg), and the discharge point enthalpy (point I in FIG. 5) $h_d'$ when injection is performed and the discharge temperature is decreased by 20° C. is 567.5 (kJ/kg). From Equation (2), the injection flow rate $Gr_{inj}$ is 40.0 (kg/h).

Then, the steady-state opening degree of the expansion device 14*b* is determined. By substituting the discharge pressure, that is, 3.07 (MPa), of the compressor 10 at a condensing temperature of 49° C. and the suction pressure, that is, 0.81 (MPa), of the compressor 10 at an evaporating temperature of 0° C., the pressure (point F in FIG. 5) $P_{inj}$ of the injection unit of the compressor 10 equals 0.84 (MPa), from Equation (12). The outlet-side pressure $P_{out}$ of the expansion device 14*b* obtained by adding together this pressure and the pressure corresponding to a saturation temperature of +5° C. is 0.99 (MPa). The maximum refrigerant flow rate Q is a value obtained by multiplying the injection flow rate $Gr_{inj}$, that is, 40.0 (kg/h), by the inlet refrigerant density of the expansion device 14*b*, that is, 877.2 (kg/m$^3$). The specific gravity G is a value obtained by dividing the inlet refrigerant density of the expansion device 14*b*, that is, 877.2 (kg/m), by the density of water (defined to be 1000 (kg/m$^3$)). The inlet-side pressure Pin of the expansion device 14*b* is 3.07 (MPa), and the outlet-side pressure $P_{out}$ of the expansion device 14*b* is 0.99 (MPa). From Equation (10), the Cv value is 0.011.

When the Cv value is 0.011, from Equation (16), the number of pulses of the electronic expansion valve is 93. Accordingly, the steady-state opening degree of the expansion device 14*b* is 93 pulses. That is, in the steady state, the refrigeration cycle is in balance when the opening degree of the expansion device 14*b* is 93 pulses. This value is used as an initial value for injection control, thereby making it possible to readily stabilize the refrigeration cycle in a case where injection is performed. In the following description, also in the other operation modes, the steady-state opening degree is used as an initial value for injection control.

Similarly, when the condensing temperature is 59° C., the evaporating temperature is 0° C., the superheat (degree of superheat) is 2° C., the subcool (degree of subcooling) is 5° C., and the discharge temperature of the compressor 10 is 125° C., the injection flow rate $Gr_{inj}$ for reducing the discharge temperature by 20° C. is 42.8 (kWh). The Cv value of the expansion device 14*b* is 0.010, and the number of pulses is 92.

Similarly, when the condensing temperature is 39° C., the evaporating temperature is 0° C., the superheat (degree of superheat) is 2° C., the subcool (degree of subcooling) is 5° C., and the discharge temperature of the compressor 10 is 83° C., the injection flow rate $Gr_{inj}$ for reducing the discharge temperature by 20° C. is 35.5 (kg/h). The Cv value of the expansion device 14*b* is 0.011, and the number of pulses is 95.

The steady-state opening degrees at condensing temperatures not illustrated in FIG. 15 can be determined by interpolation from the steady-state opening degrees of the expansion device 14*b* under the evaporating temperature conditions illustrated in FIG. 15. That is, the steady-state opening degree of the expansion device 14*b* can be determined using the interpolation method. In the following description, opening degrees under conditions not illustrated in the drawings are determined by interpolation in a manner similar to that described above.

Next, the steady-state opening degrees of the expansion device 14*b* for controlling the injection flow rate and the expansion device 14*a* for controlling the intermediate pressure in the heating only operation mode will be described. FIG. 16 is an explanatory diagram for explaining the steady-state opening degrees of the expansion device 14*b* for controlling the injection flow rate and the expansion device 14*a* for controlling the intermediate pressure in the heating only operation mode. In FIG. 16, the results of an estimate of the refrigerant mass flow rate Gr, the injection flow rate $Gr_{inj}$, the Cv value, the number of pulses, and the amount of change in the number of pulses of the expansion device 14*b*, and the Cv value and the number of pulses of the expansion device 14*a* when the intermediate pressure changes in the heating only operation mode are presented in a table. The details of the estimate will be described hereinafter.

The refrigeration cycle is in balance at a condensing temperature of 49° C., an evaporating temperature of 0° C., a superheat (degree of superheat) of 2° C., a subcool (degree of subcooling) of 5° C., and a saturation pressure having an intermediate pressure of 30° C. The discharge temperature of the compressor 10 is 104° C. The injection flow rate for reducing the discharge temperature of the compressor 10 by 20° C. is determined.

The rated capacity W at 10 horsepower is 31.5 (kW), and the enthalpy difference Δh of the condensation unit is 310.3 (kJ/kg). From Equation (5), the refrigerant mass flow rate Gr in the compressor suction unit is 365.5 (kg/h). Further, the refrigerant mass flow rate Gr in the compressor suction unit is 365.5 (kWh), the enthalpy (point K in FIG. 7) $h_{inj}$ of the refrigerant during injection is 255.3 (kJ/kg), the discharge point enthalpy (point G in FIG. 7) $h_d$ of the compressor 10 without performing injection is 593.9 (kJ/kg), and the discharge point enthalpy (point I in FIG. 7) $h_d'$ when injection is performed and the discharge temperature is decreased by 20° C. is 567.5 (kJ/kg). From Equation (2), the injection flow rate $Gr_{inj}$ (kg/h) is 30.9 (kg/h).

Then, the steady-state opening degree of the expansion device 14*b* is determined. By substituting the discharge pressure, that is, 3.07 (MPa), of the compressor 10 at a condensing temperature of 49° C. and the suction pressure, that is, 0.81 (MPa), of the compressor 10 at an evaporating temperature of 0° C., the pressure (point F in FIG. 7) $P_{inj}$ of the injection unit of the compressor 10 equals 0.84 (MPa), from Equation (12). The outlet-side pressure $P_{out}$ of the expansion device 14*b* obtained by adding together this pressure and the pressure corresponding to a saturation temperature of +5° C. is 0.99 (MPa). The maximum refrigerant flow rate is a value obtained by multiplying the injection flow rate $Gr_{inj}$, that is, 30.9 (kg/h), by the inlet refrigerant density of the expansion device 14*b*, that is, 940.1 (kg/m$^3$). The specific gravity G is a value obtained by dividing the inlet refrigerant density of the expansion device

14*b*, that is, 940.1 (kg/m$^3$), by the density of water (defined to be 1000 (kg/m$^3$)). The inlet-side pressure $P_{in}$ of the expansion device 14*b* is 1.93 (MPa), and the outlet-side pressure $P_{out}$ of the expansion device 14*b* is 0.99 (MPa). From Equation (10), the Cv value of the expansion device 14*b* is 0.012.

When the Cv value is 0.012, from Equation (16), the number of pulses of the electronic expansion valve is 97. Accordingly, the steady-state opening degree of the expansion device 14*b* is 97 pulses.

Further, the steady-state opening degree of the expansion device 14*a* for controlling the intermediate pressure is calculated using Equation (13) since a two-phase refrigerant flows into the expansion device 14*a*. The maximum refrigerant flow rate Q is a value obtained by multiplying the refrigerant mass flow rate Gr, that is, 365.5 (kWh), by the inlet refrigerant density of the expansion device 14*a*, that is, 452.6 (kg/m$^3$). The specific gravity G is a value obtained by dividing the inlet refrigerant density of the expansion device 14*a*, that is, 452.6 (kg/m$^3$), by the density of water (defined to be 1000 (kg/m$^3$)). The inlet-side pressure Pin of the expansion device 14*a* is 1.93 (MPa), and the outlet-side pressure $P_{out}$ of the expansion device 14*a* is 0.81 (MPa). From Equation (13), the Cv value of the expansion device 14*a* is 0.188.

When the Cv value is 0.188, from Equation (16), the number of pulses of the electronic expansion valve is 642. Accordingly, the steady-state opening degree of the expansion device 14*a* is 642 pulses. That is, in the steady state, the refrigeration cycle is in balance when the opening degree of the expansion device 14*b* is 97 pulses and the opening degree of the expansion device 14*a* is 642 pulses. This value is used as an initial value for injection control, thereby making it possible to readily stabilize the refrigeration cycle in a case where injection is performed. In the heating only operation mode, injection is performed from an intermediate pressure rather than a high pressure. Hence, the initial opening degrees for injection control in the heating only operation mode, and also the initial opening degrees in the cooling only operation mode, may be increased by a certain opening degree, for example, 0.018 for the Cv value.

Similarly, when the condensing temperature is 49° C., the evaporating temperature is 0° C., the superheat (degree of superheat) is 2° C., the subcool (degree of subcooling) is 5° C., the saturation pressure has an intermediate pressure of 20° C., and the discharge temperature of the compressor 10 is 104° C., the injection flow rate $Gr_{inj}$ for reducing the discharge temperature by 20° C. is 29.1 (kg/h). The Cv value of the expansion device 14*b* is 0.015, and the number of pulses is 108. The Cv value of the expansion device 14*a* is 0.286, and the number of pulses is 944.

Similarly, when the condensing temperature is 49° C., the evaporating temperature is 0° C., the superheat (degree of superheat) is 2'C, the subcool (degree of subcooling) is 5° C., the saturation pressure has an intermediate pressure of 10° C., and the discharge temperature of the compressor 10 is 104° C., the injection flow rate $Gr_{inj}$ for reducing the discharge temperature by 20° C. is 27.6 (kg/h). The Cv value of the expansion device 14*b* is 0.029, and the number of pulses is 149. The Cv value of the expansion device 14*a* is 0.495, and the number of pulses is 1591.

FIG. 17 is an explanatory diagram for explaining the steady-state opening degrees of the expansion device 14*b* for controlling the injection flow rate and the expansion device 14*a* for controlling the intermediate pressure when the evaporating temperature changes in the heating only operation mode. In FIG. 17, the results of an estimate of the refrigerant mass flow rate Gr, the injection flow rate $Gr_{inj}$, the Cv value, the number of pulses, and the amount of change in the number of pulses of the expansion device 14*b*, and the Cv value and the number of pulses of the expansion device 14*a* when the evaporating temperature changes in the heating only operation mode are presented in a table. The results of the estimate will be described hereinafter.

When the condensing temperature is 49° C., the evaporating temperature is −15° C., the superheat (degree of superheat) is 2° C., the subcool (degree of subcooling) is 5° C., the saturation pressure has an intermediate pressure of 30° C., and the discharge temperature of the compressor 10 is 130° C., the injection flow rate $Gr_{inj}$ for reducing the discharge temperature by 20° C. is 19.0 (kg/h). The Cv value of the expansion device 14*b* is 0.006, and the number of pulses is 79. The Cv value of the expansion device 14*a* is 0.121, and the number of pulses is 433.

Similarly, when the condensing temperature is 49° C., the evaporating temperature is −30° C., the superheat (degree of superheat) is 2° C., the subcool (degree of subcooling) is 5° C., the saturation pressure has an intermediate pressure of 30° C., and the discharge temperature of the compressor 10 is 163° C., the injection flow rate $Gr_{inj}$ for reducing the discharge temperature by 20° C. is 9.5 (kg/h). The Cv value of the expansion device 14*b* is 0.003, and the number of pulses is 69. The Cv value of the expansion device 14*a* is 0.064, and the number of pulses is 259.

Next, the steady-state opening degree of the expansion device 14*b* for controlling the injection flow rate in the cooling main operation mode will be described. FIG. 18 is an explanatory diagram for explaining the steady-state opening degree of the expansion device 14*b* for controlling the injection flow rate in the cooling main operation mode. In FIG. 18, the results of an estimate of the refrigerant mass flow rate Gr, the injection flow rate Grinj, and the Cv value, the number of pulses, and the amount of change in the number of pulses of the expansion device 14*b* in the cooling main operation mode are presented in a table. The method of the estimate is similar to that in the cooling only operation mode described above, and therefore will not be described. The following description will be directed to only the results of the estimate.

When the condensing temperature is 49° C., the evaporating temperature is 0° C., the superheat (degree of superheat) is 2° C., the subcool (degree of subcooling) is 5° C. the indoor heating load is intermediate (the flow into the gas-liquid separators 27*a* with a quality of 0.6), and the discharge temperature of the compressor 10 is 104° C., the injection flow rate $Gr_{inj}$ for reducing the discharge temperature by 20° C. is 41.7 (kg/h). The Cv value of the expansion device 14*b* is 0.011, and the number of pulses is 96. That is, in the steady state, the refrigeration cycle is in balance when the opening degree of the expansion device 14*b* is 96 pulses. This value is used as an initial value for injection control, thereby making it possible to readily stabilize the refrigeration cycle in a case where injection is performed.

Further, in the cooling main operation mode, injection is performed via the gas-liquid separator 27*a*. Hence, it is no longer necessary to change the opening degree of the expansion device 14*b* in accordance with a change in heating load. The control load can be reduced.

Next, the steady-state opening degree of the expansion device 14*b* for controlling the injection flow rate in the heating main operation mode will be described. FIG. 19 is an explanatory diagram for explaining the steady-state opening degree of the expansion device 14*b* for controlling the injection flow rate in the heating main operation mode. In FIG. 19, the results of an estimate of the injection flow rate $Gr_{inj}$, the Cv value, the number of pulses, and the amount of change in the number of pulses of the expansion device 14*b*, and the Cv value and the number of pulses of the expansion device 14*a* when the intermediate pressure changes in the heating main operation mode are presented in a table. The method for the estimate is similar to that in the heating only operation mode described above, and therefore will not be described. The following description will be directed to only the results of the estimate.

When the condensing temperature is 49° C., the evaporating temperature is 0° C., the superheat (degree of superheat) is 2° C., the subcool (degree of subcooling) is 5° C., the saturation pressure has an intermediate pressure of 7° C., the indoor cooling load is intermediate (the flow into the gas-liquid separators 27*b* with a quality of 0.6), and the discharge temperature of the compressor 10 is 104° C., the injection flow rate $Gr_{inj}$ for reducing the discharge temperature by 20° C. is 27.2 (kg/h). The Cv value of the expansion device 14*b* is 0.062, and the number of pulses is 252. The Cv value of the expansion device 14*a* is 0.950, and the number of pulses is 3000. That is, in the steady state, the refrigeration cycle is in balance when the opening degree of the expansion device 14*b* is 252 pulses and the opening degree of the expansion device 14*a* is 3000 pulses. This value is used as an initial value for injection control, thereby making it possible to readily stabilize the refrigeration cycle in a case where injection is performed.

Similarly, when the condensing temperature is 49° C., the evaporating temperature is 0° C., the superheat (degree of superheat) is 2° C., the subcool (degree of subcooling) is 5° C., the saturation pressure has an intermediate pressure of 12° C., the indoor cooling load is intermediate, and the discharge temperature of the compressor 10 is 104° C., the injection flow rate $Gr_{inj}$ for reducing the discharge temperature by 20° C. is 27.9 (kWh). The Cv value of the expansion device 14*b* is 0.023, and the number of pulses is 132. The Cv value of the expansion device 14*a* is 0.710, and the number of pulses is 2256.

Similarly, when the condensing temperature is 49° C., the evaporating temperature is 0° C., the superheat (degree of superheat) is 2° C., the subcool (degree of subcooling) is 5° C., the saturation pressure has an intermediate pressure of 17° C., the indoor cooling load is intermediate, and the discharge temperature of the compressor 10 is 104° C., the injection flow rate for reducing the discharge temperature by 20° C. is 28.6 (kg/h). The Cv value of the expansion device 14*b* is 0.017, and the number of pulses is 113. The Cv value of the expansion device 14*a* is 0.552, and the number of pulses is 1770.

FIG. 20 is an explanatory diagram for explaining the steady-state opening degrees of the expansion device 14*b* for controlling the injection flow rate when the evaporating temperature changes in the heating main operation mode. In FIG. 20, the results of an estimate of the injection flow rate $Gr_{inj}$ (kg/h), the CV value, the number of pulses, and the amount of change in the number of pulses of the expansion device 14*b*, and the Cv value and the number of pulses of the expansion device 14*a* when the evaporating temperature changes in the heating main operation mode are presented in a table. The results of the estimate will be described hereinafter.

When the condensing temperature is 49° C., the evaporating temperature is −10° C., the superheat (degree of superheat) is 2° C., the subcool (degree of subcooling) is 5° C., the saturation pressure has an intermediate pressure of 7° C., the indoor cooling load is intermediate (the flow into the gas-liquid separators 27*b* with a quality of 0.6), and the discharge temperature of the compressor 10 is 104° C., the injection flow rate $Gr_{inj}$ for reducing the discharge temperature by 20° C. is 21.1 (kg/h). The Cv value of the expansion device 14*b* is 0.014, and the number of pulses is 104. The Cv value of the expansion device 14*a* is 0.592, and the number of pulses is 1891.

[Control Method when Operation Mode Changes]

Next, the control of the intermediate pressure and the control of the opening degrees of the expansion device 14*a* and the expansion device 14*b* when the operation mode changes will be described with reference to the results (FIG. 15 to FIG. 20) of the calculation performed in the manner described above.

[Activation from Stopped State]

When the outdoor unit 1 is activated from the stopped state, the opening/closing device 24 is kept at a closed state and the opening degree of the expansion device 14*b* is set to a fully closed state for a certain period of time, for example, three minutes, after activation. The reason for this control is that the discharge temperature of the compressor 10 is not high for a while after activation and thus injection is not necessary. Alternatively, the expansion device 14*b* may be set to an opened state after a certain period of time has elapsed. The expansion device 14*b* may also be set to an opened state in a case where the discharge temperature of the compressor 10 or the discharge pressure of the compressor 10 exceeds a certain value.

[Heating Only Operation Mode to Heating Main Operation Mode]

In a case where the operation mode changes from the heating only operation mode to the heating main operation mode, control is performed so that the target value of the intermediate pressure is reduced and the opening degree of the expansion device 14*b* is increased. That is, the expansion device 14*b* is controlled so that the opening degree is increased in accordance with the range over which the target value of the intermediate pressure decreases.

In the heating only operation mode, the operation needs to be performed under a condition of an outside air temperature lower than that in the heating main operation mode. Accordingly, it is necessary to increase the target value of the intermediate pressure in order to increase the injection flow rate. In the heating main operation mode, it is necessary to reduce the intermediate pressure (control the intermediate pressure in the range of, for example, 0° C. to 10° C.) to ensure the cooling capacity. To this end, the target value of the intermediate pressure in the heating only operation mode needs to be higher than that of the intermediate pressure in the heating main operation mode.

A specific example of a change of the operation mode from the heating only operation mode to the heating main operation mode will be described with reference to the steady-state opening degrees described above. FIG. 21 is a diagram illustrating an example of control target values when the operation mode changes from the heating only operation mode to the heating main operation mode. In FIG. 21, the opening degree (Cv value), the number of pulses, and the amount of change in the number of pulses of the expansion device 14*a*, and the opening degree (Cv value), the number of pulses, and the amount of change in the number of pulses of the expansion device 14*b* when a mode change occurs between the heating only operation mode and the heating main operation mode are illustrated.

Here, consideration will be given of a case where the operation state changes from the heating only operation mode with a condensing temperature of 49 degrees C., an evaporating temperature of 0° C., a superheat (degree of superheat) of 2° C., a subcool (degree of subcooling) of 5° C., a saturation pressure having an intermediate pressure or 30° C. to the heating main operation mode with a condensing temperature of 49° C., an evaporating temperature of 0° C., a superheat of 2° C., a subcool of 5° C., a saturation pressure having an intermediate pressure of 7° C., and an intermediate indoor cooling load (the flow into the gas-liquid separators 27*b* with a quality of 0.6).

In this case, the opening degree and the number of pulses of the expansion device 14*a* are: the Cv value is 0.188 and the number of pulses is 642 for the heating only operation mode, and the Cv value is 0.950 and the number of pulses is 3000 for the heating main operation mode. Accordingly, in a case where the operation mode changes from the heating only operation mode to the heating main operation mode, the opening degree of the expansion device 14*b* is controlled so that the number of pulses is increased by 2360. Further, the opening degree and the number of pulses of the expansion device 14*b* are: the Cv value is 0.012 and the number of pulses is 97 for the heating only operation mode, and the Cv value is 0.062 and the number of pulses is 252 for the heating main operation mode. Accordingly, in a case where the operation mode changes from the heating only operation mode to the heating main operation mode, the opening degree of the expansion device 14*b* is controlled so that the number of pulses is increased by 160.

In this manner, in the air-conditioning apparatus 100, the steady-state opening degrees described above are used as the initial values for injection control when the operation mode changes, thereby making it possible to switch the operation mode while ensuring reliability.

[Heating Main Operation Mode to Heating Only Operation Mode]

In a case where the operation state changes from the heating main operation mode to the heating only operation mode, the target value of the intermediate pressure is increased. However, the opening degree of the expansion device 14*b* is maintained as it is, and is controlled in accordance with the discharge temperature after a certain period of time has elapsed.

[Heating Main Operation Mode to Cooling Main Operation Mode]

In a case where the operation mode changes from the heating main operation mode to the cooling main operation mode, control is performed in the following order: The opening degree of the expansion device 14*b* is changed to a certain opening degree, and then the first refrigerant flow switching device 11 is switched. If the switching of the first refrigerant flow switching device 11 is performed first, intermediate-pressure injection changes to high-pressure injection, causing the possibility that the amount of injection into the compressor 10 will be excessively large, the discharge temperature will be excessively low, or the amount of liquid refrigerant flowing into the compressor 10 will be excessively large.

A specific example of a change of the operation mode from the heating main operation mode to the cooling main operation mode will be described with reference to the steady-state opening degrees described above. FIG. 22 is a diagram illustrating an example of control target values when the operation mode changes from the heating main operation mode to the cooling main operation mode. In FIG. 22, the opening degree (Cv value), the number of pulses, and the amount of change in the number of pulses of the expansion device 14*a*, and the opening degree (Cv value), the number of pulses, and the amount of change in the number of pulses of the expansion device 14*b* when a mode change occurs between the heating main operation mode and the cooling main operation mode are illustrated.

Here, consideration will be given of a case where the operation state changes from the heating main operation mode with a condensing temperature of 49° C., an evaporating temperature of 0° C., a superheat (degree of superheat) of 2° C., a subcool (degree of subcooling) of 5° C., a saturation pressure having an intermediate pressure of 7° C., and an intermediate indoor cooling load (the flow into the gas-liquid separators 27*b* with a quality 0.6) to the cooling main operation mode with a condensing temperature of 49° C., an evaporating temperature of 0° C., a superheat of 2° C., a subcool of 5° C., and an intermediate indoor heating load (the flow into the gas-liquid separators 27*a* with a quality of 0.6).

In this case, the opening degree and the number of pulses of the expansion device 14*a* are: the Cv value is 0.950 and the number of pulses is 3000 for the heating main operation mode. Since no refrigerant flows in the cooling main operation mode, the opening degree may be set as desired. Accordingly, in a case where the operation mode changes from the heating main operation mode to the cooling main operation mode, control is performed so that the opening degree of the expansion device 14*b* is kept as it is. Further, the opening degree and the number of pulses of the expansion device 14*b* are: the Cv value is 0.062 and the number of pulses is 252 for the heating main operation mode, and the Cv value is 0.011 and the number of pulses is 96 for the cooling main operation mode. Accordingly, in a case where the operation mode changes from the heating main operation mode to the cooling main operation mode, the opening degree of the expansion device 14*b* is controlled so that the number of pulses is decreased by 160.

In this manner, in the air-conditioning apparatus 100, the steady-state opening degrees described above are used as the initial values for injection control when the operation mode changes, thereby making it possible to readily stabilize the refrigeration cycle when the operation mode changes.

[Cooling Main Operation Mode to Heating Main Operation Mode]

In a case where the operation mode changes from the cooling main operation mode to the heating main operation mode, control is performed in the following order: The first refrigerant flow switching device 11 is switched, and then the opening degree of the expansion device 14*b* is changed to a certain opening degree. If the opening degree of the expansion device 14*b* is changed first, the injection flow rate into the compressor 10 is excessively large, causing the possibility that the discharge temperature will be excessively low or the amount of liquid refrigerant flowing into the compressor 10 will be excessively large. In a case where the operation mode changes from the cooling main operation mode to the heating main operation mode, control may be performed so that the increase and decrease in the amount of change in the number of pulses in the case of a change of the operation mode from the heating main operation mode to the cooling main operation mode are reversed.

[Cooling Main Operation Mode to Cooling Only Operation Mode]

In a case where the operation mode changes from the cooling main operation mode to the cooling only operation mode, the opening degree of the expansion device 14*b* is controlled so as to decrease by a certain opening degree.

Figures 23, 24:
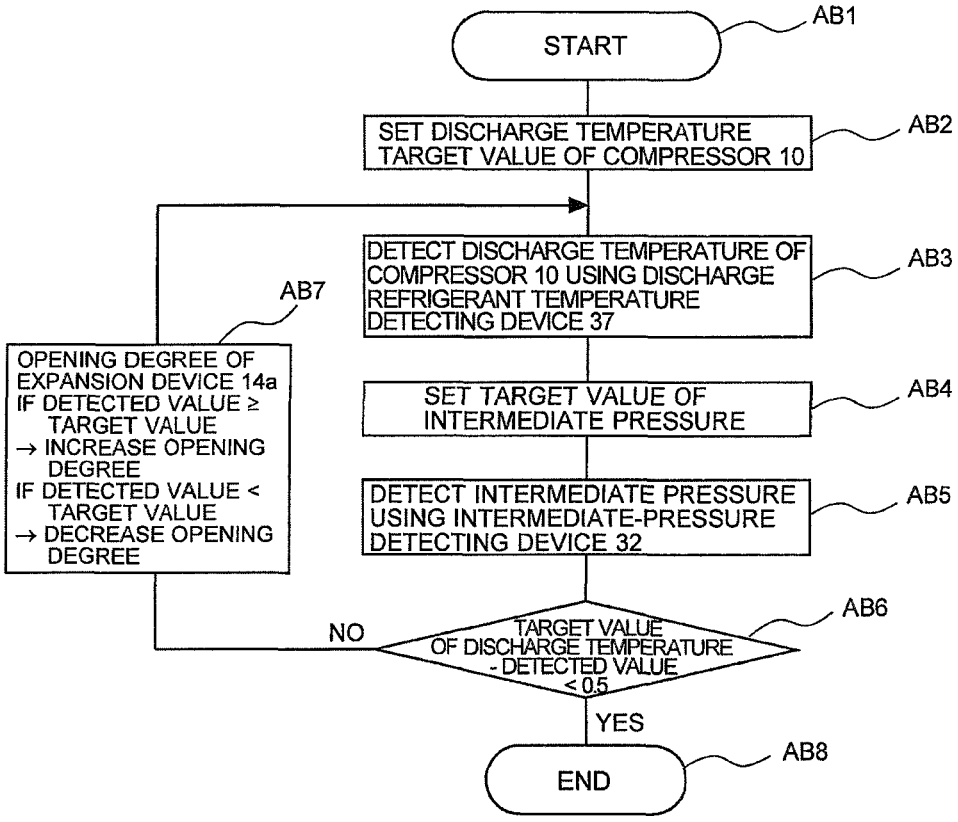
FIG. 23 is a diagram illustrating an example of control target values when the operation mode of the air-conditioning apparatus according to Embodiment 1 of the present invention changes from the cooling main operation mode to the cooling only operation mode.
FIG. 24 is a flowchart illustrating an example of the flow for a control process for controlling both the intermediate pressure and the discharge temperature of a compressor with a single expansion device in the air-conditioning apparatus according to Embodiment 1 of the present invention.

A specific example of a change of the operation mode from the cooling main operation mode to the cooling only operation mode will be described with reference to the steady-state opening degrees described above. FIG. 23 is a diagram illustrating an example of control target values when the operation mode changes from the cooling main operation mode to the cooling only operation mode. In FIG. 23, the opening degree (Cv value), the number of pulses, and the amount of change in the number of pulses of the expansion device 14*b* when a mode change occurs between the cooling main operation mode and the cooling only operation mode are illustrated.

Here, consideration will be given of a case where the operation state changes from the cooling main operation mode with a condensing temperature of 49° C., an evaporating temperature of 0° C., a superheat (degree of superheat) of 2° C., a subcool (degree of subcooling) of 5° C., and an intermediate indoor heating load (the flows into the gas-liquid separators 27*a* with a quality of 0.6) to the cooling only operation mode with a condensing temperature of 49° C., an evaporating temperature of 0° C., a superheat of 2° C., and a subcool of 5° C.

In this case, the opening degree and the number of pulses of the expansion device 14*b* are: the Cv value is 0.011 and the number of pulses 96 for the cooling main operation mode, and the Cv value is 0.011 and the number of pulses is 93 for the cooling only operation mode. Since the amount of change in the number of pulses is small, the opening degree is not changed for a mode change between the cooling main operation mode and the cooling only operation mode.

In this manner, in the air-conditioning apparatus 100, the steady-state opening degrees described above are used as the initial values for injection control when the operation mode changes, thereby making it possible to readily stabilize the refrigeration cycle when the operation mode changes.

[Cooling Only Operation Mode to Cooling Main Operation Mode]

In a case where the operation mode changes from the cooling only operation mode to the cooling main operation mode, control is performed so that the opening degree of the expansion device 14*b* is increased by a certain opening degree. In a case where the operation mode changes from the cooling only operation mode to the cooling main operation mode, control may be performed so that the increase and decrease in the amount of change in the number of pulses in the case of a change of the operation mode from the cooling main operation mode to the cooling only operation mode are reversed.

The enthalpy (point K in FIG. 5) of the refrigerant for injection in the cooling only operation mode is smaller than the enthalpy (point K in FIG. 9) of the refrigerant for injection in the cooling main operation mode by an amount corresponding to the subcool. Hence, it is necessary to reduce the injection flow rate. To this end, in a case where the operation mode changes from the cooling main operation mode to the cooling only operation mode, control is performed so that the opening degree of the expansion device 14*b* is decreased by a certain opening degree that depends on the subcool. Conversely, in a case where the operation mode changes from the cooling only operation mode to the cooling main operation mode, control is performed so that the opening degree of the expansion device 14*b* is increased by the certain opening degree.

[Injection with Intermediate Pressure Control]

The injection control method for the heating only operation mode and the heating main operation mode may also be performed by controlling both the intermediate pressure and the discharge temperature of the compressor 10 only with the expansion device 14*a* while the opening degree of the expansion device 14*b* is set to a fully opened state all the time.

FIG. 24 is a flowchart illustrating an example of the flow for a control process for controlling both the intermediate pressure and the discharge temperature of the compressor 10 only with the expansion device 14*a*. A control process for controlling both the intermediate pressure and the discharge temperature of the compressor 10 only with the expansion device 14*a* will be described with reference to FIG. 24. There is no change in the injection control method for the cooling only operation mode and the cooling main operation mode, which do not require the intermediate pressure. The illustrated control process for the air-conditioning apparatus 100 is performed by the controller 50 described above.

When the outdoor unit 1 is activated and the process starts (AB1), first, the controller 50 sets a discharge temperature target value that is a discharge temperature control target value of the compressor 10 (AB2). The discharge temperature target value may be set so that the target value of the discharge temperature is set to a low value, for example, 80° C. or the like, so as to increase the injection flow rate because the pressure drop in the heat source side heat exchanger 12 is low for a high injection flow rate in the heating operation. Then, the controller 50 detects the discharge temperature of the compressor 10 using the information supplied from the discharge refrigerant temperature detecting device 37 (AB3).

Then, the controller 50 sets the target value of the intermediate pressure. (AB4). The target value of the intermediate pressure may be set to a high value, for example, 1.93 MPa, which is the saturation pressure of the R32 refrigerant at 30° C., or the like, so as to increase the injection flow rate in the heating only operation mode. In the heating main operation mode, because of the presence of an indoor unit 2 that is in cooling operation, it is not possible to increase the evaporating temperature, that is, the intermediate pressure. Accordingly, the target value of the intermediate pressure may be set to, for example, 1.01 MPa, which is the saturation pressure of the R32 refrigerant at 7° C., or the like.

The controller 50 detects the intermediate pressure using the information supplied from the intermediate-pressure detecting device 32 (AB5). The controller 50 determines whether or not the difference between the target value of the discharge temperature of the compressor 10 and the detected value of the discharge temperature of the compressor 10 is smaller than a predetermined temperature difference, for example, 0.5° C. (AB6). If the difference between the target value of the discharge temperature of the compressor 10 and the detected value of the discharge temperature of the compressor 10 is greater than or equal to the predetermined temperature difference (AB6; NO) and if the detected value of the discharge temperature of the compressor 10 is larger than the target value of the discharge temperature of the compressor 10, the controller 50 increases the opening degree of the expansion device 14*a* (the upper case in AB7). On the other hand, if the difference between the target value of the discharge temperature of the compressor 10 and the detected value of the discharge temperature of the compressor 10 is greater than or equal to the predetermined temperature difference (AB6; NO) and if the detected value of the discharge temperature of the compressor 10 is smaller than the target value of the discharge temperature of the compressor 10, the controller 50 decreases the opening degree of the expansion device 14*a* (the lower case in AB7).

If the difference between the target value of the discharge temperature of the compressor 10 and the detected value of the discharge temperature of the compressor 10 is smaller than the temperature difference (AB6; YES), the controller 50 terminates the control of the discharge temperature (AB6).

The method for determining the opening degree of the expansion device 14*a* is the same as the calculation method described above, and therefore will not be described. In addition, the steady-state opening degrees of the expansion device 14*a* for the respective operation modes and the respective intermediate target pressure values are almost the same as the opening degrees illustrated in FIG. 15 to FIG. 20, and therefore will not be described. The steady-state opening degrees described above are used as the initial values for injection control, thereby making it possible to readily stabilize the refrigeration cycle in a case where injection is performed with intermediate pressure control.

The method for setting the opening degree of the expansion device 14*b* to a fully opened state and simultaneously controlling the intermediate pressure and the injection flow rate only with the expansion device 14*a* in the heating operation is, in other words, no use of the expansion device 14*b* during heating. Since a high-pressure refrigerant is injected during injection in the cooling operation, the maximum opening degree of the expansion device 14*b* may be small. A small-capacity, low-cost device can thus be used as the expansion device 14*b*.

[Injection with Pressure Differential Control]

The injection control method for the heating only operation mode and the heating main operation mode may also be performed by, while the opening degree of the expansion device 14*b* is set to a fully opened state all the time, controlling the difference (pressure differential) between the detected value of the intermediate-pressure detecting device 32 and the detected value of the suction pressure detecting device 33 installed near the suction of the compressor 10 only with the expansion device 14*a* to reduce the discharge temperature of the compressor 10.

Figures 25, 26:
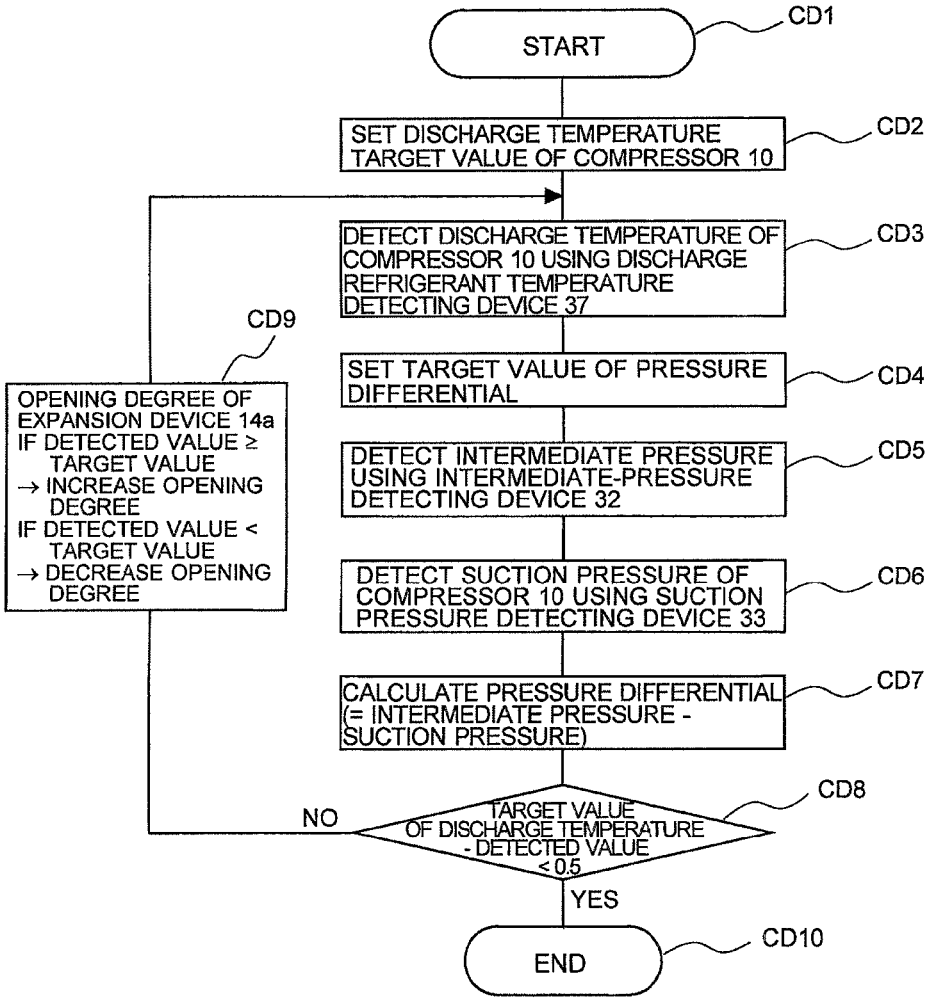
FIG. 25 is a flowchart illustrating an example of the flow for a control process for controlling both the intermediate pressure and the discharge temperature of a compressor with a single expansion device in the air-conditioning apparatus according to Embodiment 1 of the present invention.
FIG. 26 is a table illustrating the steady-state opening degrees of an expansion device 14*a* for the respective operation modes of the air-conditioning apparatus according to Embodiment 1 of the present invention and the respective pressure differential target values.

FIG. 25 is a flowchart illustrating an example of the flow for a control process for controlling both the intermediate pressure and the discharge temperature of the compressor 10 only with the expansion device 14*a*. A control process for controlling both the intermediate pressure and the discharge temperature of the compressor 10 only with the expansion device 14*a* will be described with reference to FIG. 25. There is no change in the injection control method for the cooling only operation mode and the cooling main operation mode, which do not require the intermediate pressure. The illustrated control process for the air-conditioning apparatus 100 is performed by the controller 50 described above.

When the outdoor unit 1 is activated and the process starts (CD1), first, the controller 50 sets a discharge temperature target value that is a discharge temperature control target value of the compressor 10 (CD2). The discharge temperature target value may be set so that the target value of the discharge temperature is set to a low value, for example, 80° C. or the like, so as to increase the injection flow rate because the pressure drop in the heat source side heat exchanger 12 is low for a high injection flow rate in the heating operation. Then, the controller 50 detects the discharge temperature of the compressor 10 using the information supplied from the discharge refrigerant temperature detecting device 37 (CD3).

Then, the controller 50 sets the target value of the difference (pressure differential) between the intermediate pressure and the suction pressure of the compressor 10 (CD4), The target value of the pressure differential may be set to a high value, for example, 1.11 MPa, which is the difference between the saturation pressures of the R32 refrigerant at 30° C. and 0'C, or the like, so as to increase the injection flow rate in the heating only operation mode. In the heating main operation mode, because of the presence of an indoor unit 2 that is in cooling operation, it is not possible to increase the evaporating temperature. Accordingly, it is not also possible to increase the pressure differential. In this case, the target value of the pressure differential may be set to, for example, 0.20 MPa, which is the difference between the saturation pressures of the R32 refrigerant at 7° C. and 0° C., or the like.

The controller 50 detects the intermediate pressure using the information supplied from the intermediate-pressure detecting device 32 (CD5). The controller 50 detects the suction pressure of the compressor 10 using the information supplied from the suction pressure detecting device 33 (CD6), and calculates the difference (pressure differential) between the intermediate pressure and the suction pressure of the compressor 10 (CD7). The controller 50 determines whether or not the difference between the target value of the discharge temperature of the compressor 10 and the detected value of the discharge temperature of the compressor 10 is smaller than a predetermined temperature difference, for example, 0.5° C. (CD8).

If the difference between the target value of the discharge temperature of the compressor 10 and the detected value of the discharge temperature of the compressor 10 is greater than or equal to the predetermined temperature difference (CD8: NO) and if the detected value of the discharge temperature of the compressor 10 is larger than the target value of the discharge temperature of the compressor 10, the controller 50 increases the opening degree of the expansion device 14*a* so as to increase the pressure differential (the upper case in CD9). On the other hand, if the difference between the target value of the discharge temperature of the compressor 10 and the detected value of the discharge temperature of the compressor 10 is greater than or equal to the predetermined temperature difference (CD8; NO) and if the detected value of the discharge temperature of the compressor 10 is smaller than the target value of the discharge temperature of the compressor 10, the controller 50 decreases the opening degree of the expansion device 14*a* so as to decrease the pressure differential (the lower case in CD9).

If the difference between the target value of the discharge temperature of the compressor 10 and the detected value of the discharge temperature of the compressor 10 is smaller than the temperature difference (CD8; YES), the controller 50 terminates the control of the discharge temperature (CD10). The method for determining the opening degree of the expansion device 14*a* is the same as the calculation method described above, and therefore will not be described.

FIG. 26 is a table illustrating the steady-state opening degrees of the expansion device 14*a* for the respective operation modes and the respective pressure differential target values. The steady-state opening degrees are obtained as follows: A saturation pressure difference at a temperature difference between an evaporating temperature and a saturation temperature of an intermediate pressure is used as a pressure differential, and the steady-state opening degree of the expansion device 14*a* in this case is obtained from the result of an estimate of an intermediate target pressure value in the heating only operation mode (FIG. 16) and the result of an estimate of an intermediate target pressure value in the heating main operation mode (FIG. 19). The steady-state opening degrees described above are used as the initial values for injection control, thereby making it possible to readily stabilize the refrigeration cycle in a case where injection is performed with pressure differential control. While a pressure differential is determined using the detected value of the suction pressure detecting device 33, a pressure differential may be determined by converting a detected temperature of the suction refrigerant temperature detecting device 38 into a saturation pressure. In this case, the refrigerant needs to be in a two-phase gas-liquid state.

The method for setting the opening degree of the expansion device 14*b* to a fully opened state and simultaneously controlling the pressure differential and the injection flow rate only with the expansion device 14*a* in the heating operation is, in other words, no use of the expansion device 14*b* during heating. Since a high-pressure refrigerant is injected during injection in the cooling operation, the maximum opening degree of the expansion device 14*b* may be small. A small-capacity, low-cost expansion device can thus be used as the expansion device 14*b*.

As described above, the air-conditioning apparatus 100 according to Embodiment 1 is configured such that a refrigerant flows into the expansion device 14*b* that controls the injection flow rate via gas-liquid separators (the gas-liquid separators 27*a* and the gas-liquid separators 27*b*) and the refrigerant-refrigerant heat exchanger 28. This configuration can ensure that a refrigerant that is to flow into the expansion device 14*b* is a liquid refrigerant. Accordingly, the air-conditioning apparatus 100 can achieve stable injection control regardless of the operation mode, and can prevent an excessive increase in the temperature of the refrigerant discharged from the compressor 10.

Embodiment 2

Figure 27:
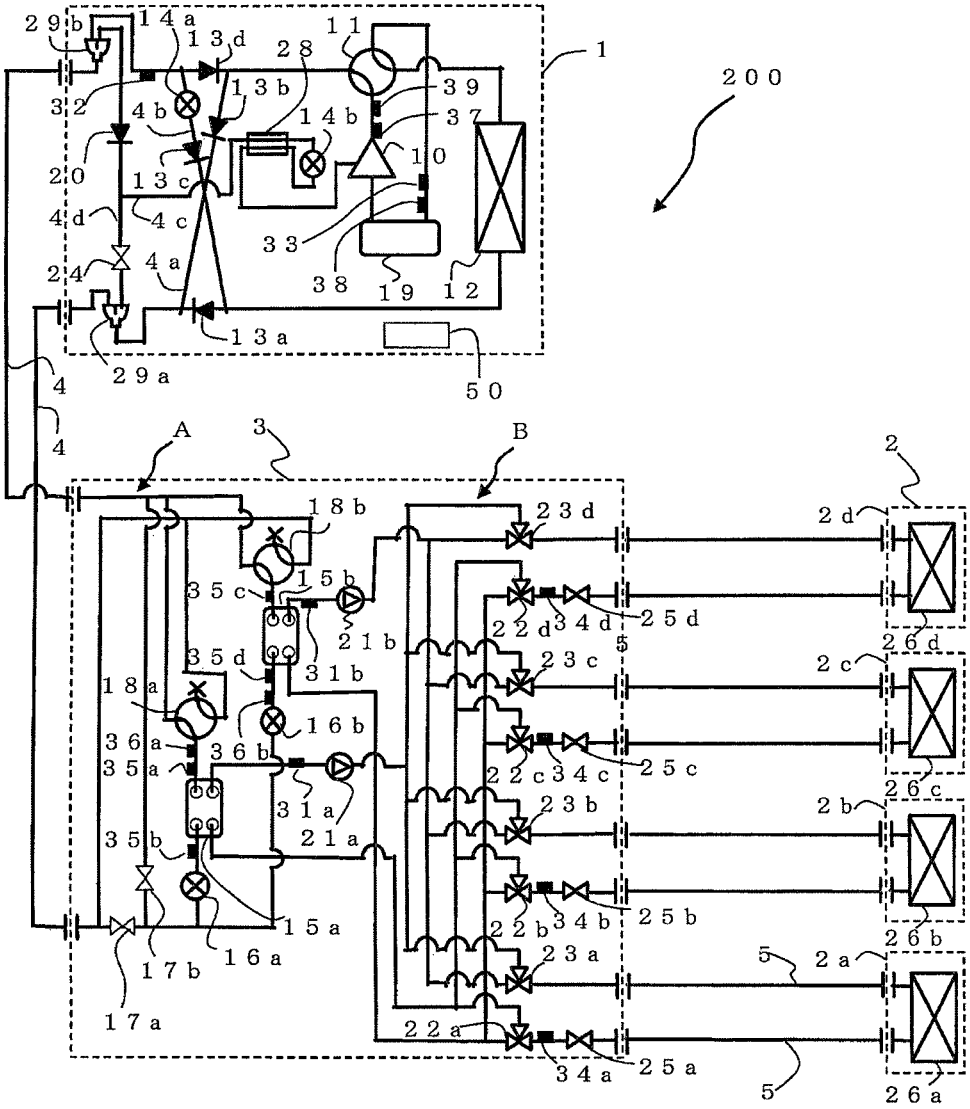
FIG. 27 is a schematic diagram illustrating an example circuit configuration of an air-conditioning apparatus according to Embodiment 2 of the present invention.

FIG. 27 is a schematic diagram illustrating an example circuit configuration of an air-conditioning apparatus 200 according to Embodiment 2. The air-conditioning apparatus 200 according to Embodiment 2 has a configuration in which the gas-liquid separators 27*a* and the gas-liquid separators 27*b* in the air-conditioning apparatus 100 according to Embodiment 1 are replaced by a branch portion 29*a* and a branch portion 29*b*, respectively. In other respects, the air-conditioning apparatus 200 is similar to that of the air-conditioning apparatus 100 according to Embodiment 1 and therefore will not be described. In addition, the flow of a heat medium is similar to that in Embodiment 1, and therefore will not be described.

The branch portion 29*a* is configured to split the flow of a refrigerant that has passed through the check valve 13*a* or the check valve 13*b* into a flow to the refrigerant pipe 4 and a flow to the branch pipe 4*d*. The branch portion 29*b* is configured to split the flow of a refrigerant returning from the heat medium relay unit 3 into a flow to the branch pipe 4*d* and a refrigerant that is to flow through the check valve 13*d* or the check valve 13*c*.

[Operation Modes]

Figure 28:
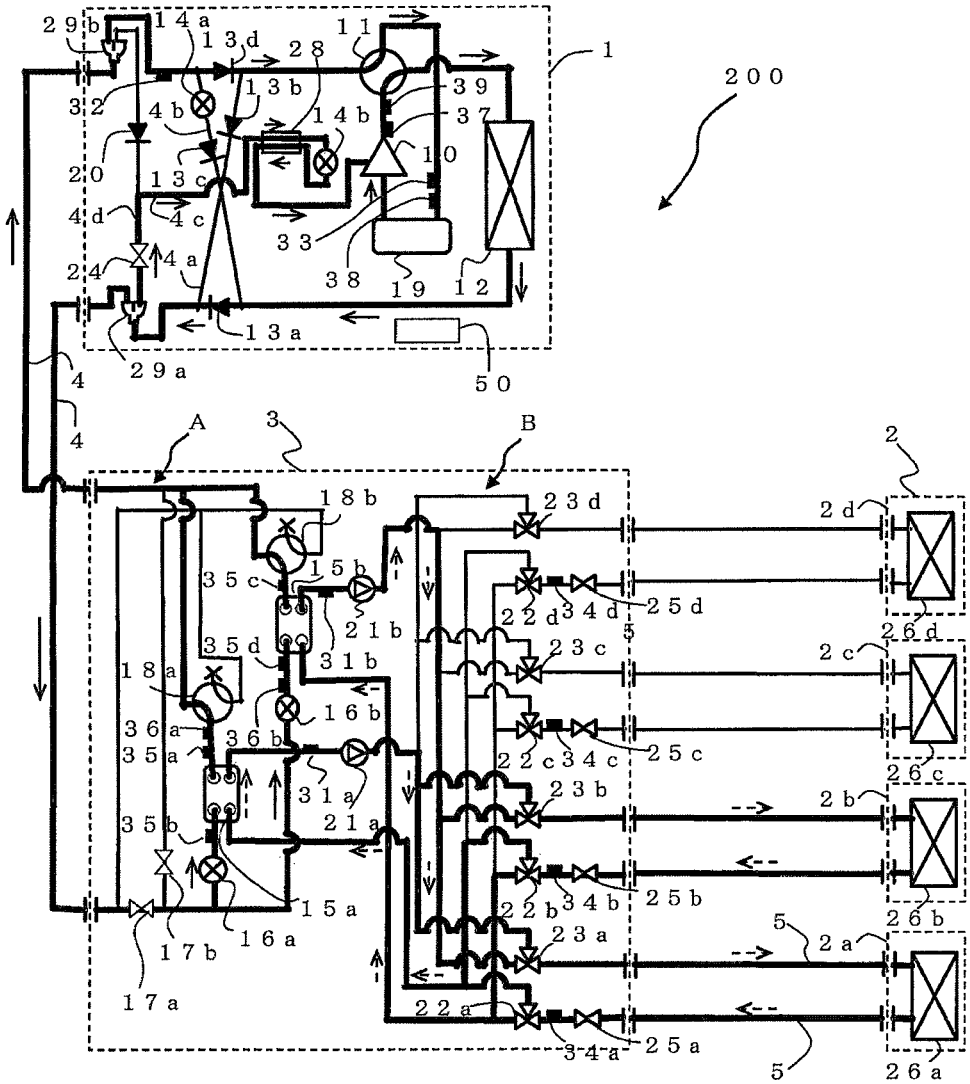
FIG. 28 is a refrigerant circuit diagram illustrating a refrigerant flow when the air-conditioning apparatus according to Embodiment 2 of the present invention is in a cooling only operation mode.
Figure 29:
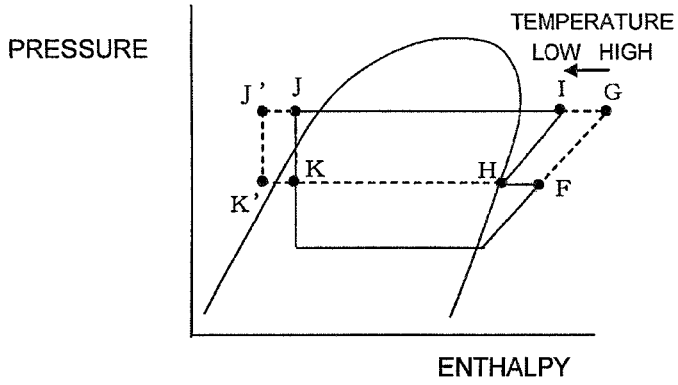
FIG. 29 is a P-h diagram illustrating a state transition of a heat source side refrigerant when the air-conditioning apparatus according to Embodiment 2 of the present invention is in the cooling only operation mode.
Figure 30:
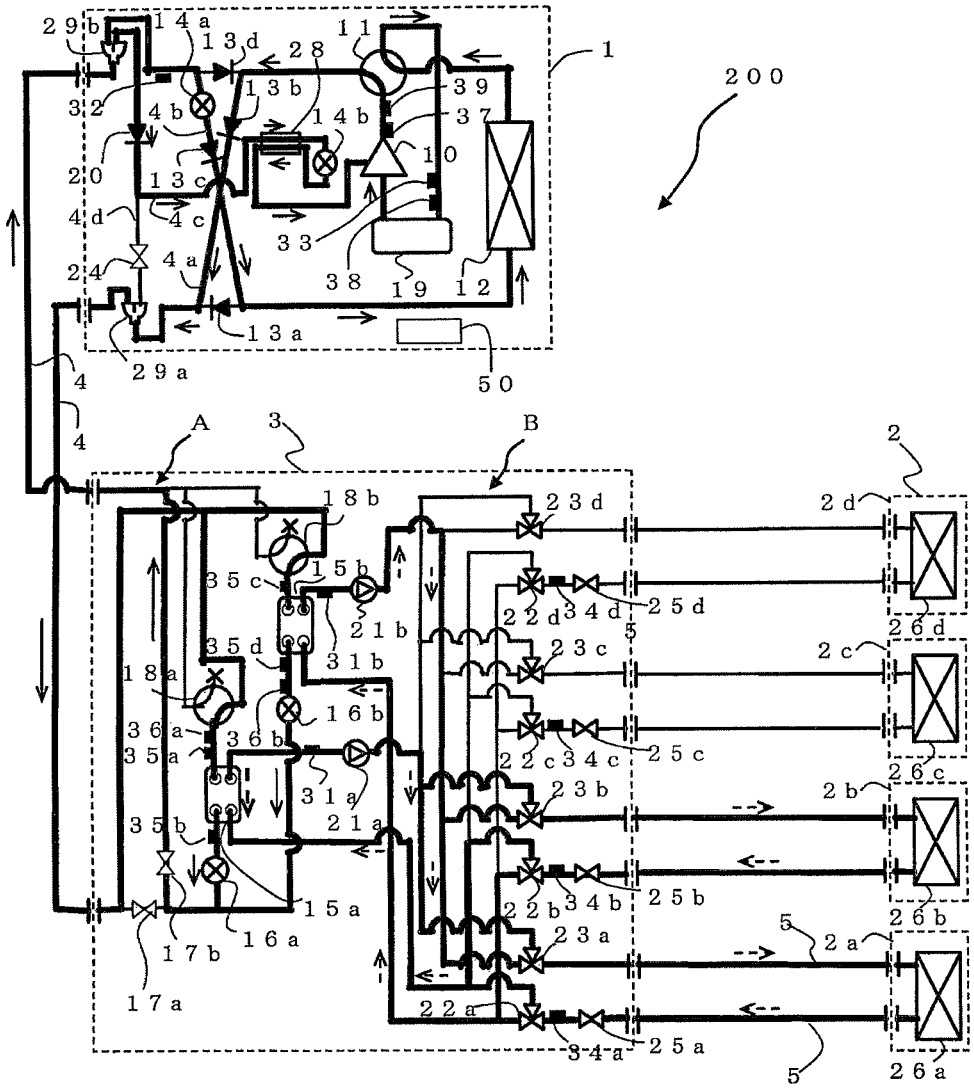
FIG. 30 is a refrigerant circuit diagram illustrating a refrigerant flow when the air-conditioning apparatus according to Embodiment 2 of the present invention is in a heating only operation mode.
Figure 31:
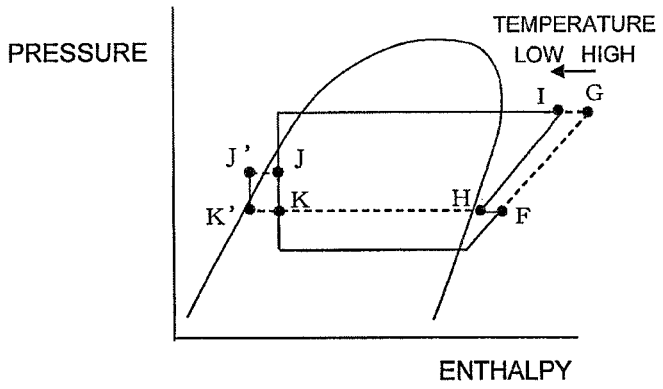
FIG. 31 is a P-h diagram illustrating a state transition of a heat source side refrigerant when the air-conditioning apparatus according to Embodiment 2 of the present invention is in the cooling only operation mode.
Figure 32:
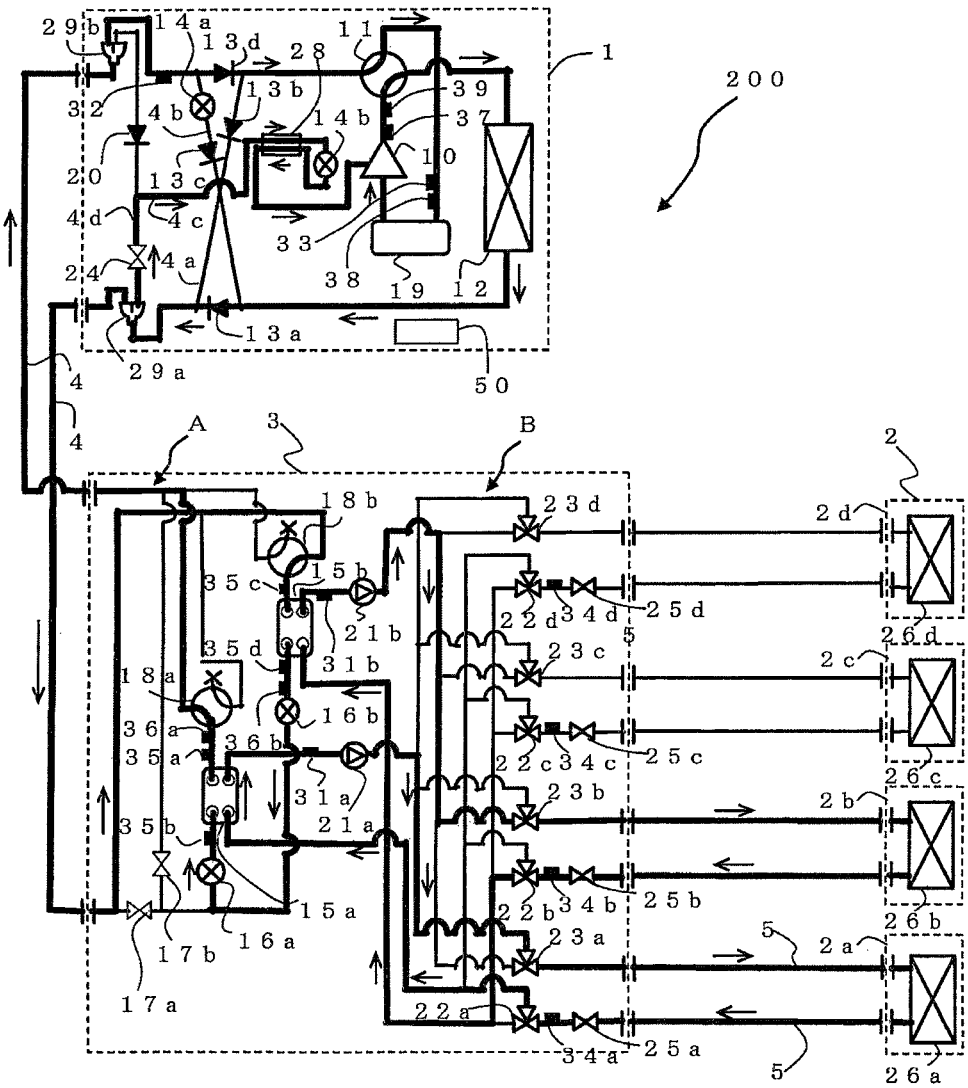
FIG. 32 is a refrigerant circuit diagram illustrating a refrigerant flow when the air-conditioning apparatus according to Embodiment 2 of the present invention is in the cooling main operation mode.
Figure 33:
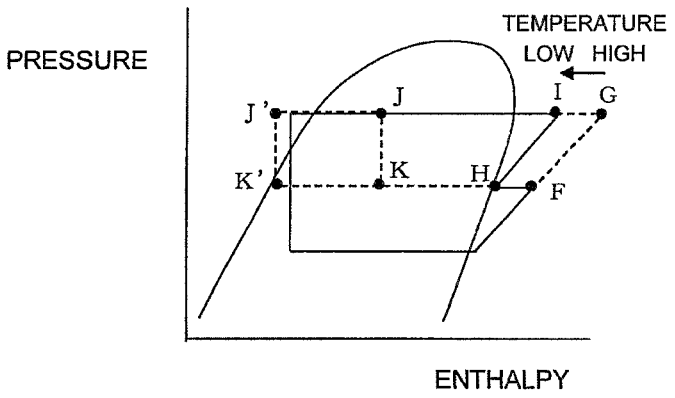
FIG. 33 is a P-h diagram illustrating a state transition of a heat source side refrigerant when the air-conditioning apparatus according to Embodiment 2 of the present invention is in the cooling main operation mode.
Figure 34:
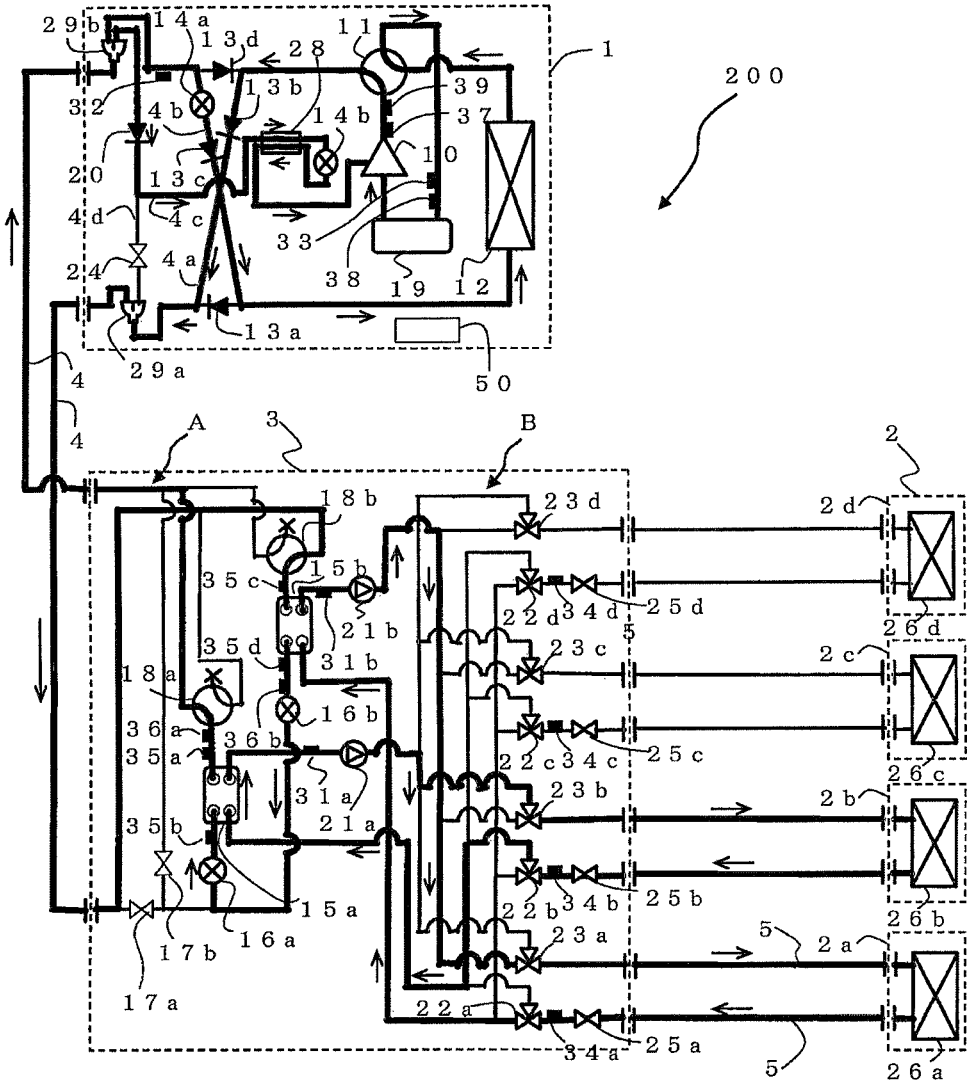
FIG. 34 is a refrigerant circuit diagram illustrating a refrigerant flow when the air-conditioning apparatus according to Embodiment 2 of the present invention is in the heating main operation mode.
Figure 35:
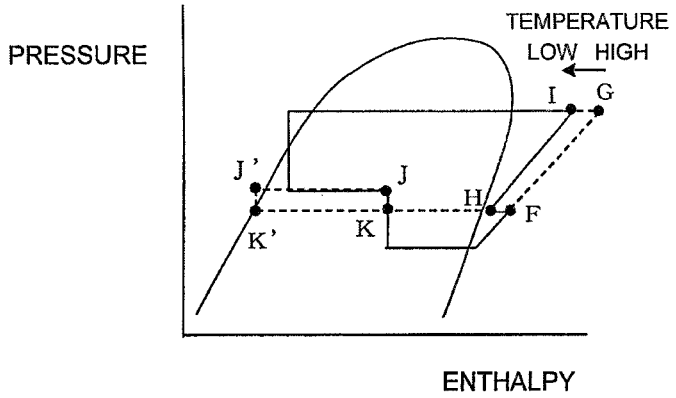
FIG. 35 is a P-h diagram illustrating a state transition of a heat source side refrigerant when the air-conditioning apparatus according to Embodiment 2 of the present invention is in the heating main operation mode.

FIG. 28 is a refrigerant circuit diagram illustrating a refrigerant flow when the air-conditioning apparatus 200 is in the cooling only operation mode. FIG. 29 is a P-h diagram illustrating a state transition of a heat source side refrigerant in the cooling only operation mode. FIG. 30 is a refrigerant circuit diagram illustrating a refrigerant flow when the air-conditioning apparatus 200 is in the heating only operation mode. FIG. 31 is a P-h diagram illustrating a state transition of a heat source side refrigerant in the cooling only operation mode. FIG. 32 is a refrigerant circuit diagram illustrating a refrigerant flow when the air-conditioning apparatus 200 is in the cooling main operation mode. FIG. 33 is a P-h diagram illustrating a state transition of a heat source side refrigerant in the cooling main operation mode. FIG. 34 is a refrigerant circuit diagram illustrating a refrigerant flow when the air-conditioning apparatus 200 is in the heating main operation mode. FIG. 35 is a P-h diagram illustrating a state transition of a heat source side refrigerant in the heating main operation mode.

The flow of a heat source side refrigerant in the individual operation modes of the air-conditioning apparatus 200 is basically the same as the flow of a heat source side refrigerant described in Embodiment 1. In the air-conditioning apparatus 200, since the branch portion 29*a* and the branch portion 29*b* are installed in place of the gas-liquid separators 27*a* and the gas-liquid separators 27*b*, the state of the heat source side refrigerant, the flow of which is split at the branch portion 29*a* and the branch portion 29*b*, is slightly different from that in the air-conditioning apparatus 100 according to Embodiment 1.

[Injection Control]

A specific control method for the air-conditioning apparatus 200 according to Embodiment 2 during injection will be described. Injection control for reducing the discharge temperature of the compressor 10 is like that described in Embodiment 1 and Illustrated in FIG. 15. Further, the control of the injection flow rate and the method for determining the opening degree of the expansion device 14*a* and the expansion device 14*b* are also the same as those in Embodiment 1. In the air-conditioning apparatus 200, however, because of the different refrigerant circuit configuration from that of the air-conditioning apparatus 100, the injection flow rate and the steady-state opening degree of the expansion device 14*a* and device 14*b* are different. The description will be directed to the difference from Embodiment 1 with regard to the injection control method for the respective operation modes.

[Injection Control Method for Cooling Only Operation Mode]

The refrigerant injection operation will be described with reference to FIG. 28 and FIG. 29.

The internal volume of the compression chamber of the compressor 10 decreases while the compression chamber is rotated 0 to 360 degrees with a motor (not illustrated). The inside low-temperature and low-pressure gaseous refrigerant that has been sucked into the compression chamber is compressed so that the pressure and the temperature increase in accordance with the decrease in the internal volume of the compression chamber. When the rotation angle of the motor reaches a certain angle, the opening (formed in part of the compression chamber) is opened (the state indicated by point F in FIG. 29), thereby bringing the inside of the compression chamber and the injection pipe 4*c* located outside the compressor 10 into communication with each other.

The refrigerant compressed by the compressor 10 is condensed and liquified in the heat source side heat exchanger 12 into a high-pressure liquid refrigerant (point J in FIG. 29), and reaches the branch portion 29*a* via the check valve 13*a*. The opening/closing device 24 is set to an opened state, and the flow of the high-pressure liquid refrigerant is split at the branch portion 29*a*. The refrigerant, the flow of which is split at the branch portion 29*a*, flows into the injection pipe 4*c* via the opening/closing device 24 through the branch pipe 4*d*. The refrigerant that has flowed into the injection pipe 4*c* flows into the expansion device 14*b* via the refrigerant-refrigerant heat exchanger 28, and is converted into a low-temperature and intermediate-pressure two-phase refrigerant through pressure reduction. The refrigerant that has flowed into the expansion device 14*b* is cooled with the refrigerant whose pressure and temperature have been reduced through pressure reduction in the refrigerant-refrigerant heat exchanger 28 (point J' in FIG. 29). The refrigerant is throttled by the expansion device 14*b* (point K' in FIG. 29), and is then heated with the refrigerant before undergoing pressure reduction in the refrigerant-refrigerant heat exchanger 28 (point K in FIG. 29). Then, the refrigerant is directed into the compression chamber.

The expansion device 14*b* may not be able to perform stable control if a refrigerant in a two-phase state flows into the expansion device 14*b*. The configuration described above ensures that a liquid refrigerant is reliably supplied to the expansion device 14*b* even if the subcool (degree of subcooling) at the outlet of the heat source side heat exchanger 12 is low due to factors such as a small amount of enclosed refrigerant, thereby achieving stable control. FIG. 36 illustrates the steady-state opening degrees of the expansion device 14*b* for controlling the injection flow rate when the condensing temperature changes in the cooling only operation mode. The calculation conditions and the calculation processes for the individual operation modes are similar to those in Embodiment 1, and will not be described.

[Injection Control Method for Heating Only Operation Mode]

The refrigerant injection operation will be described with reference to FIG. 30 and FIG. 31.

The internal volume of the compression chamber of the compressor 10 decreases while the compression chamber is rotated 0 to 360 degrees with a motor. The inside low-temperature and low-pressure gaseous refrigerant that has been sucked into the compression chamber is compressed so that the pressure and the temperature increase in accordance with the decrease in the internal volume of the compression chamber. When the rotation angle of the motor reaches a certain angle, the opening is opened (the state indicated by point Fin FIG. 31), thereby bringing the inside of the compression chamber and the injection pipe 4*c* located outside the compressor 10 into communication with each other.

The pressure of the refrigerant returning to the outdoor unit 1 from the heat medium relay unit 3 through the refrigerant pipe 4 is controlled to have an intermediate-pressure state on the upstream side of the expansion device 14*a* due to the operation of the expansion device 14*a* (point J in FIG. 31). The flow of the two-phase refrigerant set to the intermediate-pressure state due to the operation of the expansion device 14*a* is split at the branch portion 29*b*, and part of the refrigerant flows into the branch pipe 4*d*. This refrigerant flows to the injection pipe 4*c* via the backflow prevention device 20. The refrigerant flowing through the injection pipe 4*c* flows into the expansion device 14*b* via the refrigerant-refrigerant heat exchanger 28 to undergo pressure reduction. A low-temperature and intermediate-pressure two-phase refrigerant whose pressure has been slightly reduced through the pressure reduction is obtained.

The heat source side refrigerant that has flowed into the expansion device 14*b* is cooled with the heat source side refrigerant whose pressure and temperature have been reduced through pressure reduction in the refrigerant-refrigerant heat exchanger 28, and is thus liquified (point J' in FIG. 31). This heat source side refrigerant is throttled by the expansion device 14*b* (point K' in FIG. 31), and is then heated with the refrigerant before undergoing pressure reduction in the refrigerant-refrigerant heat exchanger 28 (point K in FIG. 31). Then, the heat source side refrigerant is directed into the compression chamber through the opening port formed in the compression chamber of the compressor 10.

The configuration described above allows a refrigerant in an intermediate-pressure two-phase state to be converted into an intermediate-pressure liquid refrigerant before flowing into the expansion device 14*b*, and can achieve stable control. FIG. 37 illustrates the steady-state opening degrees of the expansion device 14*b* for controlling the injection flow rate and the expansion device 14*a* for controlling the intermediate pressure when the intermediate pressure changes in the heating only operation mode. FIG. 38 illustrates the steady-state opening degrees of the expansion device 14*b* for controlling the injection flow rate and the expansion device 14*a* for controlling the intermediate pressure when the evaporating temperature changes in the heating only operation mode.

[Injection Control Method for Cooling Main Operation Mode]

The refrigerant injection operation will be described with reference to FIG. 32 and FIG. 33.

The internal volume of the compression chamber of the compressor 10 decreases while the compression chamber is rotated 0 to 360 degrees with a motor (not illustrated). The inside low-temperature and low-pressure gaseous refrigerant that has been sucked into the compression chamber is compressed so that the pressure and the temperature increase in accordance with the decrease in the internal volume of the compression chamber. When the rotation angle of the motor reaches a certain angle, the opening (formed in part of the compression chamber) is opened (the state indicated by point F in FIG. 33), thereby bringing the inside of the compression chamber and the injection pipe 4*c* located outside the compressor 10 into, communication with each other.

The refrigerant compressed by the compressor 10 is condensed in the heat source side heat exchanger 12 into a high-pressure two-phase refrigerant (point J in FIG. 33), and reaches the branch portion 29*a* via the check valve 13*a*. The opening/closing device 24 is set to an opened state, and the flow of the high-pressure two-phase refrigerant is split at the branch portion 29*a*. The refrigerant, the flow of which is split at the branch portion 29*a*, flows into the injection pipe 4*c* via the opening/closing device 24 through the branch pipe 4*d*. The refrigerant that has flowed into the injection pipe 4*c* flows into the expansion device 14*b* via the refrigerant-refrigerant heat exchanger 28 to undergo pressure reduction. A low-temperature and intermediate-pressure two-phase refrigerant is obtained. The refrigerant that has flowed into the expansion device 14*b* is cooled with the refrigerant whose pressure and temperature have been reduced through pressure reduction in the refrigerant-refrigerant heat exchanger 28, and is thus liquified (point J' in FIG. 33). The refrigerant is throttled by the expansion device 14*b* (point K' in FIG. 33), and is then heated with the refrigerant before undergoing pressure reduction in the refrigerant-refrigerant heat exchanger 28 (point K in FIG. 33). Then, the refrigerant is directed into the compression chamber.

The configuration described above ensures that a refrigerant in a high-pressure two-phase state is converted into a high-pressure liquid refrigerant before flowing into the expansion device 14*b*, and can achieve stable control. FIG. 39 illustrates the steady-state opening degrees of the expansion device 14*b* for controlling the injection flow rate when the indoor heating load (quality) changes in the cooling main operation mode.

[Injection Control Method for Heating Main Operation Mode]

The refrigerant injection operation will be described with reference to FIG. 34 and FIG. 35.

The internal volume of the compression chamber of the compressor 10 decreases while the compression chamber is rotated 0 to 360 degrees with a motor (not illustrated). The inside low-temperature and low-pressure gaseous refrigerant that has been sucked into the compression chamber is compressed so that the pressure and the temperature increase in accordance with the decrease in the internal volume of the compression chamber. When the rotation angle of the motor reaches a certain angle, the opening port (formed in part of the compression chamber) is opened (the state indicated by point F in FIG. 35), thereby bringing the inside of the compression chamber and the injection pipe 4*c* located outside the compressor 10 into communication with each other.

The pressure of the refrigerant returning to the outdoor unit 1 from the heat medium relay unit 3 through the refrigerant pipe 4 is controlled to have an intermediate-pressure state on the upstream side of the expansion device 14*a* due to the operation of the expansion device 14*a* (point J in FIG. 35). The flow of the two-phase refrigerant set to the intermediate-pressure state due to the operation of the expansion device 14*a* is split at the branch portion 29*b*, and part of the refrigerant flows into the branch pipe 4*d*. This refrigerant flows to the injection pipe 4*c* via the backflow prevention device 20. The refrigerant flowing through the injection pipe 40 flows into the expansion device 14*b* via the refrigerant-refrigerant heat exchanger 28 to undergo pressure reduction. A low-temperature and intermediate-pressure two-phase refrigerant whose pressure has been slightly reduced through the pressure reduction is obtained.

The heat source side refrigerant that has flowed into the expansion device 14*b* is cooled with the refrigerant whose pressure and temperature have been reduced through pressure reduction in the refrigerant-refrigerant heat exchanger 28, and is thus liquified (point J' in FIG. 35). This heat source side refrigerant is throttled by the expansion device 14*b* (point K' in FIG. 35), and is then heated with the refrigerant before undergoing pressure reduction in the refrigerant-refrigerant heat exchanger 28 (point K in FIG. 35). Then, the heat source side refrigerant is directed into the compression chamber through the opening port formed in the compression chamber of the compressor 100.

The configuration described above allows a refrigerant in an intermediate-pressure two-phase state to be converted into an intermediate-pressure liquid refrigerant before flowing into the expansion device 14*b*, and can achieve stable control. FIG. 40 illustrates the steady-state opening degrees of the expansion device 14*b* for controlling the injection flow rate and the expansion device 14*a* for controlling the intermediate pressure when the intermediate pressure changes in the heating main operation mode. FIG. 41 illustrates the steady-state opening degrees of the expansion device 14*b* for controlling the injection flow rate and the expansion device 14*a* for controlling the intermediate pressure when the evaporating temperature changes in the heating main operation mode.

As described above, the configuration of the air-conditioning apparatus 200 according to Embodiment 2 also allows separate control of the intermediate pressure and the injection flow rate using the two expansion devices, namely, the expansion device 14*a* and the expansion device 14*b*. The air-conditioning apparatus 200 can control the intermediate pressure and the injection flow rate, as desired, and can achieve stable injection under various conditions.

[Control Method when Operation Mode Changes]

The intermediate pressure and the opening degree of the expansion device 14*a* and the expansion device 14*b* when the operation mode changes are controlled using a method similar to that in Embodiment 1, and therefore will not be described. FIG. 42 to FIG. 44 illustrate the initial opening degrees of the expansion device 14*a* and the expansion device 14*b* when the operation mode of the air-conditioning apparatus 200 according to Embodiment 2 changes. The calculation conditions and the calculation processes are similar to those in Embodiment 1, and will not be described in detail.

[Injection with Intermediate Pressure Control]

Also in the air-conditioning apparatus 200, the injection control method for the heating only operation mode and the heating main operation mode may be performed by controlling both the intermediate pressure and the discharge temperature of the compressor 10 only with the expansion device 14*a* while the opening degree of the expansion device 14*b* is set to a fully opened state all the time. The flow for a control process for controlling both the intermediate pressure and the discharge temperature of the compressor 10 only with the expansion device 14*a* is similar to that illustrated in FIG. 24 as described in Embodiment 1, and therefore will not be described. There is no change in the injection control method for the cooling only operation mode and the cooling main operation mode, which do not require the intermediate pressure.

The steady-state opening degrees of the expansion device 14*a* for the respective operation modes and the respective intermediate target pressure values are almost the same as the opening degrees illustrated in FIG. 36 to FIG. 41. The steady-state opening degrees of the expansion device 14*a* are used as the initial values for injection control, thereby making it possible to readily stabilize the refrigeration cycle when performing injection with intermediate pressure control.

The method for setting the opening degree of the expansion device 14*b* to a fully opened state and simultaneously controlling the intermediate pressure and the injection flow rate only with the expansion device 14*a* in the heating operation is, in other words, no use of the expansion device 14*b* during heating. Since a high-pressure refrigerant is injected during injection in the cooling operation, the maximum opening degree of the expansion device 14*b* may be small. A small-capacity, low-cost device can thus be used as the expansion device 14*b*.

[Injection with Pressure Differential Control]

Also in Embodiment 2, the injection control method for the heating only operation mode and the heating main operation mode may be performed by, while the opening degree of the expansion device 14*b* is set to a fully opened state all the time, controlling the difference (pressure differential) between the detected value of the intermediate-pressure detecting device 32 and the detected value of the suction pressure detecting device 33 installed near the suction of the compressor 10 only with the expansion device 14*a* to reduce the discharge temperature of the compressor 10. The flow for this control process is similar to that illustrated in FIG. 25 described in Embodiment 1, and therefore will not be described. There is no change in the injection control method for the cooling only operation mode and the cooling main operation mode, which do not require the intermediate pressure.

FIG. 45 is a table illustrating the steady-state opening degrees of the expansion device 14*a* for the respective operation modes and the respective pressure differential target values. The steady-state opening degrees are obtained as follows: A saturation pressure difference at a temperature difference between an evaporating temperature and a saturation temperature of an intermediate pressure is used as a pressure differential, and the steady-state opening degree of the expansion device 14*a* in this case is obtained from the result of an estimate of an intermediate target pressure value in the heating only operation mode (FIG. 37) and the result of an estimate of an intermediate target pressure value in the heating main operation mode (FIG. 40). The steady-state opening degrees described above are used as the initial values for injection control, thereby making it possible to readily stabilize the refrigeration cycle in a case where injection is performed with pressure differential control.

The method for setting the opening degree of the expansion device 14*b* to a fully opened state and simultaneously controlling the pressure differential and the injection flow rate only with the expansion device 14*a* in the heating operation is, in other words, no use of the expansion device 14*b* during heating. Since a high-pressure refrigerant is injected during injection in the cooling operation, the maximum opening degree of the expansion device 14*b* may be small. A small-capacity, low-cost expansion device can thus be used as the expansion device 14*b*.

As described above, the air-conditioning apparatus 200 according to Embodiment 2 is configured such that a refrigerant flows into the expansion device 14*b* that controls the injection flow rate via the branch portions (the branch portion 29*a* and the branch portion 29*b*) and the refrigerant-refrigerant heat exchanger 28. This configuration can ensure that a refrigerant that is to flow into the expansion device 14*b* is a liquid refrigerant. Accordingly, the air-conditioning apparatus 200 can achieve stable injection control regardless of the operation mode, and can prevent an excessive increase in the temperature of the refrigerant discharged from the compressor 10. Furthermore, since no gas-liquid separators are used, the air-conditioning apparatus 200 can be produced at lower cost.

Embodiment 3

Figure 46:
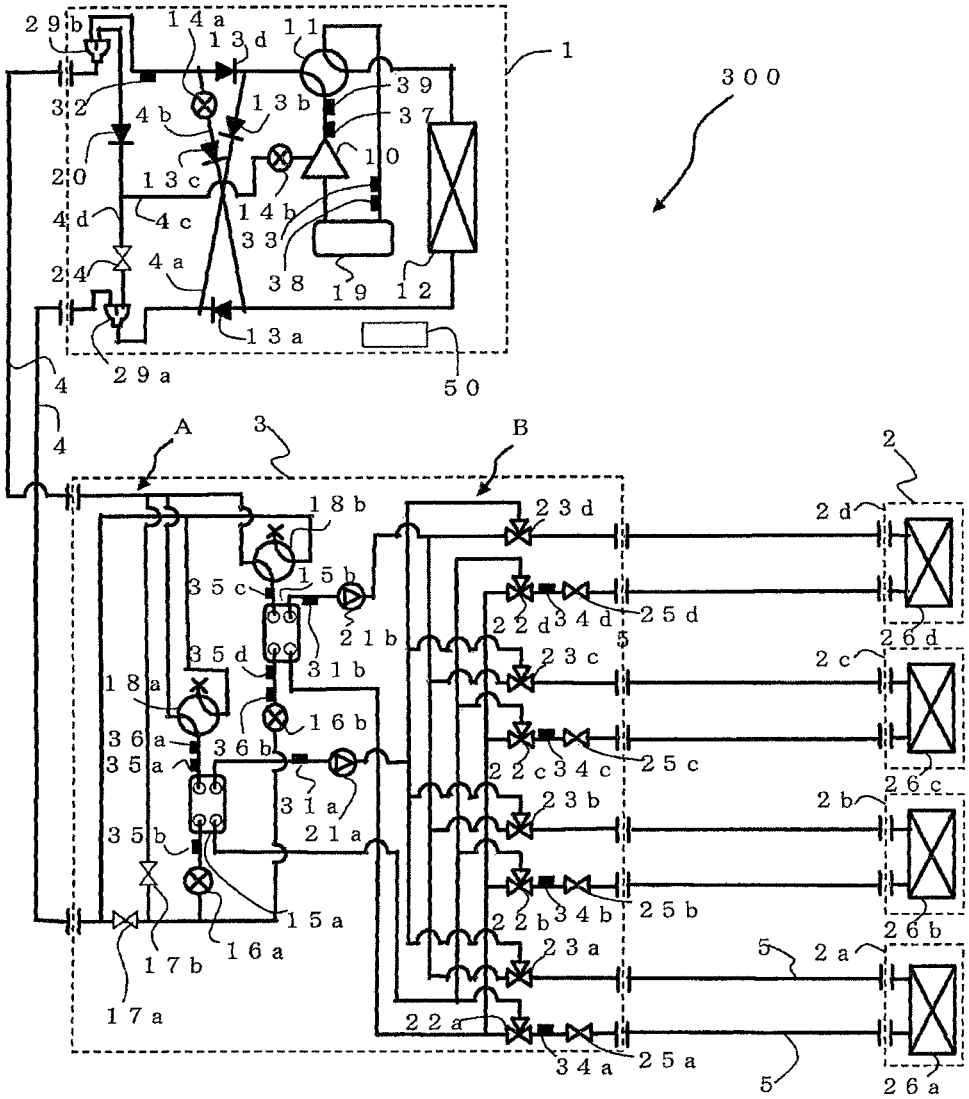
FIG. 46 is a schematic diagram illustrating an example circuit configuration of an air-conditioning apparatus according to Embodiment 3 of the present invention.
Figure 47:
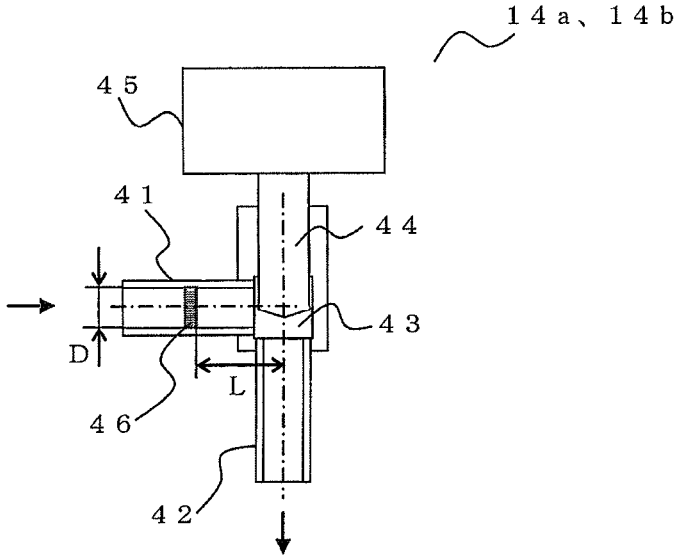
FIG. 47 is a schematic diagram illustrating an example configuration of an expansion device.

FIG. 46 is a schematic diagram illustrating an example circuit configuration of an air-conditioning apparatus 300 according to Embodiment 3, FIG. 47 is a schematic diagram illustrating an example configuration of expansion devices 14 (the expansion device 14*a* and the expansion device 14*b*). The air-conditioning apparatus 300 according to Embodiment 3 has a configuration in which the refrigerant-refrigerant heat exchanger 28 of the air-conditioning apparatus 200 according to Embodiment 2 is not included and an expansion device including an agitating device 46 illustrated in FIG. 47 is used as each of the expansion device 14*a* and the expansion device 14*b*. In other respects, the air-conditioning apparatus 300 is similar to the air-conditioning apparatus 100 according to Embodiment 1 and the air-conditioning apparatus 200 according to Embodiment 2, and therefore will not be described. Also, the flow of a heat medium is similar to that in Embodiment 1, and therefore will not be described.

As illustrated in FIG. 47, each of the expansion devices 14 includes an inlet pipe 41 serving as an inlet into which a refrigerant flows, a outlet pipe 42 serving as an outlet out of which a refrigerant flows, an expansion unit 43 that reduces the pressure of a refrigerant, a valve body 44 that adjusts the throttling performed by the expansion unit 43, a motor 45 that drives the valve body 44, and an agitating device 46 that agitates a refrigerant. The agitating device 46 is placed in the inlet pipe 41.

A two-phase refrigerant that has flowed through the inlet pipe 41 reaches the agitating device 46. Due to the operation of the agitating device 46, a gaseous refrigerant and a liquid refrigerant are agitated and mixed together substantially uniformly. The two-phase refrigerant in which the gaseous refrigerant and the liquid refrigerant are mixed together substantially uniformly is throttled by the expansion unit 43 to reduce the pressure of the refrigerant, and then flows out of the outlet pipe 42. In this case, the position of the valve body 44 is adjusted by the motor 45, and the throttling to be performed by the expansion unit 43 is controlled.

The agitating device 46 may be of any type that allows a substantially uniform mixture of gaseous refrigerant and liquid refrigerant, and may be formed of, for example, metal foam. The metal foam is a metal porous body having a three-dimensional mesh structure, which is similar to that of a resin foam such as a sponge, and has the highest porosity (void ratio) (80% to 97%) among metal porous bodies. A two-phase refrigerant transmitted through the metal foam experiences an influence of the three-dimensional mesh structure, and there is an advantage of the gas contained in the refrigerant being made fine and agitated, so that the gas is mixed with the liquid uniformly.

It is apparent in the field of fluid dynamics that a refrigerant flow is not affected by disturbance and maintains its original flow when the refrigerant flow reaches a distance at which L/D is 8 to 10, where D' denotes the inner diameter of a pipe into which the refrigerant flows, and L' denotes the length from the position having a structure that disturbs the flow (for example, the installation position of an agitating device) to the expansion unit. Accordingly, the agitating device 46 may be installed at the position at which L/D is 6 or less, where D denotes the inner diameter of the inlet pipe 41 of the expansion device 14, and L denotes the length from the agitating device 46 to the expansion unit 43. The agitating device 46 is installed at this position, thereby allowing the agitated two-phase refrigerant to reach the expansion unit 43 while maintaining an agitated state. Stable control can be achieved.

[Operation Modes]

Figure 48:
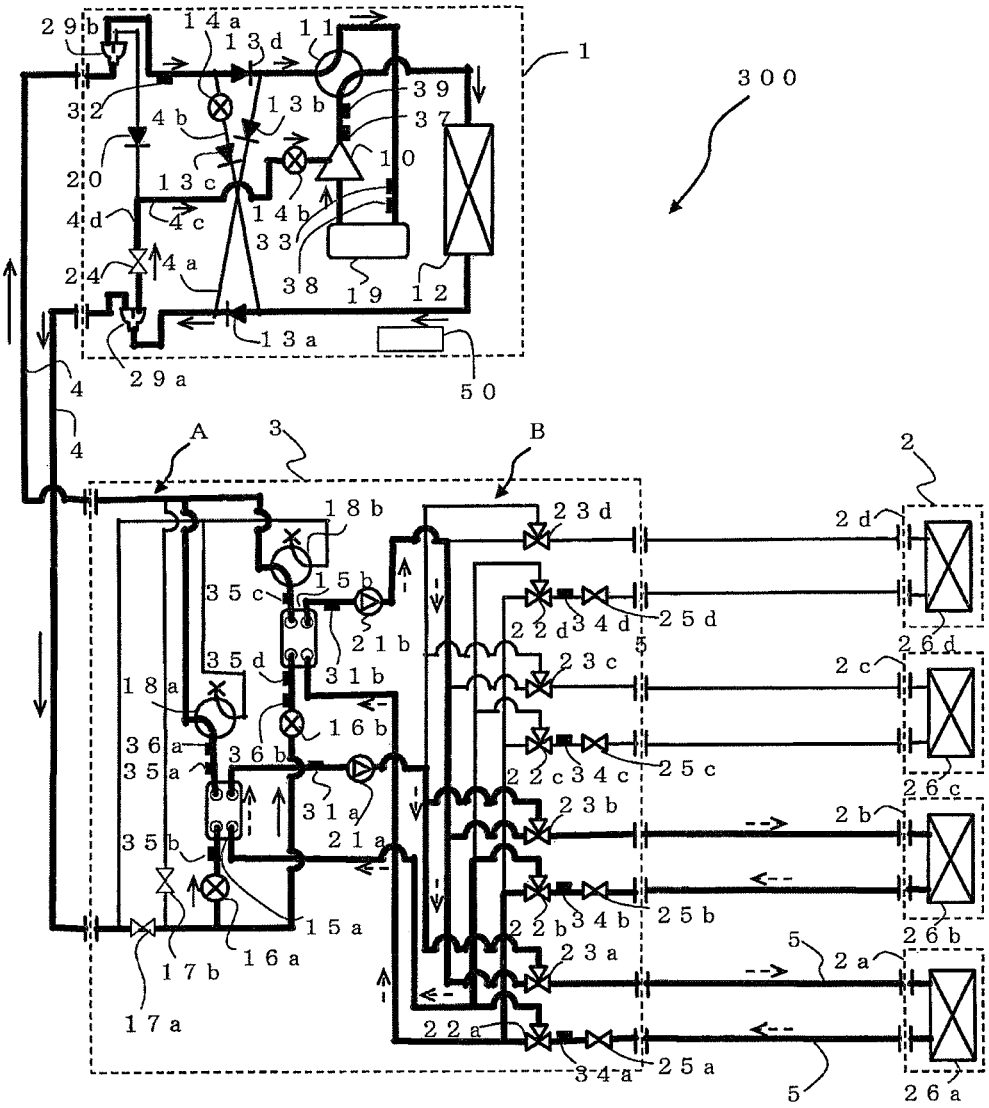
FIG. 48 is a refrigerant circuit diagram illustrating a refrigerant flow when the air-conditioning apparatus according to Embodiment 3 of the present invention is in a cooling only operation mode.
Figure 49:
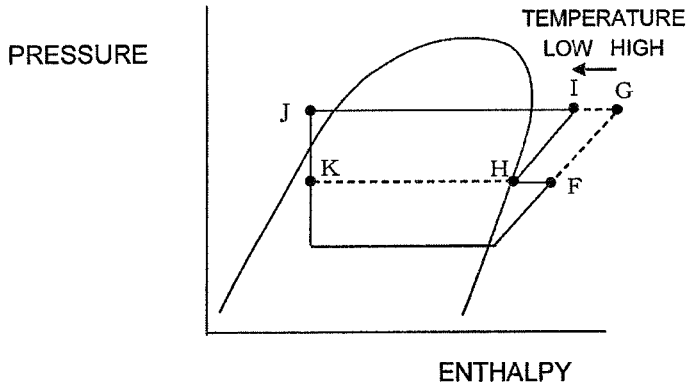
FIG. 49 is a P-h diagram illustrating a state transition of a heat source side refrigerant when the air-conditioning apparatus according to Embodiment 3 of the present invention is in the cooling only operation mode.
Figure 50:
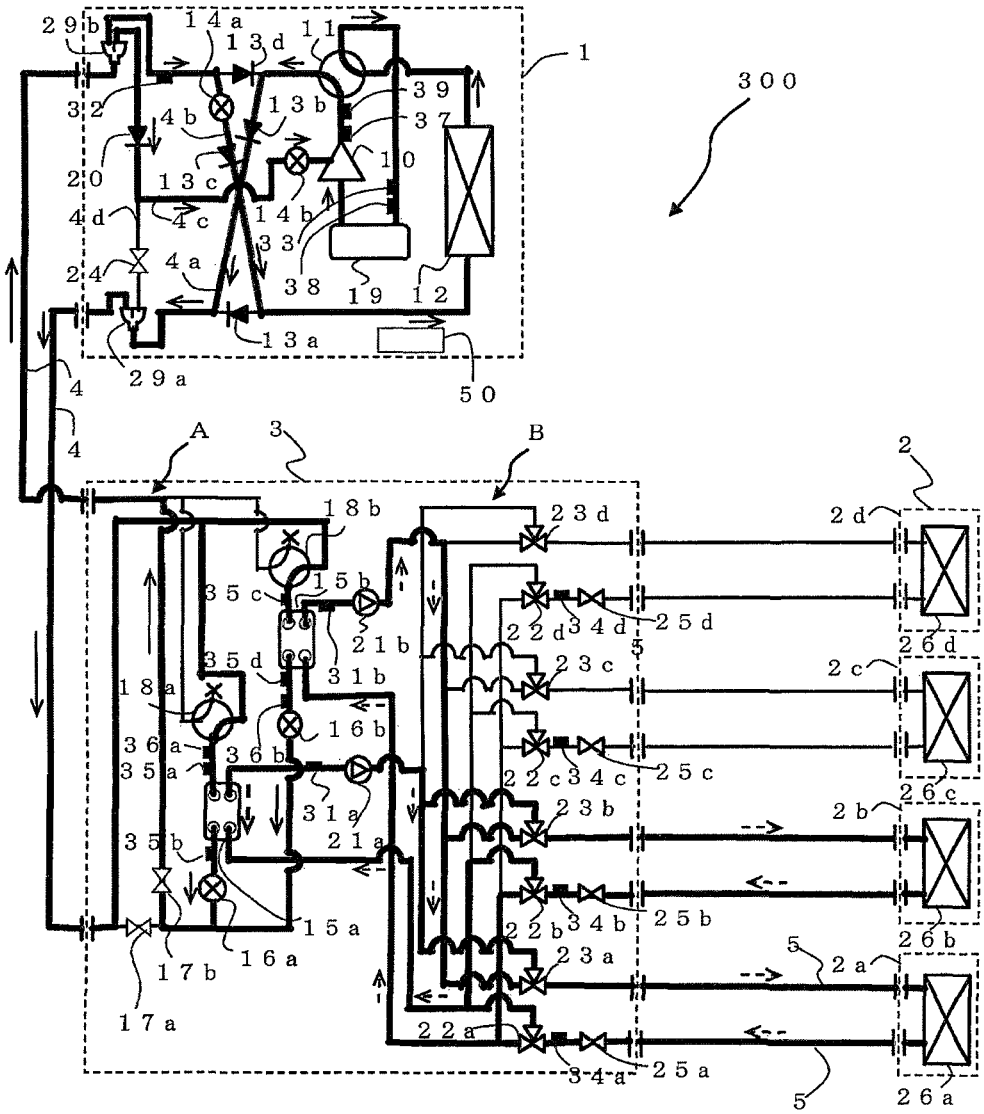
FIG. 50 is a refrigerant circuit diagram illustrating a refrigerant flow when the air-conditioning apparatus according to Embodiment 3 of the present invention is in a heating only operation mode.
Figure 51:
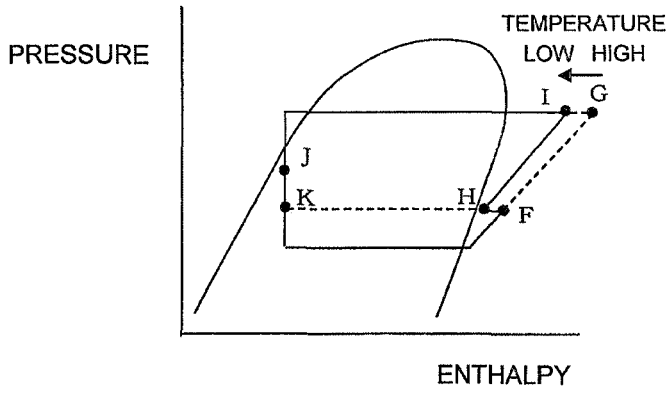
FIG. 51 is a P-h diagram illustrating a state transition of a heat source side refrigerant when the air-conditioning apparatus according to Embodiment 3 of the present invention is in the cooling only operation mode.
Figure 52:
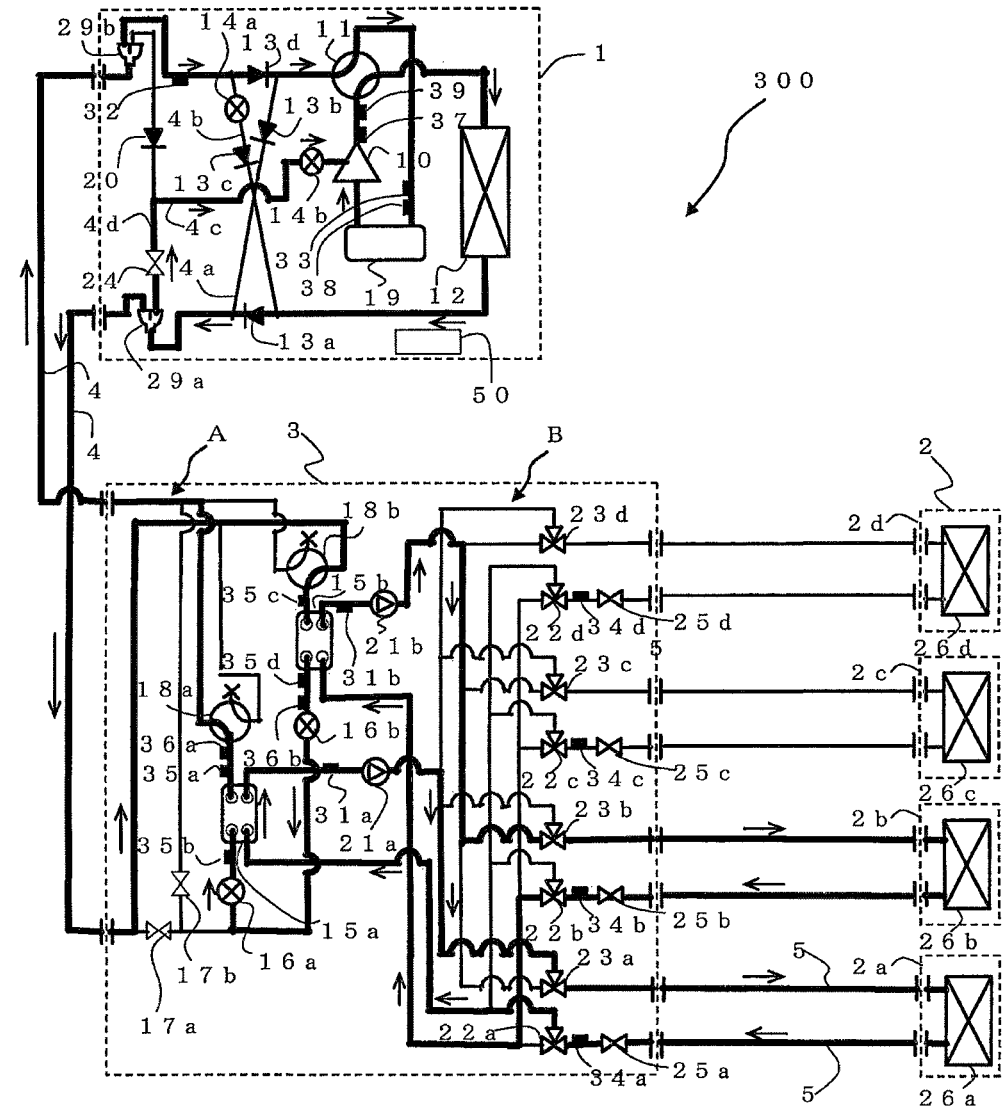
FIG. 52 is a refrigerant circuit diagram illustrating a refrigerant flow when the air-conditioning apparatus according to Embodiment 3 of the present invention is in the cooling main operation mode.
Figure 53:
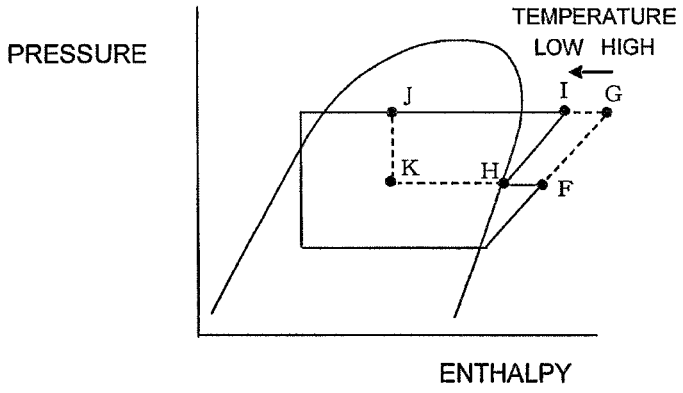
FIG. 53 is a P-h diagram illustrating a state transition of a heat source side refrigerant when the air-conditioning apparatus according to Embodiment 3 of the present invention is in the cooling main operation mode.
Figure 54:
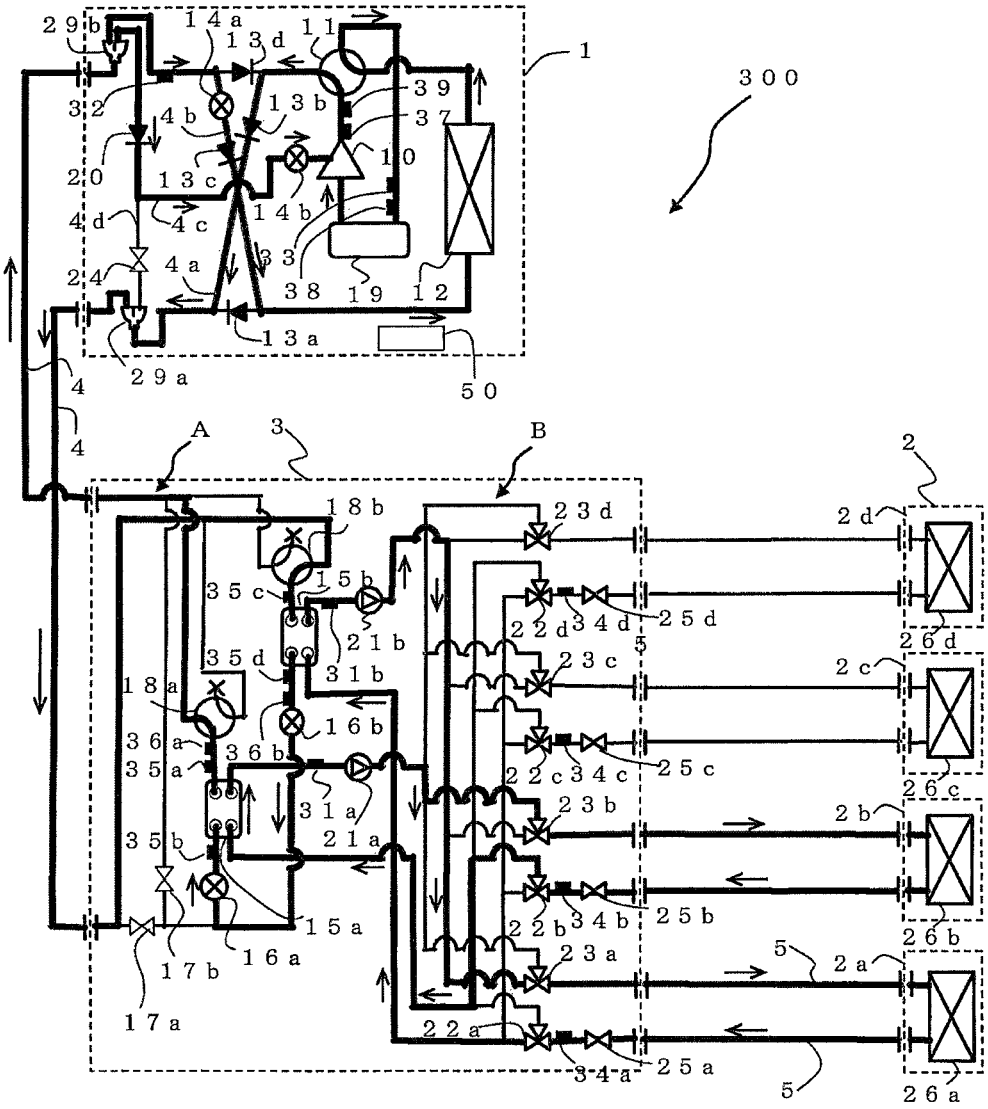
FIG. 54 is a refrigerant circuit diagram illustrating a refrigerant flow when the air-conditioning apparatus according to Embodiment 3 of the present invention is in the heating main operation mode.
Figure 55:
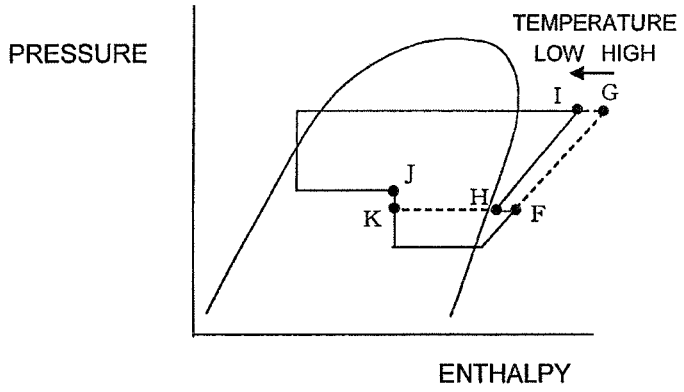
FIG. 55 is a P-h diagram illustrating a state transition of a heat source side refrigerant when the air-conditioning apparatus according to Embodiment 3 of the present invention is in the heating main operation mode.

FIG. 48 is a refrigerant circuit diagram illustrating a refrigerant flow when the air-conditioning apparatus 300 is in the cooling only operation mode. FIG. 49 is a P-h diagram illustrating a state transition of a heat source side refrigerant in the cooling only operation mode. FIG. 50 is a refrigerant circuit diagram illustrating a refrigerant flow when the air-conditioning apparatus 300 is in the heating only operation mode. FIG. 51 is a P-h diagram illustrating a state transition of a heat source side refrigerant in the cooling only operation mode. FIG. 52 is a refrigerant circuit diagram illustrating a refrigerant flow when the air-conditioning apparatus 300 is in the cooling main operation mode. FIG. 53 is a P-h diagram illustrating a state transition of a heat source side refrigerant in the cooling main operation mode. FIG. 54 is a refrigerant circuit diagram illustrating a refrigerant flow when the air-conditioning apparatus 300 is in the heating main operation mode. FIG. 55 is a P-h diagram illustrating a state transition of a heat source side refrigerant in the heating main operation mode.

The flow of a heat source side refrigerant in the individual operation modes of the air-conditioning apparatus 300 is basically the same as the flow of a heat source side refrigerant described in Embodiment 1. In the air-conditioning apparatus 300, since the expansion devices 14 each having the structure illustrated in FIG. 47 are employed, the injection flow rate and the steady-state opening degree of the expansion device 14*a* and the expansion device 14*b* are different. The description will be directed to this point in more detail.

[Expansion Device 14*a* and Expansion Device 14*b*]

It is assumed that an electronic expansion valve is used as each of the expansion device 14*a* and the expansion device 14*b*. In this case, when a refrigerant in a two-phase state flows into the expansion device 14*a* and the expansion device 14*b*, and a gaseous refrigerant and a liquid refrigerant separately flow, the state where a gas flows through the expansion unit and the state where a liquid flows through the expansion unit separately occurs. Then, there are cases in which the pressure on the outlet side may be unstable. This tendency is prominent particularly when the quality is low, because the separation of the refrigerant occurs.

In the air-conditioning apparatus 300, each of the expansion device 14*a* and the expansion device 14*b* has the structure illustrated in FIG. 47. An expansion device having such a structure can achieve stable control even if a two-phase refrigerant flows into the expansion device. As in Embodiment 1, the use of a gas-liquid separator provides sufficiently stable control without using an expansion device having such a structure. However, if, as in Embodiment 2 and Embodiment 3, a gas-liquid separator is not used, an expansion device designed to have such a structure is employed, thereby making it possible to achieve stable control in a manner similar to that in Embodiment 1 regardless of the environmental conditions.

[Injection Control Method for Cooling Only Operation Mode]

The refrigerant injection operation will be described with reference to FIG. 48 and FIG. 49.

The internal volume of the compression chamber decreases while the compression chamber of the compressor 10 is rotated 0 to 360 degrees with a motor (not illustrated). The inside low-temperature and low-pressure gaseous refrigerant that has been sucked into the compression chamber is compressed so that the pressure and the temperature increase in accordance with the decrease in the internal volume of the compression chamber. When the rotation angle of the motor reaches a certain angle, the opening port (formed in part of the compression chamber) is opened (the state indicated by point F in FIG. 49), thereby bringing the inside of the compression chamber and the injection pipe 4*c* located outside the compressor 10 into communication with each other.

The refrigerant compressed by the compressor 10 is condensed and liquified in the heat source side heat exchanger 12 into a high-pressure liquid refrigerant (point J in FIG. 49), and reaches the branch portion 29*a* via the check valve 13*a*. The opening/closing device 24 is set to an opened state, and the flow of the high-pressure liquid refrigerant is split at the branch portion 29*a*. The refrigerant, the flow of which is split at the branch portion 29*a*, flows into the injection pipe 4*c* via the opening/closing device 24 through the branch pipe 4*d*. The refrigerant that has flowed into the injection pipe 4*c* flows into the expansion device 14*b* via the refrigerant-refrigerant heat exchanger 28 to undergo pressure reduction. A low-temperature and intermediate-pressure two-phase refrigerant through pressure reduction is obtained (point K in FIG. 49). Then, the refrigerant is directed into the compression chamber through the opening port formed in the compression chamber of the compressor 10.

In the compression chamber, an intermediate-pressure gaseous refrigerant (point F in FIG. 49) and a low-temperature and intermediate-pressure two-phase refrigerant (point Kin FIG. 49) are mixed, and the temperature of the refrigerant decreases (point H in FIG. 49). The discharge temperature of the refrigerant discharged from the compressor 10 decreases (point I in FIG. 49) accordingly. The discharge temperature of the compressor 10 without performing injection is indicated by point G in FIG. 49. As can be seen, the discharge temperature decreases from point G to point I due to the injection. The branch portion 29*b* has a structure in which the flow of a refrigerant is split while causing the refrigerant to flow from to top in order to uniformly distribute the refrigerant in a two-phase state that has flowed into the branch portion 29*b*. This structure allows more uniform distribution of a two-phase refrigerant.

FIG. 56 illustrates the steady-state opening degrees of the expansion device 14*b* for controlling the injection flow rate when the condensing temperature changes in the cooling only operation mode. In Embodiment 3, the calculation conditions and the calculation processes are similar to those in Embodiment 1, and will not be described.

[Injection Control Method for Heating Only Operation Mode]

The refrigerant injection operation will be described with reference to FIG. 50 and FIG. 51.

The internal volume of the compression chamber of the compressor 10 decreases while the compression chamber is rotated 0 to 360 degrees with a motor. The inside low-temperature and low-pressure gaseous refrigerant that has been sucked into the compression chamber is compressed so that the pressure and the temperature increase in accordance with the decrease in the internal volume of the compression chamber. When the rotation angle of the motor reaches a certain angle, the opening is opened (the state indicated by point F in FIG. 51), thereby bringing the inside of the compression chamber and the injection pipe 4*c* located outside the compressor 10 into communication with each other.

The pressure of the refrigerant returning to the outdoor unit 1 from the heat medium relay unit 3 through the refrigerant pipe 4 is controlled to have an intermediate-pressure state on the upstream side of the expansion device 14*a* due to the operation of the expansion device 14*a* (point J in FIG. 51). The flow of the two-phase refrigerant set to the intermediate-pressure state due to the operation of the expansion device 14*a* is split at the branch portion 29*b*, and part of the refrigerant flows into the branch pipe 4*d*. This refrigerant flows to the injection pipe 4*c* via the backflow prevention device 20. The refrigerant that has flowed to the injection pipe 4*c* flows into the expansion device 14*b* via the refrigerant-refrigerant heat exchanger 28 to undergo pressure reduction. A low-temperature and intermediate-pressure two-phase refrigerant whose pressure has been slightly reduced through the pressure reduction is obtained (point K in FIG. 51). Then, the refrigerant is directed into the compression chamber through the opening port formed in the compression chamber of the compressor 10.

In the compression chamber, an intermediate-pressure gaseous refrigerant (point F in FIG. 51) and a low-temperature and intermediate-pressure two-phase refrigerant (point K in FIG. 51) are mixed, and the temperature of the refrigerant decreases (point H in FIG. 51). The discharge temperature of the refrigerant discharged from the compressor 10 decreases (point I in FIG. 51) accordingly. The discharge temperature of the compressor 10 without performing injection is indicated by point G in FIG. 51. As can be seen, the discharge temperature decreases from point G to point I due to the injection. The structure of the branch portion 29*b* has been described together with the cooling only operation mode.

FIG. 57 illustrates the steady-state opening degrees of the expansion device 14*b* for controlling the injection flow rate and the expansion device 14*a* for controlling the intermediate pressure when the intermediate pressure changes in the heating only operation mode. FIG. 58 illustrates the steady-state opening degrees of the expansion device 14*b* for controlling the injection flow rate and the expansion device 14*a* for controlling the intermediate pressure when the evaporating temperature changes in the heating only operation mode.

[Injection Control Method for Cooling Main Operation Mode]

The refrigerant injection operation will be described with reference to FIG. 52 and FIG. 53.

The internal volume of the compression chamber of the compressor 10 decreases while the compression chamber is rotated 0 to 360 degrees with a motor (not illustrated). The inside low-temperature and low-pressure gaseous refrigerant that has been sucked into the compression chamber is compressed so that the pressure and the temperature increase in accordance with the decrease in the internal volume of the compression chamber. When the rotation angle of the motor reaches a certain angle, the opening port (formed in part of the compression chamber) is opened (the state indicated by point F in FIG. 53), thereby bringing the inside of the compression chamber and the injection pipe 4*c* located outside the compressor 10 into communication with each other.

The refrigerant compressed by the compressor 10 is condensed in the heat source side heat exchanger 12 into a high-pressure two-phase refrigerant (point J in FIG. 53), and reaches the branch portion 29*a* via the check valve 13*a*. The opening/closing device 24 is set to an opened state, and the flow of the high-pressure two-phase refrigerant is split at the branch portion 29*a*. The refrigerant, the flow of which is split at the branch portion 29*a*, flows into the injection pipe 4*c* via the opening/closing device 24 through the branch pipe 4*d*. The refrigerant that has flowed into the injection pipe 4*c* flows into the expansion device 14*b* to undergo pressure reduction. A low-temperature and intermediate-pressure two-phase refrigerant through pressure reduction is obtained (point K in FIG. 53). Then, the refrigerant is directed into the compression chamber through the opening port formed in the compression chamber of the compressor 10.

In the compression chamber, an intermediate-pressure gaseous refrigerant (point F in FIG. 53) and a low-temperature and intermediate-pressure two-phase refrigerant (point K in FIG. 53) are mixed, and the temperature of the refrigerant decreases (point H in FIG. 53). The discharge temperature of the refrigerant discharged from the compressor 10 decreases (point I in FIG. 53) accordingly. The discharge temperature of the compressor 10 without performing injection is indicated by point G in FIG. 53. As can be seen, the discharge temperature decreases from point G to point I due to the injection. The structure of the branch portion 29*b* has been described together with the cooling only operation mode.

FIG. 59 illustrates the steady-state opening degrees of the expansion device 14*b* for controlling the injection flow rate when the indoor heating load (quality) changes in the cooling main operation mode.

[Injection Control Method for Heating Main Operation Mode]

The refrigerant injection operation will be described with reference to FIG. 54 and FIG. 55.

The internal volume of the compression chamber of the compressor 10 decreases while the compression chamber is rotated 0 to 360 degrees with a motor (not illustrated). The inside low-temperature and low-pressure gaseous refrigerant that has been sucked into the compression chamber is compressed so that the pressure and the temperature increase in accordance with the decrease in the internal volume of the compression chamber. When the rotation angle of the motor reaches a certain angle, the opening port (formed in part of the compression chamber) is opened (the state indicated by point F in FIG. 55), thereby bringing the inside of the compression chamber and the injection pipe 4*c* located outside the compressor 10 into communication with each other.

The pressure of the refrigerant returning to the outdoor unit 1 from the heat medium relay unit 3 through the refrigerant pipe 4 is controlled to have an intermediate-pressure state on the upstream side of the expansion device 14*a* due to the operation of the expansion device 14*a* (point J in FIG. 55). The flow of the two-phase refrigerant set to the intermediate-pressure state due to the operation of the expansion device 14*a* is split at the branch portion 29*b*, and part of the refrigerant flows into the branch pipe 4*d*. This refrigerant flows to the injection pipe 4*c* via the backflow prevention device 20. The refrigerant that has flowed to the injection pipe 4*c* flows into the expansion device 14*b* via the refrigerant-refrigerant heat exchanger 28*t*0 undergo pressure reduction. A low-temperature and intermediate-pressure two-phase refrigerant whose pressure has been slightly reduced through the pressure reduction is obtained (point K in FIG. 55). Then, the refrigerant is directed into the compression chamber through the opening port formed in the compression chamber of the compressor 10.

In the compression chamber, an intermediate-pressure gaseous refrigerant (point F in FIG. 55) and a low-temperature and intermediate-pressure two-phase refrigerant (point K in FIG. 55) are mixed, and the temperature of the refrigerant decreases (point H in FIG. 55). The discharge temperature of the refrigerant discharged from the compressor 10 decreases (point I in FIG. 55) accordingly. The discharge temperature of the compressor 10 without performing injection is indicated by point G in FIG. 55. As can be seen, the discharge temperature decreases from point G to point I due to the injection. The structure of the branch portion 29*b* has been described together with the cooling only operation mode.

FIG. 60 illustrates the steady-state opening degrees of the expansion device 14*b* for controlling the injection flow rate and the expansion device 14*a* for controlling the intermediate pressure when the intermediate pressure changes in the heating main operation mode. FIG. 61 illustrates the steady-state opening degrees of the expansion device 14*b* for controlling the injection flow rate and the expansion device 14*a* for controlling the intermediate pressure when the evaporating temperature changes in the heating main operation mode.

As described above, the configuration of the air-conditioning apparatus 300 according to Embodiment 3 also allows separate control of the intermediate pressure and the injection flow rate using the two expansion devices, namely, the expansion device 14*a* and the expansion device 14*b*. The air-conditioning apparatus 300 can control the intermediate pressure and the injection flow rate, as desired, and can achieve stable injection under various conditions.

[Control Method when Operation Mode Changes]

The intermediate pressure and the opening degree of the expansion device 14*a* and the expansion device 14*b* when the operation mode changes are controlled using a method similar to that in Embodiment 1, and therefore will not be described. FIG. 62 to FIG. 64 illustrate the initial opening degrees when the operation mode changes according to Embodiment 3. The calculation conditions and the calculation processes are similar to those in Embodiment 1, and will not be described in detail.

[Injection with Intermediate Pressure Control]

Also in the air-conditioning apparatus 300, the injection control method for the heating only operation mode and the heating main operation mode may be performed by controlling both the intermediate pressure and the discharge temperature of the compressor 10 only with the expansion device 14*a* while the opening degree of the expansion device 14*b* is set to a fully opened state all the time. The flow for a control process for controlling both the intermediate pressure and the discharge temperature of the compressor 10 only with the expansion device 14*a* is similar to that illustrated in FIG. 24 as described in Embodiment 1, and therefore will not be described. There is no change in the injection control method for the cooling only operation mode and the cooling main operation mode, which do not require the intermediate pressure.

The steady-state opening degrees of the expansion device 14*a* for the respective operation modes and the respective intermediate target pressure values are almost the same as the opening degrees illustrated in FIG. 57 to FIG. 60. The steady-state opening degrees of the expansion device 14*a* are used as the initial values for injection control, thereby making it possible to readily stabilize the refrigeration cycle when performing injection with intermediate pressure control.

The method for setting the opening degree of the expansion device 14*b* to a fully opened state and simultaneously controlling the intermediate pressure and the injection flow rate only with the expansion device 14*a* in the heating operation is, in other words, no use of the expansion device 14*b* during heating. Since a high-pressure refrigerant is injected during injection in the cooling operation, the maximum opening degree of the expansion device 14*b* may be small. A small-capacity, low-cost device can thus be used as the expansion device 14*b*.

[Injection with Pressure Differential Control]

Also in Embodiment 3, the injection control method for the heating only operation mode and the heating main operation mode may be performed by, while the opening degree of the expansion device 14*b* is set to a fully opened state all the time, controlling the difference (pressure differential) between the detected value of the intermediate-pressure detecting device 32 and the detected value of the suction pressure detecting device 33 installed near the suction of the compressor 10 only with the expansion device 14*a* to reduce the discharge temperature of the compressor 10. The flow for this control process is similar to that illustrated in FIG. 24 as described in Embodiment 1, and therefore will not be described. There is no change in the injection control method for the cooling only operation mode and the cooling main operation mode, which do not require the intermediate pressure.

FIG. 65 is an explanatory diagram of a table illustrating the steady-state opening degrees of the expansion device 14*a* for the respective operation modes and the respective pressure differential target values. The steady-state opening degrees are obtained as follows: A saturation pressure difference at a temperature difference between an evaporating temperature and a saturation temperature of an intermediate pressure is used as a pressure differential, and the steady-state opening degree of the expansion device 14*a* in this case is obtained from the result of an estimate of an intermediate target pressure value in the heating only operation mode (FIG. 57) and the result of an estimate of an intermediate target pressure value in the heating main operation mode (FIG. 60). The steady-state opening degrees described above are used as the initial values for injection control, thereby making it possible to readily stabilize the refrigeration cycle in a case where injection is performed with pressure differential control.

The method for setting the opening degree of the expansion device 14*b* to a fully opened state and simultaneously controlling the pressure differential and the injection flow rate only with the expansion device 14*a* in the heating operation is, in other words, no use of the expansion device 14*b* during heating. Since a high-pressure refrigerant is injected during injection in the cooling operation, the maximum opening degree of the expansion device 14*b* may be small. A small-capacity, low-cost expansion device can thus be used as the expansion device 14*b*.

As described above, the air-conditioning apparatus 300 according to Embodiment 3 is configured such that due to the operation of the agitating device 46, a gas and a liquid are mixed uniformly even if a two-phase refrigerant flows into the expansion device 14*a* and the expansion device 14*b*. This configuration can achieve stable injection control regardless of the operation mode, and can prevent an excessive increase in the temperature of the refrigerant discharged from the compressor 10. Furthermore, since a gas-liquid separator and the refrigerant-refrigerant heat exchanger 28 are not used, the air-conditioning apparatus 200 can be produced at lower cost.

REFERENCE SIGNS LIST

1 outdoor unit, 2 indoor unit, 2*a* indoor unit, 2*b* indoor unit, 2*c* indoor unit, 2*d* indoor unit, 3 heat medium relay unit, 4 refrigerant pipe, 4*a* first connecting pipe, 4*b* second connecting pipe, 4*c* injection pipe, 4*d* branch pipe, 5 pipe, 6 outdoor space, 7 indoor space, 8 space, 9 structure, 10 compressor, 11 first refrigerant flow switching device, 12 heat source side heat exchanger, 13*a* check valve, 13*b* check valve, 13*c* check valve, 13*d* check valve, 14 expansion device, 14*a* expansion device (second expansion device), 14*b* expansion device (third expansion device), 15 intermediate heat exchanger, 15*m* intermediate heat exchanger, 15*b* intermediate heat exchanger, 16 expansion device (first expansion device), 16*a* expansion device, 16*b* expansion device, 17 opening/closing device, 17*a* opening/closing device, 17*b* opening/closing device, 18 second refrigerant flow switching device, 18*a* second refrigerant flow switching device, 18*b* second refrigerant flow switching device, 19 accumulator, 20 backflow prevention device, 21 pump, 21*a* pump, 21*b* pump, 22 first heat medium flow switching device, 22*a* first heat medium flow switching device, 22*b* first heat medium flow switching device, 22*c* first heat medium flow switching device, 22*d* first heat medium flow switching device, 23 second heat medium flow switching device, 23*a* second heat medium flow switching device, 23*b* second heat medium flow switching device, 23*c* second heat medium flow switching device, 23*d* second heat medium flow switching device, 24 opening/closing device, 24*d* bypass pipe, 25 heat medium flow control device, 25*a* heat medium flow control device, 25*b* heat medium flow control device, 25*c* heat medium flow control device, 25*d* heat medium flow control device, 26 use side heat exchanger, 26*a* use side heat exchanger, 26*b* use side heat exchanger, 26*c* use side heat exchanger, 26*d* use side heat exchanger, 27 gas-liquid separator, 27*a* gas-liquid separator, 27*b* gas-liquid separator, 28 refrigerant-refrigerant heat exchanger, 29*a* branch portion, 29*b* branch portion, 31 first temperature sensor, 31*a* first temperature sensor, 31*b* first temperature sensor, 32 intermediate-pressure detecting device, 33 suction pressure detecting device, 34 second temperature sensor, 34*a* second temperature sensor, 34*b* second temperature sensor, 34*c* second temperature sensor, 34*d* second temperature sensor, 35 third temperature sensor, 35*a* third temperature sensor, 35*b* third temperature sensor, 35*c* third temperature sensor, 35*d* third temperature sensor, 36 pressure sensor, 36*a* pressure sensor, 36*b* pressure sensor, 37 discharge refrigerant temperature detecting device, 38 suction refrigerant temperature detecting device, 39 high-pressure detecting device, 41 inlet pipe, 42 outlet pipe, 43 expansion unit, 44 valve body, 45 motor, 46 agitating device, 50 controller, 100 air-conditioning apparatus, 200 air-conditioning apparatus, 300 air-conditioning apparatus. A refrigerant circuit, B heat medium circuit.

The invention claimed is:

1. An air-conditioning apparatus comprising:

a refrigerant circuit formed by connecting a compressor, a refrigerant flow switching device, a first heat exchanger, a first expansion device, and second heat exchangers by using a pipe, the air-conditioning apparatus being capable of, by an operation of the refrigerant flow switching device, switching between a cooling operation, a heating operation, a cooling only operation mode, and a heating only operation mode, the cooling operation being an operation in which a high-pressure refrigerant flows through the first heat exchanger so that the first heat exchanger operates as a condenser and in which a low-pressure refrigerant flows through at least one or all of the second heat exchangers so that the at least one or all of the second heat exchangers operate as an evaporator or evaporators, the heating operation being an operation in which a low-pressure refrigerant flows through the first heat exchanger so that the first heat exchanger operates as an evaporator and in which a high-pressure refrigerant flows through at least one or all of the second heat exchangers so that the at least one or all of the second heat exchangers operate as a condenser or condensers, the cooling only operation mode in which a high-pressure liquid refrigerant flows through one of the two refrigerant pipes and a low-pressure gaseous refrigerant flows through the other refrigerant pipe, and the heating only operation mode in which a high-pressure gaseous refrigerant flows through one of the two refrigerant pipes and an intermediate-pressure two-phase refrigerant flows through the other refrigerant pipe, the air-conditioning apparatus further comprising an outdoor unit that includes the compressor, the refrigerant flow switching device, and the first heat exchanger;

a heat medium relay unit that includes the first expansion device and the second heat exchangers;

an injection pipe through which the refrigerant is directed into a compression chamber of the compressor, which is in a compression process, from outside the compressor via an opening port formed in part of the compression chamber;

a second expansion device that reduces a pressure of a refrigerant flowing from the second heat exchanger to the first heat exchanger via the first expansion device in the heating operation;

a third expansion device disposed in the injection pipe; and a controller that controls an opening degree of at least one of the second expansion device and the third expansion device to adjust an amount of refrigerant that is to flow through the injection pipe, wherein the injection pipe connects the opening port and a first pipe, the first pipe connecting between a second pipe and a third pipe, the second pipe connecting the first heat exchanger operating as a condenser in the cooling operation and the first expansion device, and the third pipe connecting the first expansion device and the first heat exchanger operating as an evaporator in the heating operation, and the controller controls the opening degree of the third expansion device to be in a fully closed state or a small opening degree that prevents passage of a refrigerant when the air-conditioning apparatus is activated, the controller performs control such that in an operation state where a high pressure and a low pressure of a refrigerant in the cooling only operation mode are identical to a high pressure and a low pressure of a refrigerant in the heating only operation mode, the opening degree of the third expansion device in the heating only operation mode is larger than the opening degree of the third expansion device in the cooling only operation mode.

2. The air-conditioning apparatus of claim 1, wherein while the heating operation is being executed, the controller controls the opening degree of the second expansion device so that a pressure of the refrigerant on an upstream side of the second expansion device is in a certain preset range.

3. The air-conditioning apparatus of claim 1, wherein while the heating operation or the cooling operation is being executed, the controller controls the opening degree of the third expansion device so that a temperature of the refrigerant discharged from the compressor approaches a certain preset value.

4. The air-conditioning apparatus of claim 1, wherein while the heating operation is being executed, the controller controls the opening degree of the third expansion device to be in a substantially fully opened state, and controls the opening degree of the second expansion device so that a pressure of the refrigerant on the upstream side of the second expansion device is in a certain preset range.

5. The air-conditioning apparatus of claim 1, wherein while the heating operation is being executed, the controller controls the opening degree of the second expansion device so that a difference between a pressure of the refrigerant that is to be sucked into the compressor and a pressure of the refrigerant on the upstream side of the second expansion device approaches a preset target value.

6. The air-conditioning apparatus of claim 1, wherein the air-conditioning apparatus further includes a heating main operation mode in which a high-pressure gaseous refrigerant flows through one of the two refrigerant pipes and an intermediate-pressure two-phase refrigerant flows through the other refrigerant pipe, and in which the second heat exchangers include a second heat exchanger operating as a condenser and a second heat exchanger operating as an evaporator, and when an operation mode changes from the heating only operation mode to the heating main operation mode, the controller sets a target pressure value on the upstream side of the second expansion device in the heating main operation mode to a value lower than a target pressure value on the upstream side of the second expansion device in the heating only operation mode.

7. The air-conditioning apparatus of claim 6, wherein the target pressure value on the upstream side of the second expansion device is set to a saturation pressure at 0° C. to 10° C. in the heating main operation mode.

8. The air-conditioning apparatus of claim 1, wherein the air-conditioning apparatus further includes a heating main operation mode in which a high-pressure gaseous refrigerant flows through one of the two refrigerant pipes and an intermediate-pressure two-phase refrigerant flows through the other refrigerant pipe, and in which the second heat exchangers include a second heat exchanger operating as a condenser and a second heat operating as an evaporator, and a cooling main operation mode in which a high-pressure two-phase refrigerant flows through one of the two refrigerant pipes and a low-pressure gaseous refrigerant flows through the other refrigerant pipe, and in which the second heat exchangers include a second heat exchanger operating as a condenser and a second heat exchanger operating as an evaporator, and when an operation mode changes from the heating main operation mode to the cooling main operation mode, the controller switches a state of the refrigerant flow switching device and thereafter decreases the opening degree of the third expansion device by a certain preset value.

9. The air-conditioning apparatus of claim 1, wherein the air-conditioning apparatus further includes a heating main operation mode in which a high-pressure gaseous refrigerant flows through one of the two refrigerant pipes and an intermediate-pressure two-phase refrigerant flows through the other refrigerant pipe, and in which the second heat exchangers include a second heat exchanger operating as a condenser and a second heat exchanger operating as an evaporator, and a cooling main operation mode in which a high-pressure two-phase refrigerant flows through one of the two refrigerant pipes and a low-pressure gaseous refrigerant flows through the other refrigerant pipe, and in which the second heat exchangers include a second heat exchanger operating as a condenser and a second heat exchanger operating as an evaporator, and when an operation mode changes from the cooling main operation mode to the heating main operation mode, the controller switches a state of the refrigerant flow switching device and thereafter increases the opening degree of the third expansion device by a certain preset value.

10. The air-conditioning apparatus of claim 1, wherein the air-conditioning apparatus further includes a cooling main operation mode in which a high-pressure two-phase refrigerant flows through one of the two refrigerant pipes and a low-pressure gaseous refrigerant flows through the other refrigerant pipe, and in which the second heat exchangers include a second heat exchanger operating as a condenser and a second heat exchanger operating as an evaporator, and when an operation mode changes from the cooling main operation mode to the cooling only operation mode, the controller decreases the opening degree of the third expansion device by a certain preset value.

11. The air-conditioning apparatus of claim 1, wherein the air-conditioning apparatus further includes a cooling main operation mode in which a high-pressure two-phase refrigerant flows through one of the two refrigerant pipes and a low-pressure gaseous refrigerant flows through the other refrigerant pipe, and in which the second heat exchangers include a second heat exchanger operating as a condenser and a second heat exchanger operating as an evaporator, and when an operation mode changes from the cooling only operation mode to the cooling main operation mode, the controller increases the opening degree of the third expansion device by a certain preset value.

12. The air-conditioning apparatus of claim 1, further comprising:

an indoor unit that is installed at a position at which the indoor unit is capable of air-conditioning a space to be air-conditioned, the indoor unit accommodating a use side heat exchanger that performs heat exchange with air in the space to be air-conditioned, wherein the indoor unit and the heat medium relay unit are connected using a pair of two heat medium pipes through which a heat medium different from a refrigerant circulates, and the second heat exchangers perform heat exchange between the refrigerant and the heat medium.

* * * * *